US007226727B2

(12) United States Patent
Ohshima et al.

(10) Patent No.: US 7,226,727 B2
(45) Date of Patent: Jun. 5, 2007

(54) SILVER HALIDE COLOR PHOTOGRAPHIC LIGHT-SENSITIVE MATERIAL

(75) Inventors: Naoto Ohshima, Minami-ashigara (JP); Shigeru Shibayama, Minami-ashigara (JP); Naoya Shibata, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/262,987

(22) Filed: Nov. 1, 2005

(65) Prior Publication Data

US 2006/0051711 A1 Mar. 9, 2006

Related U.S. Application Data

(62) Division of application No. 10/608,185, filed on Jun. 30, 2003.

(30) Foreign Application Priority Data

| | | |
|---|---|---|
| Jun. 28, 2002 | (JP) | 2002-190629 |
| Jun. 28, 2002 | (JP) | 2002-190728 |
| Sep. 27, 2002 | (JP) | 2002-284296 |
| Sep. 30, 2002 | (JP) | 2002-285529 |

(51) Int. Cl.
*G03C 1/06* (2006.01)
*G03C 1/005* (2006.01)
*G03C 1/46* (2006.01)

(52) U.S. Cl. ..... 430/604; 430/605; 430/599; 430/567; 430/503; 430/502

(58) Field of Classification Search ..... 430/502, 430/503, 567, 599, 604, 605
See application file for complete search history.

(56) References Cited

U.S. PATENT DOCUMENTS

| | | | | |
|---|---|---|---|---|
| 5,162,195 | A | 11/1992 | Inagaki | |
| 5,399,475 | A | 3/1995 | Hasebe et al. | |
| 5,418,118 | A | 5/1995 | Edwards et al. | |
| 5,691,119 | A | 11/1997 | Mydlarz et al. | |
| 5,736,310 | A | 4/1998 | Chen et al. | |
| 5,783,378 | A | 7/1998 | Mydlarz et al. | |
| 6,706,468 | B2 | 3/2004 | Aiba et al. | |
| 6,727,054 | B2 | 4/2004 | Aiba et al. | |
| 6,949,334 | B2 * | 9/2005 | Ohshima et al. | 430/611 |
| 2002/0076662 | A1 | 6/2002 | Ochiai | |

FOREIGN PATENT DOCUMENTS

| | | | |
|---|---|---|---|
| EP | 0 718 686 | A1 | 6/1996 |
| EP | 0 952 484 | A2 | 10/1999 |
| EP | 1 048 978 | A1 | 11/2000 |
| EP | 1 174 760 | A2 | 1/2002 |
| EP | 1 282 005 | A1 | 2/2003 |
| JP | 3-21947 | A | 1/1991 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material having, on a support, a yellow dye-forming light-sensitive silver halide emulsion layer, a magenta dye-forming light-sensitive silver halide emulsion layer and a cyan dye-forming light-sensitive silver halide emulsion layer, and a light-insensitive hydrophilic colloid layer that does not develop a color, wherein a total amount of a hydrophilic binder on the emulsion layer-coating side of the support is 6.0 g/m$^2$ or less, and at least one of said silver halide emulsion layers contains at least one compound selected from metal complexes represented by formula (I) set forth below and a silver halide emulsion of a 90 mole % or more silver chloride content with a silver bromide-containing phase formed in a layer form.

11 Claims, No Drawings

SILVER HALIDE COLOR PHOTOGRAPHIC LIGHT-SENSITIVE MATERIAL

CROSS-REFERENCE TO RELATED APPLICATION

This application is a divisional of U.S. application Ser. No. 10/608,185 filed Jun. 30, 2003, the disclosure of which is incorporated herein by reference.

FIELD OF THE INVENTION

The present invention relates to a silver halide color photographic light-sensitive material.

The present invention relates, more particularly, to a silver halide color photographic light-sensitive material showing a high sensitivity and a hard gradation even upon a digital exposure such as a laser scanning exposure, and having excellent pressure resistance and rapid processing suitability.

The present invention relates in detail to a high contrast silver halide photographic light-sensitive material suitable for rapid process. More particularly, it relates to a silver halide photographic light-sensitive material providing a stable photographic performance, when rapidly processed.

The present invention relates in detail to a silver halide color photographic light-sensitive material suitable for rapid processing. More particularly, it relates to a silver halide color photographic light-sensitive material capable of giving a stable photographic performance regardless the exposure system, when subjected to a rapid processing.

The present invention relates in detail to a silver halide color photographic light-sensitive material excellent in storability of the light-sensitive material, rapid processability and processing stability. More particularly, it relates to a silver halide color photographic light-sensitive material that is capable of supressing deterioration of a white ground resulting from storage of the light-sensitive material even for a long period of time, and capable of attaining the maximum density upon a rapid color development in a short time as well as a stable photographic performance against a fluctuation in the processing factors.

BACKGROUND OF THE INVENTION

In recent years, digitalization has been remarkably propaganted also in the field of a color print using a color photographic paper. For example, a digital exposure system by laser scanning exposure has been rapidly spread in comparison with a conventional analog exposure system of directly conducting a printing from a processed color negative film using a color printer. The digital exposure system is characterized in that a high image quality is obtained by conducting image processing, and it greatly contributes to improvement of qualities of color prints using a color photographic paper. Further, along with the rapid propagation of digital cameras, it is also considered to be an important factor that a color print with a high image quality is easily obtained from these electronic recording media. It is believed that they will lead to further remarkable popularization.

As the silver halide emulsion for use in a color photographic paper, a silver halide of a high silver chloride content has been used primarily because of a demand for rapid processing whereby productivity can be mainly enhanced. The silver halide emulsion of a high silver chloride content generally has a tendency to cause both low sensitivity and soft gradation enhancement upon a high illuminance exposure such as a laser scanning exposure. Therefore, various investigations to improve such problem have been conducted.

It has been known to dope iridium in order to improve a high illuminance reciprocity law failure of a silver chloride emulsion. However, it has been also known that the silver chloride emulsion with doped iridium causes latent image sensitization in a short time after exposure. For example, JP-B-7-34103 discloses that the problem of latent image sensitization can be overcome by providing a localized phase of high silver bromide content and doping iridium therein. The silver halide emulsion prepared by the aforementioned method slows high sensitivity and hard gradation, and does not cause the problem of latent image sensitization even upon a relatively high illuminance exposure of about 1/100 second. However, another problem has been found by further investigations that it is difficult to obtain hard gradation in a silver halide emulsion still providing high sensitivity even upon an ultra-high illuminance exposure of about 1μ second that is required in a digital exposure system using laser scanning exposure. For example, U.S. Pat. No. 5,691,119 proposes a method of further enhancing high illuminance gradation by preparing emulsion grains with a localized phase of high silver bromide content. However, this method has the disadvantages that an effect on the hard gradation enhancement is neither satisfactory nor photographic performance is stable in repeat of preparation.

For example, U.S. Pat. No. 5,783,378 proposes a method of reducing a high illuminance reciprocity law failure by using at least three kinds of dopants, resulting in hard gradation enhancement. However, the reason why hard gradation can be obtained resides in the use of a dopant acting as a desensitizing and hard gradation-enhancing agent. Therefore, this method is fundamentally incompatible with high sensitivity enhancement.

For example, U.S. Pat. No. 5,736,310 discloses that emulsions having high sensitivity and with a less reciprocity law failure upon high illuminance exposure can be obtained by emulsions containing I having a maximum concentration in a sub-surface of the high silver chloride emulsion. Indeed, along with the increase of illuminance for exposure, high sensitivity can be obtained using the emulsions. However, it has been found that the gradation is so soft that these emulsions are not suitable to digital exposure with a limited dynamic range in terms of light volume.

Further, for example, U.S. Pat. No. 5,399,475 discloses that high sensitivity can be obtained by localizing and incorporating a phase of a high silver bromide content in various forms into emulsion grains of a high silver chloride content.

On the other hand, regarding the color printing system, techniques such as an ink jet system, a sublimation system and a color xerography system have been progressed respectively and accepted as the color printing methods providing an excellent photographic image quality. Among them, the feature of the digital exposure system using the color photographic paper resides in the high image quality, high productivity and high fastness of images. It is desired to further improve these performances and show photographs with higher quality, more readily and economically.

Particularly, if it is possible to receive recording media of digital camera at a shop counter, finish a high quality print in a short period of time of about several minutes and return the same in situ, that is, if one stop service for color printing is possible, superiority of color printing using a color photographic paper is increased much more. Further, if rapid processability of the color photographic paper is improved, a printing equipment of high productivity even with a smaller size and a low price can be used and popularization of the one stop service for a color print can be expected much more. In view of the above, it is particularly important to improve the rapid processability of the color photographic paper.

For enabling one-stop service for color printing using a color photographic paper, it is necessary to study on various view points such as shortening of exposure time, shortening of so-called latent image time from exposure to the start of the processing and shortening of the time from processing to drying, and various proposals have hitherto been made with respect to the individual point set forth above.

Among them, in a case where a time required for exposure per one sheet of print is extremely shorter compared with other systems and a printer has a performance of ordinary printers used in the shop, no substantial problem occurs. A printer has already been designed so as to make the latent image time as short as possible. Further, shortening of the time from processing to drying has also hitherto been made. Further, various means for rapid processing have been proposed, for example, by improving the compositions of the processing solution or processing temperature or stirring conditions for the processing solution, squeeze of the light-sensitive material, and the drying method.

From the above view, the present inventors have made studies on the color development of a color photographic paper for a short time of 28 sec. or lass from both sides of a processing formula and a processing step. However, they failed to solve the problem that the maximum density cannot be attained within such short period of processing time, so long as a conventional color photographic paper is employed.

On the other hand, from the viewpoint of further enhancing superiority of the print obtained by a conventional silver salt-using color photographic paper to the afore-mentioned new color print systems, a demand for reduction in cost of the color photographic paper is increasing more than before. As a means to respond to the demand, it has been considered to provide a color photographic paper for a common use of digital/analogue that is employed for both a digital exposure system and an analogue exposure system respectively. However, it is fairly difficult to obtain a satisfactory performance by the afore-mentioned color photographic paper because there is a definite difference in exposure time between these systems, and in addition reciprocity law failure characteristics and latent image stability. In such circumstances, it has been desired more and more to develop a light-sensitive material with a less difference in photographic performance such as reciprocity law failure and latent image stability, obtained by digital exposure and analogue exposure.

In recent years, in the field of photographic processing services, a photographic light-sensitive material that can be processed rapidly and form a high-quality image is demanded as part of improvement of service to users and as means for improving productivity. To respond to this demand, currently, a rapid processing is usually carried out in which a photographic light-sensitive material containing a high silver chloride emulsion (hereinafter, also referred to as "high silver chloride printing material") is processed in 45 seconds for a color developing time, and in about 4 minutes for a total processing time of from the start of the developing step to the completion of the drying step (for example, Color Processing CP-48S (trade name) or the like, manufactured by Fuji Photo Film Co., Ltd.). However, as compared with the rapidity of making images by other color image making methods (for example, an electrostatic transfer method, a thermal transfer method, an ink jet method), it cannot be said that even this rapid development processing system for high silver chloride printing materials shows a satisfactory rapidity. For this reason, there are demands for a super(ultra)-rapid processing, of which the total processing time from the start of development and the completion of drying of a high silver chloride color printing material, is on the level of about 1 to 2 minutes.

As a means of improving an ultra-rapid processing suitability, it has been considered to reduce a coating amount of organic materials and a coating amount of a hydrophilic binder by employment of a highly active coupler or a coupler capable of providing a large molecular extinction coefficient of a colored dye, and/or to employ a silver halide emulsion that can be rapidly developed. For example, JP-A-3-21947 proposes to set a limitation in terms of a coating amount of a hydrophilic colloid. However, these means are insufficient in terms of compatibility of digital exposure suitability with suitability of ultra-rapid processing which indicates that a total processing time of from start of development up to completion of drying is a level of 1 to 2 minutes.

The present inventors have made intensive studies, and tried to employ a silver halide emulsion comprising silver halide grains containing 90 mole % or more of silver chloride and having both a silver bromide-containing phase and a silver iodide-containing phase each formed in the layer state in the grains for a light-sensitive material containing a hydrophilic binder (colloid) in less than a normal coating amount. However, in this case, unexpected results (phenomena) were found that pressure-sensitized streaks in the yellow color appeared to cause a problem.

In the case where a color photographic paper is subjected to digital exposure by a laser scanning exposure, it is preferable that the color photographic paper has a moderate gradation. That is, if the contrast (gradation) is too high (hard), uneven color such as banding and shading easily occurs and the detail tone at the highlight of a picture tends to disappear. In contrast, if the contrast is too low (soft), it becomes difficult to cover a reproduction region from the end of toe to a high density within a dynamic range of luminous intensity of laser light sources.

For enabling one stop service for color printing using a color photographic paper, it is necessary to study on various view points such as shortening of exposure time, shortening of so-called latent image time from exposure to the start of the processing and shortening of the time from processing to drying, and various proposals have hitherto been made with respect to the individual point set forth above.

Among them, in a case where a time required for exposure per one sheet of print is extremely shorter compared with other systems and a printer has a performance of ordinary printers used in the shop, no substantial problem occurs. A printer has already been designed so as to make the latent image time as short as possible. Further, shortening of the time from processing to drying has also hitherto been made. Further, various means for rapid processing have been proposed, for example, by improving the compositions of the processing solution or processing temperature or stirring conditions for the processing solution, squeeze of the light-sensitive material, and the drying method.

From the above view, the present inventors have tried to color develop a color photographic paper for a short time of 28 sec. or less after the short latent image time of 9 sec. or less. However, it has been found that if a mixture of two kinds of emulsions whose sensitivities are made different by a different grain size is used in the same color-developable layer, a color density particularly at the shoulder portion of the characteristic curve is significantly changed by a fluctuation in the composition of a color developing solution, resulting in making it difficult to obtain a print with a stable performance. Further, it has been found that the instability of performance is remarkable upon a laser scanning exposure. As a result of various studies about resolution of the aforementioned problem, the present inventors have found that the problem can be overcome by employing a silver halide emulsion layer containing a mixture of at least two different kinds of emulsions at least one of which contains a particular metal complex.

JP-A-10-307364 discloses photographic elements composed of a photographic emulsion comprising at least two different kinds of emulsions each containing the same silver halide grains, except that the grains of at least one emulsion are treated with a compound capable of lowering sensitivity. As the compound capable of lowering sensitivity, a particular disulfide compound is described. It is also disclosed that the use of the compound enables to readily prepare a plurality of emulsions with a different sensitivity from each other, and to lessen the amounts of sensitizing dyes and agents for chemical sensitization compared with a low sensitive emulsion prepared by the use of small size grains, thereby reducing a cost.

JP-A-3-192346 and JP-A-3-241342 disclose to use a mixture of emulsions different in a content of iridium by 40% or more. It is described that a mixture of the emulsions enables to form images such that a fluctuation in sensitivity and gradation resulting from a change of exposure illuminance is reduced.

However, regarding the color photographic paper, if it is stored in the state of the light-sensitive material before exposure, a fog density of the yellow dye-developable layer in particular tends to increase so easily that a white ground after exposure and processing sometimes deteriorates particularly in the yellowish direction. In other color printing systems such as ink jet and color xerography, an ink or toner is laid on an only image portion, so that a quality of the white ground essentially depends on the whiteness of a support. Accordingly, a problem of fogging resulting from storage is one of subject matters necessary to be improved in the color photographic paper. As a result of our investigations, it has been made clear that the deterioration of white ground results from fogging of an emulsion by the action of natural radiation. Besides, it is important to minimize fluctuation in photographic performance resulting from a change of processing factors in order to stabilize and uniform a coloring density of a color photographic paper. The photographic performances to be improved in particular are a so-called "back contamination" that is a technical term employed to indicate an increase of density resulting from a mixing of a bleach-fixing solution in a color developing solution, as well as a "squeegeeing unevenness" resulting from a squeegeeing inadequacy between a color developing solution and a bleach-fixing solution. Particularly when a rapid processing is carried out, a processing dependency of these adverse performances sometimes increases. Therefore, it is very important to improve these adverse performances thereby obtaining a stable and uniform coloring. Accordingly from the viewpoints of overcoming week points compared to competing printing systems thereby enhancing superiority of the color photographic paper, it is important to improve deterioration of a white ground resulting from storage of the color photographic paper in the state of a light-sensitive material before exposure as well as a change or unevenness of the coloring density resulting from fluctuation in processing factors.

Usually, as a silver halide emulsion for use in a color photographic paper, a silver halide emulsion of a high silver chloride content is used from a demand for rapid processability. It has been known to incorporate various metal complexes in the silver halide emulsion of a high silver chloride content. Further, it has been known to dope an Ir complex in order to improve high illuminance reciprocity law failure of a silver chloride emulsion and in order to obtain high contrast gradation even upon a high illuminance (exposure). For example, JP-B-7-34103 discloses that the problem of latent image sensitization is overcome by providing a localized phase of a high silver bromide content and doping an Ir complex therein. U.S. Pat. No. 4,933,272 discloses that the low illuminance reciprocity law failure can be decreased by incorporating a metal complex containing NO or NS in a ligand. U.S. Pat. Nos. 5,360,712, 5,457,021, and 5,462,849 disclose that the reciprocity law failure can be decreased by incorporation of metal complexes comprising specified organic ligands. U.S. Pat. Nos. 5,372,926, 5,255,630, 5,255,451, 5,597,686, 5,480,771, 5,474,888, 5,500,335, 5,783,373 and 5,783,378 disclose that the performance such as the reciprocity law failure characteristic of the emulsion of a high silver chloride content can be improved by the combination of an Ir complex or a metal complex containing NO as a ligand. JP-A-2000-250156, JP-A-2001-92066 and JP-A-2002-31866 disclose a technique of producing an emulsion providing excellent latent image stability after exposure by the combination of an Ir complex and a Rh complex.

Further, JP-A-58-95736, JP-A-58-108533, JP-A-60-222844, JP-A-60-222845, JP-A-62-253143, JP-A-62-253144, JP-A-62-253166, JP-A-62-254139, JP-A-63-46440, JP-A-63-46441, JP-A-63-89840, U.S. Pat. Nos. 4,820,624, 4,865,962, 5,399,475, and 5,284,743 disclose that high sensitivity can be obtained by localization and incorporation of a phase of high silver bromide content in various forms into an emulsion of high silver chloride content.

Further, U.S. Pat. Nos. 5,726,005 and 5,736,310 disclose that emulsions with high sensitivity and less high illuminance reciprocity law failure can be obtained by emulsions containing I (band) having a maximum density in the sub-surface of the silver chloride emulsion. European Patent (EP) No. 0,928,988A disclose in the example that the emulsions excellent in reciprocity law failure, temperature dependence upon exposure or pressure property can be obtained by incorporation of a specified compound in the grains having I band formed at the 93% step of grain formation.

However, the known techniques described above do not mention the improvement in the photographic characteristic at carrying out the color-develop step within 28 sec. In detail, these known techniques do not disclose that the use of at least two emulsions containing a particular metal complex will improve the instability of photographic performances in the case where after a short latent image time of 9 sec. or less, color development is carried out within a short time of 28 sec., even though a moderate gradation can be obtained upon a digital exposure by a laser scanning exposure.

Further, these known technical reports are silent in a silver halide color photographic light-sensitive material with deterioration of a white ground resulting from storage of the color photographic paper being lessened even for a long period of time, and capable of providing the maximum density upon a rapid color development in a short period of time as well as a stable photographic performance against a fluctuation in the processing factors.

SUMMARY OF THE INVENTION

The present invention provides a silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color; wherein a total amount of a hydrophilic binder on the emulsion layer-coating side of the support is 6.0 g/m$^2$ or less, and at least one of said silver halide emulsion layers contains at least one compound selected from metal complexes represented by formula (I) set forth below and a silver halide emulsion of a 90 mole % or more silver chloride content with a silver bromide-containing phase formed in a layer form:

$$[IrX^I_nL^I_{(6-n)}]^m \qquad \text{Formula (I)}$$

wherein $X^I$ represents a halogen ion or a pseudo halogen ion other than a cyanate ion; $L^I$ represents a ligand different from $X^I$; n represents an integer of 3 to 5; and m represents an integer of −5 to +1.

The present invention also provides a silver halide photographic light-sensitive material having at least one silver halide emulsion layer on a support, wherein said silver halide emulsion layer contains at least two silver halide emulsions with 90 mole % or more of silver chloride which have different sensitivities from each other, and at least one of said silver halide emulsions contains at least one compound selected from metal complexes represented by formula (I) set forth below:

$$[IrX^I_nL^I_{(6-n)}]^m \qquad \text{Formula (I)}$$

wherein $X^I$ represents a halogen ion or a pseudo halogen ion other than a cyanate ion; $L^I$ represents a ligand different from $X^I$; n represents an integer of 3 to 5; and m represents an integer of −5 to +1.

The present invention further provides a silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a total coating amount of silver in the photographic constituent layers is in the range of 0.20 g/m$^2$ to 0.50 g/m$^2$, and at least one of said silver halide emulsion layers contains at least one silver halide emulsion (i) set forth below: (i) a silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below:

$$[IrX^I_nL^I_{(6-n)}]^m \qquad \text{Formula (I)}$$

wherein $X^I$ represents a halogen ion or a pseudo halogen ion; $L^I$ represents a ligand different from $X^I$; n represents an integer of 3 to 5; and m represents an integer of −5 to +1;

$$[MX^{II}_{n1}L^{II}_{(6-n1)}]^{m1} \qquad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

The present invention furthermore provides a silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral (tetrakaidecahedral) silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more.

Other and further, features and advantages of the invention will appear more fully from the following description.

DETAILED DESCRIPTION OF THE INVENTION

According to the present invention, there are provided the following means:

(1) A silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color; wherein a total amount of a hydrophilic binder on the emulsion layer-coating side of the support is 6.0 g/m$^2$ or less, and at least one of said silver halide emulsion layers contains at least one compound selected from metal complexes represented by formula (I) set forth below and a silver halide emulsion of a 90 mole % or more silver chloride content with a silver bromide-containing phase formed in a layer form;

$$[IrX^I_nL^I_{(6-n)}]^m \qquad \text{Formula (I)}$$

wherein $X^I$ represents a halogen ion or a pseudo halogen ion other than a cyanate ion; $L^I$ represents a ligand different from $X^I$; n represents an integer of 3 to 5; and m represents an integer of −5 to +1.

(2) A silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color; wherein a total amount of a hydrophilic binder on the emulsion layer-coating side of the support is 6.0 g/m$^2$ or less, and at least one of said silver halide emulsion layers contains at least one compound selected from metal complexes represented by formula (I) set forth below and a silver halide emulsion of a 90 mole % or more silver chloride content with a silver iodide-containing phase formed in a layer form;

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1.

(3) A silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color; wherein a total amount of a hydrophilic binder on the emulsion layer-coating side of the support is 6.0 g/m$^2$ or less, and at least one of said silver halide emulsion layers contains at least one compound selected from metal complexes represented by formula (I) set forth below and a silver halide emulsion of a 90 mole % or more silver chloride content with a silver bromide-containing phase and a silver iodide-containing phase each formed in a layer form;

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1.

(The above-mentioned items (1) to (3) are grouped as a mode of a first embodiment of the present invention.)

(4) The silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color; wherein a total coating amount of silver in the photographic constituent layers is in the range of 0.2 g/m$^2$ to 0.5 g/m$^2$, and at least one of said silver halide emulsion layers contains at least one compound selected from metal complexes represented by formula (I) set forth below and a silver halide emulsion of a 90 mole % or more silver chloride content with a silver bromide-containing phase and a silver iodide-containing phase each formed in a layer form;

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1.

(The above-mentioned item (4) is referred to as another mode of a first embodiment of the present invention.)

(5) The silver halide color photographic light-sensitive material described in any one of items (1) to (4), wherein said metal complex represented by formula (I) set forth above is represented by the following formula (IA):

$$[IrX^{IA}_{n}L^{IA}_{(6-n)}]^{m} \quad \text{Formula (IA)}$$

wherein $X^{IA}$ represents a halogen ion or a pseudo halogen ion other than a cyanate ion; $L^{IA}$ represents an inorganic ligand different from $X^{IA}$; n represents an integer of 3 to 5; and m represents an integer of −5 to +1.

(6) The silver halide color photographic light-sensitive material described in any one of items (1) to (4), wherein said metal complex represented by formula (I) set forth above is represented by the following formula (IB):

$$[IrX^{IB}_{n}L^{IB}_{(6-n)}]^{m} \quad \text{Formula (IB)}$$

wherein $X^{IB}$ represents a halogen ion or a pseudo halogen ion other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; n represents an integer of 3 to 5; and m represents an integer of −5 to +1.

(7) The silver halide color photographic light-sensitive material described in any one of items (1) to (4), wherein said metal complex represented by formula (I) set forth above is represented by the following formula (IC):

$$[IrX^{IC}_{n}L^{IC}_{(6-n)}]^{m} \quad \text{Formula (IC)}$$

wherein $X^{IC}$ represents a halogen ion or a pseudo halogen ion other than cyanate ion; $L^{IC}$ represents a 5-membered ring ligand having at least one nitrogen atom and at least one sulfur atom in its ring skeleton that may have a substituent (which may arbitrarily selected) on the carbon atoms in said ring skeleton; n represents an integer of 3 to 5; and m represents an integer of −5 to +1.

(8) The silver halide color photographic light-sensitive material described in any one of items (1) to (4), wherein said metal complex represented by formula (I) set forth above is represented by the following formula (ID):

$$[IrX^{ID}_{n}L^{ID}_{(6-n)}]^{m} \quad \text{Formula (ID)}$$

wherein $X^{ID}$ represents a halogen ion or a pseudo halogen ion other than a cyanate ion; $L^{ID}$ represents a 5-membered ring ligand having at least two nitrogen atom and at least one sulfur atom in its ring skeleton that may have a substituent on the carbon atoms in said ring skeleton; n represents an integer of 3 to 5; and m represents an integer of −5 to +1.

(9) The silver halide color photographic light-sensitive material described in any one of items (1) to (8), wherein a silver halide emulsion of a silver halide emulsion layer containing a yellow dye-forming coupler comprises silver halide grains having an equivalent-sphere diameter of 0.6 μm or less.

(10) A method of forming images comprising the steps of laser scanning exposing the silver halide color photographic light-sensitive material described in any one of items (1) to (9), and subjecting the exposed silver halide color photographic light-sensitive material to developing processing with a time requirement of 90 seconds or less in terms of dry to dry.

(The silver halide color photographic light-sensitive materials mentioned in items (1) to (9) above and the method of forming images mentioned in item (10) above are grouped as a first embodiment of the present invention.)

(11) A silver halide photographic light-sensitive material having at least one silver halide emulsion layer on a support, said silver halide emulsion layer containing at least two silver halide emulsions with 90 mole % or more of silver chloride and different sensitivities from each other, and at least one of said silver halide emulsions containing at least one complex selected from metal complexes represented by formula (I) set forth below;

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1.

(12) A silver halide photographic light-sensitive material having at least one silver halide emulsion layer on a support, said silver halide emulsion layer containing at least two silver halide emulsions with 90 mole % or more of silver chloride and different sensitivities from each other, and at least one of said silver halide emulsions containing at least one compound selected from metal complexes represented by formula (II) set forth below;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents a charge of the metal complex and it is an integer of −4 to +1.

(13) A silver halide photographic light-sensitive material having at least one silver halide emulsion layer on a support, said silver halide emulsion layer containing at least two silver halide emulsions with 90 mole % or more of silver chloride and different sensitivities from each other, and at least one of said silver halide emulsions containing at least one compound selected from metal complexes represented by formula (I) and at least one compound selected from metal complexes represented by formula (II) respectively set forth below;

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents a charge of the metal complex and it is an integer of −4 to +1.

(14) The silver halide photographic light-sensitive material described in any one of items (11) to (13), wherein a content of at least one compound selected from said metal complexes represented by formula (I) per mole of silver halide is greater in a lower sensitivity emulsion than in a higher sensitivity emulsion of said two silver halide emulsions with different sensitivities from each other.

(15) The silver halide photographic light-sensitive material described in any one of items (11), (13) and (14), wherein an average content of at least one compound selected from said metal complexes represented by formula (I) per one silver halide grain is greater in a lower sensitivity emulsion than in a higher sensitivity emulsion of said two silver halide emulsions with different sensitivities from each other.

(16) The silver halide photographic light-sensitive material described in any one of items (11), (13), (14) and (15), wherein a degree of desensitization due to at least one compound selected from said metal complexes represented by formula (I) is greater in a lower sensitivity emulsion than in a higher sensitivity emulsion of said two silver halide emulsions with different sensitivities from each other.

(17) The silver halide photographic light-sensitive material described in any one of items (12) to (13), wherein a content of at least one compound (member) selected from said metal complexes represented by formula (II) per mole of silver halide is greater in a lower sensitivity emulsion than in a higher sensitivity emulsion of said two silver halide emulsions with different sensitivities from each other.

(18) The silver halide photographic light-sensitive material described in any one of items (12), (13) and (17), wherein an average content of at least one compound selected from said metal complexes represented by formula (II) per one silver halide grain is greater in a lower sensitivity emulsion than in a higher sensitivity emulsion of said two silver halide emulsions with different sensitivities from each other.

(19) The silver halide photographic light-sensitive material described in any one of items (12), (13), (17) and (18), wherein a degree of desensitization due to at least one compound selected from said metal complexes represented by formula (II) is greater in a lower sensitivity emulsion than in a higher sensitivity emulsion of said two silver halide emulsions with different sensitivities from each other.

(20) The silver halide photographic light-sensitive material described in any one of items (11) to (19), wherein said two silver halide emulsions with different sensitivities from each other contain silver halide grains having an equivalent-sphere diameter of 0.6 μm or less respectively.

(21) The silver halide color photographic light-sensitive material described in any one of items (11) and (13) to (16), wherein said metal complex represented by formula (I) set forth above is represented by the following formula (IA):

$$[IrX^{IA}_{n}L^{IA}_{(6-n)}]^{m} \quad \text{Formula (IA)}$$

wherein $X^{IA}$ represents a halogen ion or a pseudo halogen ion other than a cyanate ion; $L^{IA}$ represents an inorganic ligand different from $X^{IA}$; n represents an integer of 3 to 5; and m represents an integer of −5 to +1.

(22) The silver halide photographic light-sensitive material described in any one of items (11) and (13) to (16), wherein said metal complex represented by formula (I) set forth above is represented by the following formula (IB):

$$[IrX^{IB}_{n}L^{IB}_{(6-n)}]^{m} \quad \text{Formula (IB)}$$

wherein $X^{IB}$ represents a halogen ion or a pseudo halogen ion other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; n represents an integer of 3 to 5; and m represents an integer of −5 to +1.

(23) The silver halide photographic light-sensitive material described in any one of items (11) and (13) to (16), wherein said metal complex represented by formula (I) set forth above is represented by the following formula (IC):

$$[IrX^{IC}_{n}L^{IC}_{(6-n)}]^{m} \quad \text{Formula (IC)}$$

wherein $X^{IC}$ represents a halogen ion or a pseudo halogen ion other than a cyanate ion; $L^{IC}$ represents a 5-membered ring ligand having at least one nitrogen atom and at least one sulfur atom in its ring skeleton that may have a substituent on the carbon atoms in said ring skeleton; n represents an integer of 3 to 5; and m represents an integer of −5 to +1.

(24) The silver halide photographic light-sensitive material described in any one of items (11) and (13) to (16), wherein said metal complex represented by formula (I) set forth above is represented by the following formula (ID):

$$[IrX^{ID}_{n}L^{ID}_{(6-n)}]^{m} \quad \text{Formula (ID)}$$

wherein $X^{ID}$ represents a halogen ion or a pseudo halogen ion other than a cyanate ion; $L^{ID}$ represents a 5-membered ring ligand having at least two nitrogen atom and at least one sulfur atom in its ring skeleton that may have a substituent on the carbon atoms in said ring skeleton; n represents an integer of 3 to 5; and m represents an integer of −5 to +1.

(25) The silver halide photographic light-sensitive material described in any one of items (12), (13) and (17) to (19), wherein said metal complex represented by formula (II) set forth above is represented by the following formula (IIA):

$$[M^{IIA}X^{IIA}_{n1}L^{IIA}_{(6-n1)}]^{m1} \quad \text{Formula (IIA)}$$

wherein $M^{IIA}$ represents Re, Ru, Os, or Rh; $X^{IIA}$ represents a halogen ion; $L^{IIA}$ represents NO or NS, when $M^{IIA}$ is Re, Ru, or Os, and $L^{IIA}$ represents $H_2O$, OH or O, when $M^{IIA}$ is Rh; n1 represents an integer of 3 to 6; and m1 represents a charge of the metal complex and it is an integer of −4 to +1.

(26) The silver halide photographic light-sensitive material described in any one of items (11) to (25), wherein a total amount of silver coated on the silver halide photographic light-sensitive material is 0.2 g/m$^2$ or more and 0.5 g/m$^2$ or less.

(27) The silver halide photographic light-sensitive material described in any one of items (11) to (26), wherein a total amount of a hydrophilic binder (such as gelatin) coated on the support of the silver halide photographic light-sensitive material is 3 g/m$^2$ or more and 6 g/m$^2$ or less.

(28) The silver halide photographic light-sensitive material described in any one of items (11) to (27), wherein the light-sensitive material is a silver halide color photographic light-sensitive material having, on a reflective support, at least one silver halide emulsion layer containing a yellow dye-forming coupler, at least one silver halide emulsion layer containing a magenta dye-forming coupler and at least one silver halide emulsion layer containing a cyan dye-forming coupler.

(29) The silver halide color photographic light-sensitive material described in any one of items (11) to (28), for use in a rapid processing in which a color development starts within 9 minutes after imagewise exposure of the silver halide photographic light-sensitive material and the color development is carried out for 28 sec. or less to form image.

(30) The silver halide photographic light-sensitive material described in item (29), wherein the silver halide emulsion of the silver halide emulsion layer containing a yellow dye-forming coupler is a silver halide emulsion of an equivalent-sphere diameter of 0.6 μm or less.

(31) The silver halide photographic light-sensitive material described in items (11) to (30), wherein at least one of said silver halide emulsions in the silver halide emulsion layer contains 0.1 to 7 mole % of silver bromide that is forming a silver bromide-containing phase of a higher silver bromide content than the neighborhood.

(32) The silver halide photographic light-sensitive material described in items (11) to (31), wherein at least one of said silver halide emulsions in the silver halide emulsion layer contains 0.02 to 1 mole % of silver iodide that is forming a silver iodide-containing phase of a higher silver iodide content than the neighborhood.

(33) The silver halide photographic light-sensitive material described in any one of items (11) to (32), for use in digital exposure in which the silver halide photographic light-sensitive material is imagewise exposed by a laser scanning exposure.

(34) The silver halide photographic light-sensitive material described in any one of items (11) to (33), for use in digital exposure in which the silver halide photographic light-sensitive material is imagewise exposed by a scanning exposure using a blue semiconductor laser having emission wavelength of 420 nm to 460 nm.

(35) A method of forming images comprising imagewise exposing the silver halide photographic light-sensitive material described in any one of items (11) to (32) by a laser scanning exposure.

(36) A method of forming images comprising imagewise exposing the silver halide photographic light-sensitive material described in any one of items (11) to (33) by a scanning exposure using a blue semiconductor laser having emission wavelength of 420 nm to 460 nm.

(The silver halide color photographic light-sensitive materials mentioned in items (11) to (34) above and the methods of forming images mentioned in items (35) and (36) above are grouped as a second embodiment of the present invention.)

(37) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a total coating amount of silver in the photographic constituent layers is in the range of 0.20 g/m$^2$ to 0.50 g/m$^2$, and at least one of said silver halide emulsion layers contains at least one silver halide emulsion (i) set forth below:

(i) A silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below;

$$[IrX^{I}_{n}L^{I}_{(6-n)}]^{m} \quad \text{Formula (I)}$$

wherein $X^{I}$ represents a halogen ion or a pseudo halogen ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

(38) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a total coating amount of gelatin (or hydrophilic binder) in the photographic constituent layers is in the range of 3.0 g/m$^2$ to 6.0 g/m$^2$, and at least one of said silver halide emulsion layers contains said silver halide emulsion of (i) set forth below;

(i) a silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below;

$$[IrX^{I}_{n}L^{I}_{(6-n)}]^{m} \quad \text{Formula (I)}$$

wherein $X^{I}$ represents a halogen ion or a pseudo halogen ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

(39) The silver halide color photographic light-sensitive material described in item (37) or (38), on a support, having constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein an average equivalent-sphere diameter of entire silver halide emulsion grains contained in said silver halide emulsion layers is 0.50 μm or less.

(40) The silver halide color photographic light-sensitive material described in any of items (37) to (39), wherein the metal complex represented by formula (I) described above is represented by formula (IA) set forth below;

$$[IrX^{IA}_{n}L^{IA}_{(6-n)}]^{m} \quad \text{Formula (IA)}$$

wherein $X^{IA}$ represents a halogen ion or a pseudo halogen ion; $L^{IA}$ represents an inorganic ligand different from $X^{IA}$ n represents an integer of 3 to 5; and m represents an integer of −5 to +1.

(41) The silver halide color photographic light-sensitive material described in any of items (37) to (39), wherein the metal complex represented by formula (I) described above is represented by formula (IB) set forth below;

$$[IrX^{IB}_{n}L^{IB}_{(6-n)}]^{m} \quad \text{Formula (IB)}$$

wherein $X^{IB}$ represents a halogen ion or a pseudo halogen ion; $L^{IB}$ represents a ligand having a chain or cyclic hydrocarbon as a basic structure, or in which a portion of carbon atoms or hydrogen atoms of the basic structure is substituted with other atoms or atom groups; n represents an integer of 3 to 5; and m represents an integer of −5 to +1.

(42) The silver halide color photographic light-sensitive material described in any of items (37) to (39), wherein the metal complex represented by formula (I) described above is represented by formula (IC) set forth below;

$$[IrX^{IC}_{n}L^{IC}_{(6-n)}]^{m} \quad \text{Formula (IC)}$$

wherein $X^{IC}$ represents a halogen ion or a pseudo halogen ion; $L^{IC}$ represents a 5-membered ring ligand having at least one nitrogen atom and at least one sulfur atom in its ring skeleton that may have a substituent on the carbon atoms in said ring skeleton; n represents an integer of 3 to 5; and m represents an integer of −5 to +1.

(43) The silver halide color photographic light-sensitive material described in any of items (37) to (39), wherein the metal complex represented by formula (I) described above is represented by formula (ID) set forth below;

$$[IrX^{ID}_{n}L^{ID}_{(6-n)}]^{m} \quad \text{Formula (ID)}$$

wherein $X^{ID}$ represents a halogen ion or a pseudo halogen ion; $L^{ID}$ represents a 5-membered ring ligand having at least two nitrogen atom and at least one sulfur atom in its ring skeleton that may have a substituent on the carbon atoms in said ring skeleton; n represents an integer of 3 to 5; and m represents an integer of −5 to +1.

(44) The silver halide color photographic light-sensitive material described in any of items (37) to (43), wherein the metal complex represented by formula (II) described above is represented by formula (IIA) set forth below;

$$[M^{IIA}X^{IIA}_{n1}L^{IIA}_{(6-n1)}]^{m1} \quad \text{Formula (IIA)}$$

wherein $M_{IIA}$ represents Re, Ru, Os, or Rh,; $X_{IIA}$ represents a halogen ion; when $M_{IIA}$ is Re, Ru, or Os, $L_{IIA}$ represents NO, or NS, while when $M^{IIA}$ is Rh, $L^{IIA}$ represents $H_2O$, OH or O; n1 represents an integer of 3 to 6; and m1 represents an integer of −5 to +1.

(45) The silver halide color photographic light-sensitive material described in any of items (37) to (44), wherein silver halide emulsion grains contained in said silver halide emulsion layer contains 0.1 to 7 mole % of silver bromide that forms a silver bromide-containing phase of a higher silver bromide concentration than the neighborhood.

(46) The silver halide color photographic light-sensitive material described in any of items (37) to (45), wherein silver halide emulsion grains contained in said silver halide emulsion layer contains 0.02 to 1 mole % of silver iodide that forms a silver iodide-containing phase of a higher silver iodide concentration than the neighborhood.

(47) The silver halide color photographic light-sensitive material described in any of items (37) to (46), wherein silver halide emulsion grains contained in said silver halide emulsion layer are monodispersed.

(The silver halide color photographic light-sensitive materials mentioned in items (37) to (47) above are grouped as a third embodiment of the present invention.)

(48) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more.

(49) A silver halide color photographic light-sensitive material used for a laser exposure and a rapid processing in which images are formed by starting a color development of a color developing time of 28 seconds or less within 9 seconds of a latent image-keeping time after completion of a scanning exposure by laser, said silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more.

(50) The silver halide color photographic light-sensitive material according to the preceding item (48) or (49), wherein an interlayer difference of the average equivalent-sphere diameter among said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is within 50% respectively.

(51) The silver halide color photographic light-sensitive material according to the preceding item (48) or (49), wherein an interlayer difference of the average equivalent-sphere diameter among said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is within 30% respectively.

(52) The silver halide color photographic light-sensitive material according to any one of the preceding items (48) to (51), wherein a total coating amount of silver of said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is in the range of 0.25 to 0.46 g/m$^2$.

(53) The silver halide color photographic light-sensitive material according to any one of the preceding items (48) to (52), wherein a coating amount of silver of said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layers containing a cyan dye-forming coupler is in the range of 0.07 to 0.2 g/m$^2$ respectively.

(54) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more, wherein at least one of said silver halide emulsion layers comprises at least one compound selected from metal complexes represented by the following formula (I);

$$[\mathrm{Ir}X^{I}_{n}L^{I}_{(6-n)}]^{m} \qquad \text{Formula (I)}$$

wherein $X^I$ represents a halogen ion or a pseudo halogen ion other than a cyanate ion; $L^I$ represents a ligand different from $X^I$; n represents an integer of 3 to 5; and m represents an integer of −5 to +1.

(55) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more, wherein at least one of said silver halide emulsion layers comprises at least one compound selected from metal complexes represented by the following formula (II);

$$[\mathrm{M}X^{II}_{n1}L^{II}_{(6-n1)}]^{m1} \qquad \text{Formula (II)}$$

wherein M represents Cr, Mo, Re, Fe, Ru, Os, Co, Rh, Pd or Pt; $X_{II}$ represents a halogen ion; $L_{II}$ represents a ligand different from $X_{II}$; n1 represents an integer of 3 to 6; and m1 represents an integer of −4 to +1.

(56) A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a silver halide emulsion of said silver halide emulsion layer containing a yellow dye-forming coupler is an emulsion containing cubic or decatetrahedral silver halide grains having an average equivalent-sphere diameter of 0.35 to 0.65 μm with a silver iodide content of 0.1 mole % or more and a silver chloride content of 95 mole % or more and a silver halide emulsion of said silver halide emulsion layer containing a magenta dye-forming coupler and a silver halide emulsion of said silver halide emulsion layer containing a cyan dye-forming coupler are each an emulsion containing cubic or decatetrahedral silver halide grains having an average equivalent-sphere diameter of 0.35 to 0.65 μm with a silver chloride content of 95 mole % or more, wherein at least one of said silver halide emulsion layers comprises at least one compound selected from metal complexes represented by the following formula (I) and at least one compound selected from metal complexes represented by the following formula (II);

$$[IrX^{I}_{n}L^{I}_{(6-n)}]^{m} \quad \text{Formula (I)}$$

wherein $X^{I}$ represents a halogen ion or a pseudo halogen ion other than a cyanate ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{I}$; n1 represents an integer of 3 to 6; and m1 represents an integer of −4 to +1.

(57) The silver halide color photographic light-sensitive material according to the preceding item (54) or (56), wherein said metal complex represented by formula (I) is a metal complex represented by the following formula (IA);

$$[IrX^{IA}_{n}L^{IA}_{(6-n)}]^{m} \quad \text{Formula (IA)}$$

wherein $X^{IA}$ represents a halogen ion or a pseudo halogen ion other than a cyanate ion; $L^{IA}$ represents an inorganic ligand different from $X^{IA}$; n represents an integer of 3 to 5; and m represents an integer of −5 to +1.

(58) The silver halide color photographic light-sensitive material according to the preceding item (54) or (56), wherein said metal complex represented by formula (I) is a metal complex represented by the following formula (IB);

$$[IrX^{IB}_{n}L^{IB}_{(6-n)}]^{m} \quad \text{Formula (IB)}$$

wherein $X^{IB}$ represents a halogen ion or a pseudo halogen ion other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; n represents an integer of 3 to 5; and m represents an integer of −5 to +1.

(59) The silver halide color photographic light-sensitive material according to the preceding item (54) or (56), wherein said metal complex represented by formula (I) is a metal complex represented by the following formula (IC);

$$[IrX^{IC}_{n}L^{IC}_{(6-n)}]^{m} \quad \text{Formula (IC)}$$

wherein $X^{IC}$ represents a halogen ion or a pseudo halogen ion other than a cyanate ion; $L^{IC}$ represents a 5-membered ring ligand having at least one nitrogen atom and at least one sulfur atom in its ring skeleton that may have a substituent on the carbon atoms in said ring skeleton; n represents an integer of 3 to 5; and m represents an integer of −5 to +1.

(60) The silver halide color photographic light-sensitive material according to the preceding item (54) to (56), wherein said metal complex represented by formula (I) is a metal complex represented by the following formula (ID);

$$[IrX^{ID}_{n}L^{ID}_{(6-n)}]^{m} \quad \text{Formula (ID)}$$

wherein $X^{ID}$ represents a halogen ion or a pseudo halogen ion; $L^{ID}$ represents a 5-membered ring ligand having at least two nitrogen atom and at least one sulfur atom in its ring skeleton that may have a substituent on the carbon atoms in said ring skeleton; n represents an integer of 3 to 5; and m represents an integer of −5 to +1.

(61) The silver halide color photographic light-sensitive material according to any one of the preceding items (55) to (59), wherein said metal complex represented by formula (II) is represented by formula (IIA) set forth below;

$$[M^{IIA}X^{IIA}_{n1}L^{IIA}_{(6-n1)}]^{m1} \quad \text{Formula (IIA)}$$

wherein $M^{IIA}$ represents Re, Ru, Os, or Rh,; $X^{IIA}$ represents a halogen ion; when $M^{IIA}$ is Re, Ru, or Os, $L^{IIA}$ represents NO, or NS, while when $M^{IIA}$ is Rh, $L^{IIA}$ represents $H_2O$, OH or O; n1 represents an integer of 3 to 6; and m1 represents an integer of −4 to +1.

(62) The silver halide color photographic light-sensitive material according to any one of the preceding items (48) to (61), wherein said silver halide emulsion of the silver halide emulsion layer containing a yellow dye-forming coupler is a silver halide emulsion of an average equivalent-sphere diameter of 0.45 to 0.65 μm and said silver halide emulsion of the silver halide emulsion layer containing a magenta dye-forming coupler and said silver halide emulsion of the silver halide emulsion layer containing a cyan dye-forming coupler are each a silver halide emulsion of an average equivalent-sphere diameter of 0.35 to 0.55 μm.

(63) The silver halide color photographic light-sensitive material according to any one of the preceding items (48) to (62), wherein said silver halide emulsion of the silver halide emulsion layer containing a yellow dye-forming coupler is a silver halide emulsion of an average equivalent-sphere diameter of 0.45 to 0.55 μm and said silver halide emulsion of the silver halide emulsion layer containing a magenta dye-forming coupler and said silver halide emulsion of the silver halide emulsion layer containing a cyan dye-forming coupler are each a silver halide emulsion of an average equivalent-sphere diameter of 0.45 to 0.55 μm.

(64) The silver halide color photographic light-sensitive material according to any one of the preceding items (54) to (63), wherein an interlayer difference of the average equivalent-sphere diameter among said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is within 50% respectively.

(65) The silver halide color photographic light-sensitive material according to any one of the preceding items (54) to (63), wherein an interlayer difference of the average equivalent-sphere diameter among said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is within 30% respectively.

(66) The silver halide color photographic light-sensitive material according to any one of the preceding items (54) to (65), wherein a total coating amount of silver of said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is in the range of 0.25 to 0.46 g/m$^2$.

(67) The silver halide color photographic light-sensitive material according to any one of the preceding items (54) to (65), wherein an each coating amount of silver of said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is in the range of 0.07 to 0.2 g/m$^2$.

(68) The silver halide color photographic light-sensitive material according to any one of the preceding items (54) to (67), wherein said silver halide color photographic light-sensitive material is used for a laser exposure and a rapid processing in which images are formed by starting a color development of a color developing time of 28 seconds or less within 9 seconds of a latent image-holding time after completion of a scanning exposure by laser.

(The silver halide color photographic light-sensitive materials mentioned in items (48) to (68) above are grouped as a fourth embodiment of the present invention.)

Otherwise here is no specific notification, the present invention includes all of the above-mentioned first to fourth embodiments.

Then, in the description for the above formulae, the formulae having same reference letters may represent the different chemical significance. (This is applied to the below description.) That is, the descriptions of reference letters for an item have the precedence to that for another item.

However, in this matter, the descriptions of reference letters for an item may have the same chemical significance of that for another item.

In the present invention, each of the first to fourth embodiments may be carried out individually, but embodiments selected arbitrary two or three therefrom and in all of the four embodiments are preferably combined and carried out.

The present invention is explained in more detail below.

The present invention is a silver halide color photographic light-sensitive material having, on a support, at least one yellow dye-forming light-sensitive silver halide emulsion layer, at least one magenta dye-forming light-sensitive silver halide emulsion layer and at least one cyan dye-forming light-sensitive silver halide emulsion layer, and at least one light-insensitive hydrophilic colloid layer that does not develop a color, wherein a total amount of a hydrophilic binder on the emulsion layer-coating side of the support is 6.0 g/m$^2$ or less, or a total coating amount of silver in the photographic constituent layers is in the range of 0.2 g/m$^2$ to 0.5 g/m$^2$, and at least one of said silver halide emulsion layers contains at least one compound selected from metal complexes represented by formula (I) set forth below and a silver halide emulsion of a 90 mole % or more silver chloride content with a silver bromide-containing phase and/or a silver iodide-containing phase formed in the layer form, and a method of forming images comprising the steps of laser scanning exposing said silver halide color photographic light-sensitive material, and subjecting the exposed silver halide color photographic light-sensitive material to developing processing with a time requirement of 90 seconds or less in terms of dry to dry.

First, the silver halide emulsion for use in the present invention is explained.

The silver halide emulsion for use in the present invention may include specific silver halide grains (particles) and it is not particularly limited, but cubic or tetradecahedral (tetrakaidecahedral) crystal grains (a peak of these grains may be round and they may have a higher level plane) having substantially {100} faces or octahedral crystal grains may be preferably contained. In the silver halide emulsion of particularly first embodiment of the present invention, tabular grains having {100} faces or {111} faces as main planes and having an aspect ratio of 2 or more and accounting for 50% or more of a projected area of the total rains are preferably contained. Further, in the silver halide emulsion of particularly second to fourth embodiments of the present invention, tabular grains having {100} faces or {111} faces as main planes and having an aspect ratio of 3 or more are preferable. The aspect ratio is defined as the value obtained by dividing the diameter of a circle corresponding to the circle having the same area as projected area by the thickness of the grains. In the present invention, in particular, the first embodiment, cubic or tetradecahedral crystal grains are more preferable. In particular, the silver halide emulsion of the fourth embodiment of the present invention comprises grains accounting for generally 50% or more, preferably 80% or more, and more preferably 90% or more of a projected area of the total grains in the silver halide defined as in the present invention.

The silver halide color photographic sensitive material of the present invention may include a specific silver halide grains. The silver halide grains for use in the present invention, particularly the first to third embodiments, have the silver chloride content of 90 mole % or more. From the point of rapid processing suitability, the silver chloride content is preferably 93 mole % or more, and further preferably 95 mole % or more. The silver halide grains for use in the present invention, particularly the third embodiment, other than the above-mentioned specific silver halide grains used in the present silver halide color photographic material also have the silver chloride content of preferably 90 mole % or more, further preferably 93 mole % or more, and particularly preferably 95 mole % or more. The silver halide grains for use in the present invention, particularly the fourth embodiment, have the silver chloride content of generally 95 mole % or more, and from the point of rapid processing suitability, the silver chloride content is preferably 97 mole % or more, and further preferably 98 mole % or more.

The silver bromide content is preferably from 0.1 to 7 mole %, and more preferably from 0.5 to 5 mole %. This is because hard gradation and excellent latent image stability can be achieved, particularly, in the first to third embodiments of the present invention. The silver iodide content is preferably from 0.02 to 1 mole %, more preferably from 0.05 to 0.50 mole %, and most preferably from 0.07 to 0.40 mole %, because high sensitivity and hard gradation in high illumination intensity exposure can be achieved, particularly, in the first to third embodiments of the present invention.

The silver halide emulsion for use, particularly, in the first embodiment of the present invention may be silver chlorobromide emulsion, silver chloroiodide emulsion or silver chlorobromoiodide emulsion, and more preferably silver chlorobromoionide emulsion. The specific silver halide grains for use, particularly, in the second embodiment of the present invention are preferably silver iodobromochloride grains, and more preferably silver iodobromochloride having the above-mentioned halogen-composition. Particularly, in the third embodiment, the silver halide emulsion in the silver halide emulsion layer containing a yellow dye-forming coupler comprises silver iodide content of generally 0.1 mole % or more, preferably 0.1 to 1 mole %, and more preferably 0.1 to 0.4 mole %. Particularly, in the third embodiment of the present invention, the silver halide emulsion in the silver halide emulsion layer containing a yellow dye-forming coupler may contain silver bromide, and then the silver bromide content is preferably 0 to 4 mole % and more preferably 0.1 to 2 mole %. Particularly, in the third embodiment of the present invention, the silver halide emulsion in the silver halide emulsion layer containing a magenta dye-forming coupler and the silver halide emulsion in the silver halide emulsion layer containing a cyan dye-forming coupler comprise silver bromide content of preferably 0 to 4 mole % and more preferably 0.5 to 3 mole %. Particularly, in the third embodiment of the present invention, the silver halide emulsion in the silver halide emulsion layer containing a magenta dye-forming coupler and the silver halide emulsion in the silver halide emulsion layer containing a cyan dye-forming coupler comprise silver iodide content of preferably 0 to 1 mole %, more preferably 0.05 to 0.50 mole %, and most preferably 0.07 to 0.40 mole %.

The specific silver halide grains of the silver halide emulsion for use, particularly, in the fourth embodiment of the present invention are preferably silver iodobromochloride grains, and more preferably silver iodobromochloride grains having the above-mentioned halogen-composition. The silver halide grains of the silver halide emulsion for use, particularly, in the fourth embodiment of the present invention are preferably silver iodobromochloride grains, and more preferably silver iodobromochloride having the above-mentioned halogen-composition.

The silver halide grain for use in the invention has preferably a region where a content of silver bromide and/or silver iodide is higher than those in other regions, in the silver halide grains. In some cases, the silver halide grain for use in the present invention contains silver chloride, silver bromide and/or silver iodide uniformly distributed throughout the entire grain, and it partially contains a region where the content of silver bromide and/or silver iodide is high. However, as described later, the case where most of regions are formed only with silver chloride is preferred. Hereinafter, a region where the content of silver bromide is higher than that in other regions will be referred to as a silver bromide-containing phase and likewise a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. Particularly, in the first embodiment of the present invention, the silver bromide and/or iodide phase may be formed in a layer form. The local silver bromide content in the silver bromide-containing phase is preferably 5 mole % or more (preferably 5 to 85 mole %), more preferably from 10 to 80 mole %, and most preferably from 15 to 50 mole %. The local silver iodide content in the silver iodide-containing phase is preferably 0.3 mole % or more (preferably 0.3 to 10 mole %), more preferably from 0.5 to 8 mole %, and most preferably from 1 to 5 mole %. Such silver bromide- or silver iodide-containing phase may be present in plural numbers in layer form, within the grain. In this case, the phases may have different silver bromide or silver iodide contents from each other. The silver halide grain for use in the invention has at least one of the silver bromide-containing phase and silver iodide-containing phase. Preferably, it contains both at least one silver bromide-containing phase and at least one silver iodide-containing phase.

It is also preferable (important) that the silver bromide-containing phase and the silver iodide-containing phase of the silver halide emulsion for use in the present invention are each formed in the layer form so as to surround the grain. One preferred embodiment is that the silver bromide-containing phase or the silver iodide-containing phase formed in the layer form so as to surround the grain has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion has the silver bromide-containing phase or the silver iodide-containing phase formed in the layer form so as to surround the grain in the vicinity of a surface of the grain, the silver bromide or silver iodide concentration of a corner portion or an edge of the grain can be different from that of a main plane of the grain. Further, aside from the silver bromide-containing phase or the silver iodide-containing phase formed in the layer form so as to surround the grain in the vicinity of a surface of the grain, the silver bromide-containing phase or the silver iodide-containing phase not surrounding the grain may exist in isolation at a specific portion of the surface of the grain.

In a case where the silver halide emulsion of the present invention contains a silver bromide-localized phase, it is preferable that said silver bromide-localized phase is formed in a layer form so as to have a concentration maximum of silver bromide inside of a grain. Likewise, in a case where the silver halide emulsion of the present invention contains a silver iodide-localized phase, it is preferable that said silver iodide-localized phase is formed in a layer form so as to have a concentration maximum of silver iodide inside of a grain.

Such silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide grain of the silver halide emulsion for use in the present invention preferably contains both a silver bromide-containing phase and a silver iodide-containing phase, and this is a preferable mode. In this mode, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content necessary for exhibiting the effects of the present invention such as achievement of high sensitivity and realization of hard gradation, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide grain for use in the present invention, bromide ions or iodide ions are introduced to make the grain include silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion may be restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

The distribution of a bromide ion concentration and iodide ion concentration in the depth direction of a grain can be measured according to an etching/TOF-SIMS (Time of Flight-Secondary Ion Mass Spectrometry) method by means of, for example, preferably in the first embodiment, TRIFT II Model TOF-SIMS apparatus (trade name, manufactured by Phi Evans Co.) and preferably in the second to fourth embodiments. A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection-Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that the emulsion for use in the present invention has the maximum concentration of iodide ions at the surface of the grain, and the iodide ion concentration decreases inwardly in the grain. The bromide ions preferably have the maximum concentration in the inside of a grain. The local concentration of silver bromide can also be measured with X-ray diffractometry, as long as the silver bromide content is high to some extent.

In the silver halide color photographic light-sensitive material of the present invention, particularly in the third embodiment, the term "a total coating amount of silver in the photographic constituent layers" refers to a total amount of silver contained in the silver halide emulsion layers and light-insensitive hydrophilic colloid layers, and embraces all silver including silver halide and metal silver. There are several conventional methods to measure a layer-coating amount of silver. Among them, analysis using fluorescent X-rays is a preferable method from the point that a light-sensitive material with the form of a coating sample can be used for measurement.

In the silver halide color photographic light-sensitive material of the present invention, particularly in the third embodiment, a total coating amount of silver in the photographic constituent layers is in the range of 0.20 $g/m^2$ to 0.50 $g/m^2$. If the total coating amount of silver is more than the above-described range, a density does not reach the maximum within the color developing time of a rapid processing. In contrast, if the total coating amount of silver is less than the above-described range, the maximum density necessary to form images cannot be obtained.

The upper limit of the total coating amount of silver is generally 0.50 $g/m^2$, preferably 0.45 $g/m^2$, and more preferably 0.40 $g/m^2$ in the present invention, particularly in the third embodiment. On the other hand, the lower limit of the total coating amount of silver is generally 0.2 $g/m^2$, preferably 0.25 $g/m^2$ and more preferably 0.3 $g/m^2$ in the present invention, particularly in the third embodiment.

The sustained electron emission time of the silver halide emulsion for use in the invention, particularly in the first embodiment, is preferably between 10 to 10 seconds. Here, sustained electron emission time is, when a silver halide emulsion is exposed to light, a time during which a photoelectron generated in a silver halide crystal is trapped by an electron trap in the crystal and released again. If the sustained electron emission time is too short to be $10^{-5}$ second or less, high sensitivity and hard gradation in high intensity exposure are difficult to obtain. On the other hand, if the sustained electron emission time is too long to be 10 seconds or more, the problem of latent image sensitization occurs during the time interval between the exposure to light and processing in a short time. The sustained electron emission time is more preferably between $10^{-4}$ second and 10 seconds, and most preferably between $10^{-3}$ second and 1 second.

The sustained electron emission time can be measured with a double pulse photoconduction method. More particularly, this is performed as follows. Using microwave photoconduction method or radio wave photoconduction method, a short time exposure as a first shot is given and after a predetermined time, another short time exposure is given as a second shot. At the first shot exposure, electrons are trapped in the electron trap in the silver halide crystal, and when the second shot exposure is given immediately thereafter, photoconduction signal at the second shot becomes more intense since the electron trap is full of electrons. If the interval between two exposures is taken sufficiently long so that the electrons trapped in the electron trap at the first exposure have already been emitted, the intensity of the photoconduction signal at the second shot returns to the original level of intensity. By changing the interval of two exposures and determining exposure interval dependency of second shot photoconduction signals, the state of photoconduction signal intensity decreasing while exposure interval increasing, can be measured. This shows sustained emission time of photoelectrons from the electron trap. The sustained electron emission in some cases occurs continuously for a specified time after exposure. However, it is preferred that the sustained emission is observed between $10^{-5}$ second to 10 seconds, more preferably between $10^{-4}$ to 10 seconds, and still more preferably between $10^{-3}$ second to 1 second.

The metal complexes represented by the following formula (I) for use preferably in the present invention are explained;

$$[IrX^{I}_{n}L^{I}_{(6-n)}]^{m} \qquad \text{Formula (I)}$$

wherein $X^I$ represents a halogen ion or a pseudo halogen ion, preferably in the first and second embodiments, other than a cyanate ion; $L^I$ represents a ligand different from $X^I$; n represents an integer of 3 to 5; and m represents a charge of the metal complex and it is an integer of −5 to −1, 0 or +1 and preferably of −4 to −1, 0 or +1. The term "an integer of −5 to −1" is employed to indicate −5, −4, −3, −2 or −1.

For example, when m is −4, the charge is expressed as 4−. This rule is applied hereinafter, up to this, and claims.

Here, from 3 to 5 $X^I$s may be the same or different from each other. When $L^I$ is present in plurality, these plural $L^I$s may be the same or different from each other.

In formula (I), the pseudo halogen ion (halogenide) is an ion having a nature similar with that of halogen ion and can include, for example, cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$) fulminate ion ($ONC^-$), azide ion ($N_3^-$), isocyanate ion ($NCO^-$), nitrate ion ($NO_3^{2-}$), and nitrite ion ($NO_2^-$).

$X^I$ is preferably a fluoride ion, a chloride ion, a bromide ion, an iodide ion, a cyanide ion, an isocyanate ion, a thiocyanate ion, a hydroxide ion, a nitrate ion, a nitrite ion, or an azide ion. A chloride ion and a bromide ion are particularly preferable. $L^I$ has no particular limitation so long as it is a ligand different from $X^I$, and it may be an organic or inorganic compound that may or may not have electric charges, with organic or inorganic compounds with no electric charge being preferable.

Among the metal complexes represented by formula (I), particularly in the first and fourth embodiments, metal complexes represented by formula (IA) are preferred and those represented by formula (IB) are more preferred;

$$[IrX^{IA}_{n}L^{IA}_{(6-n)}]^{m} \qquad \text{Formula (IA)}$$

$$[IrX^{IB}_{n}L^{IB}_{(6-n)}]^{m}$$

wherein $X^{IA}$ represents a halogen ion or a pseudo halogen ion, in the first, second and fourth embodiments, other than a cyanate ion; $L^{IA}$ represents a ligand different from $X^{IA}$, preferably inorganic ligand; n represents an integer of 3 to 5; and in represents an integer of −5 to +1 and, in the third embodiment, preferably −4 to +1.

In formula (IA), $X^{IA}$ has the same meanings as $X^I$ in formula (I) and preferable ranges are also identical. $L^{IA}$ is preferably water, OCN, ammonia, phosphine and carbonyl, with water being particularly preferable.

Here, from 3 to 5 $X^{IA}$s may be the same or different from each other. When $L^{IA}$ is present in plurality, these plural $L^{IA}$s may be the same or different from each other.

In the formula (IB), $X^{IB}$ represents a halogen ion or a pseudo halogen ion, in the first, second and fourth embodiments, other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; n represents an integer of 3 to 5; and m represents, an integer of −5 to +1 and, in the third embodiment, preferably −4 to +1.

In formula (IB), $X^{IB}$ has the same meanings as $X^I$ in formula (I) and preferable ranges are also identical. $L^I$ represents a ligand having a chain or cyclic hydrocarbon as a basic structure, or in which a portion of carbon atoms or hydrogen atoms of the basic structure is substituted with other atoms or atom groups, but it does not include a cyanide ion. $L^{IB}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Here, from 3 to 5 $X^{IB}$s may be the same or different from each other. When $L^{IB}$ is present in plurality, these plural $L^{IB}$s may be the same or different from each other.

Among the metal complexes represented by formula (IB), metal complexes represented by formula (IC) are more preferred;

$$[IrX^{IC}_{n}L^{IC}_{(6-n)}]^{m} \qquad \text{Formula (IC)}$$

wherein $X^{IC}$ represents a halogen ion or a pseudo halogen ion, in the first, second and fourth embodiments, other than a cyanate ion; $L^{IC}$ represents a 5-membered ring ligand having at least one nitrogen atom and at least one sulfur atom in its ring skeleton that may have a substituent on the carbon atoms in said ring skeleton; n represents an integer of 3 to 5; and m represents an integer of −5 to +1 and, in the third embodiment, preferably −4 to +1.

In formula (IC), $X^{IC}$ has the same meanings as $X^I$ in formula (I) and preferable ranges are also identical. The substituent on the carbon atoms in said ring skeleton in $L^{IC}$, particularly in the first, second and fourth embodiments, is preferably a substituent having a smaller volume than n-propyl group. Preferable substituents are an alkyl group (preferably methyl group, an ethyl group), an alkoxy group (preferably methoxy group, an ethoxy group), a cyano group, an isocyano group, a cyanate group, an isocyanate group, a thiocyanate group, a isothiocyanate group, a formyl group, a thioformyl group, a hydroxyl group, a mercapto group, an amino group, a hydrazine group, an azide group, a nitro group, a nitroso group, a hydroxyamino group, a carboxy group, a carbamoyl group, a fluoride group, a chloride group, a bromide group and an iodide group.

Here, from 3 to 5 $X^{IC}$s may be the same or different from each other. When $L^{IC}$ is present in plurality, these plural $L^{IC}$s may be the same or different from each other.

Among the metal complexes represented by formula (IC), metal complexes represented by formula (ID) are more preferred;

$$[IrX^{ID}_{n}L^{ID}_{(6-n)}]^{m} \quad \text{Formula (ID)}$$

wherein $X^{ID}$ represents a halogen ion or a pseudo halogen ion, particularly other than a cyanate ion; $L^{ID}$ represents a 5-membered ring ligand having at least two nitrogen atom and at least one sulfur atom in its ring skeleton that may have a substituent on the carbon atoms in said ring skeleton; n represents an integer of 3 to 5; and m represents an integer of −5 to +1 and preferably −4 to +1.

In formula (ID), $X^{ID}$ has the same meanings as $X^{I}$ in formula (I) and preferable ranges are also identical. $L^{ID}$ is preferably a compound containing thiadiazole as a skeleton. A substituent other than hydrogen is preferably bonded to the carbon atoms in the compound. The substituents are preferably a halogen atom (such as fluorine, chlorine, bromine, iodine), an alkoxy group (such as a methoxy group, an ethoxy group), a carboxyl group, a methoxycarboxyl group, an alkoxycarbonyl group (such as methoxycarbonyl group), an acyl group, an acetyl group, a chloroformyl group, a mercapto group, an alkylthio group, a methylthio group, a thioformyl group, a thiocarboxyl group, a dithiocarboxyl group, a sulfino group, a sulfo group, a sulfamoyl group, an alkylamino group, a methylamino group, a cyano group, an isocyano group, a cyanato group, an isocyanato group, a thiocyanato group, an isothiocyanato group, a hydroxyamino group, a hydroxyimino group, a carbamoyl group, a nitroso group, a nitro group, a hydrazino group, a hydrazono group or an azide group, more preferably, a halogen atom (fluorine, chlorine, bromine, iodine), a chloroformyl group, a sulfino group, a sulfo group, an isocyano group, a cyanato group, an isocyanato group, a thiocyanato group, an isothiocyanate group, a hydroxyimino group, a nitroso group, a nitro group, or an azide group. Among them, chlorine, bromine, a chloroformyl group, an isocyano group, a cyanato group, an isocyanato group, a thiocyanato group, and an isothiocyanate group are particularly preferred. n represents preferably 4 or 5; and m represents preferably −2 or −1.

Here, from 3 to 5 $X^{ID}$ may be the same or different from each other. When $L^{ID}$ is present in plurality, these plural $L^{ID}$s may be the same or different from each other.

Preferable specific examples of the metal complexes represented by formula (I) are shown below. However, the present invention is not limited to these complexes.

$[IrCl_5(H_2O)]^{2-}$
$[IrCl_4(H_2O)_2]^{-}$
$[IrCl_4\ (H_2O)]^{-}$
$[IrCl_4(H_2O)_2]^{0}$
$[IrCl_5(OH)]^{3-}$
$[IrCl_4(H)_2]^{2-}$
$[IrCl_5(OH)]^{2-}$
$[IrCl_4(OH)^2]^{2-}$
$[IrCl_5(OH)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$
$[IrCl_5(5\text{-chlorothiadiazole})]^{2-}$
$[IrCl_4(5\text{-chlorothiadiazole})_2]^{-}$
$[IrBr_5(5\text{-chlorothiadiazole})]^{2-}$
$[IrBr_4(5\text{-chlorothiadiazole})_2]^{-}$
$[IrCl_5(2\text{-chloro-5-fluorothiadiazole})]^{2-}$
$[IrCl_4(2\text{-chloro-5-fluorothiadiazole})_2]^{-}$
$[IrBr_5(2\text{-chloro-5-fluorothiadiazole})]^{2-}$
$[IrBr_4(2\text{-chloro-5-fluorothiadiazole})_2]^{-}$
$[IrCl_5(2\text{-bromo-5-chlorothiadiazole})]^{2-}$
$[IrCl_4(2\text{-bromo-5-chlorothiadiazole})_2]^{-}$
$[IrBr_5(2\text{-bromo-5-chlorothiadiazole})]^{2-}$
$[IrBr_4(2\text{-bromo-5-chlorothiadiazole})_2]^{-}$ Among them, particularly, in the first, second and fourth embodiments, $[IrCl_5(5\text{-methylthiazole})]^{2-}$ or $[IrCl_5(2\text{-chloro-5-fluoro thiadiazole})]^{2-}$ is preferable.

In the present invention, metal complexes represented by the following formula (II) are also preferably used and expressed below;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents, in the first, second and fourth embodiments, an integer of −4 to +1 and, in the third embodiment, −5 to +1, preferably −4 to +1.

$X^{II}$ is specifically a fluoride ion, a chloride ion, a bromide ion, or an iodide ion, and particularly preferably a chloride ion and a bromide ion. $L^{II}$ may be an organic or inorganic compound that may or may not have electric charges, with inorganic compounds having no electric charge being preferable. $L^{II}$ is preferably $H_2O$, NO, NS, OH or O and particularly preferably $H_2O$, NO or NS.

Herein, 3 to 6 $X^{II}$s may be same as or different from each other. When plural $L^{II}$s exist, the plural $L^{II}$s may be same as or different from each other.

Among the metal complexes represented by formula (II), metal complexes represented by formula (IIA) are preferred;

$$[M^{IIA}X^{IIA}_{n1}L^{IIA}_{(6-n1)}]^{m1} \quad \text{Formula (IIA)}$$

wherein $M^{IIA}$ represents Re, Ru, Os, or Rh; $X^{IIA}$ represents a halogen ion; $L^{IIA}$ represents NO, or NS, when $M^{IIA}$ is Re, Ru, or Os, while $L^{IIA}$ represents $H_2O$, OH or O, when $M^{IIA}$ is Rh; n1 represents an integer of 3 to 6; and m1 represents, particularly in the first, second and fourth embodiments, an integer of −4 to +1, and particularly in the third embodiment, an integer of −5 to +1, preferably −4 to +1.

Further, in the second embodiment, n1 is preferably 4 to 6 and m1 is preferably −3 to −1.

In the formula (IIA), $X^{IIA}$ may have the same meanings as in $X^{II}$ of the formula (II), may be in the same preferable range as therein.

Here, 3 to 6 $X^{II}$s may be same as or different from each other. Then, when plural $L^{IIA}$ exist, the plural $L^{IIA}$ may be same as or different from each other.

Preferable specific examples of the metal complexes represented by formula (II) are shown below. However, the present invention is not limited to these complexes.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OSCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

In the second and fourth embodiments, among them, $[O_sCl_5(NO)]^{2-}$ or $[RhBr_6]^{2-}$ is particularly preferable.

In the present invention, particularly fourth embodiment, it is preferable to use at least one compound selected from metal complexes represented by formula (I) in combination with at least one compound selected from metal complexes represented by formula (II). Among combinations of these metal complexes, preferable embodiments are explained below.

It is preferable that the metal complex represented by formula (I) is used in combination with the metal complex represented by formula (IIA). Beside, it is preferable that the metal complex represented by formula (II) is used in combination with the metal complex represented by formula (IA) or (IB). Among them, the metal complex represented by formula (II) is preferably used in combination with the metal complex represented by formula (IB), and further 3 kinds of combination consisting of the metal complex represented by formula (IA) in addition to the afore-mentioned couple of the metal complex represented by formula (II) and the metal complex represented by formula (IB) is more preferably used. Specific examples of preferable combinations are set forth below.

Embodiment 1: a combination of the metal complex represented by formula (IA) and the metal complex represented by formula (II)

Embodiment 2: a combination of the metal complex represented by formula (IB) and the metal complex represented by formula (II)

Embodiment 3: a combination of the metal complex represented by formula (IC) and the metal complex represented by formula (II)

Embodiment 4: a combination of the metal complex represented by formula (ID) and the metal complex represented by formula (II)

Further preferable combinations are as follows.

Embodiment 5: a combination of the metal complex represented by formula (IA) and the metal complex represented by formula (IIA)

Embodiment 6: a combination of the metal complex represented by formula (IB) and the metal complex represented by formula (IIA)

Embodiment 7: a combination of the metal complex represented by formula (IC) and the metal complex represented by formula (IIA)

Embodiment 8: a combination of the metal complex represented by formula (ID) and the metal complex represented by formula (IIA)

The foregoing metal complexes are anionic ions. When these are formed into salts with cationic ions, counter cationic ions are preferably soluble in water. Specifically, alkali metal ions such as a sodium ion, a potassium ion, a rubidium ion, a cesium ion and a lithium ion, an ammonium ion and an alkyl ammonium ion are preferable. These metal complexes can be used being dissolved in water or mixed solvents of water and appropriate water-miscible organic solvents (such as alcohols, ethers, glycols, ketones, ethers and amines). The metal complexes represented by formula (I) are added in amounts of, preferably $1\times10^{-10}$ mole to $1\times10^{-3}$ mole, most preferably $1\times10^{-8}$ mole to $1\times10^{-5}$ mole, per mole of silver during grain formation. The metal complexes represented by formula (II) are added in amounts of, preferably $1\times10^{-11}$ mole to $1\times10^{-6}$ mole, most preferably $1\times10^{-9}$ mole to $1\times10^{-7}$ mole, per mole of silver during grain formation.

In the present invention, it is preferable that the above-mentioned metal complex is incorporated into the silver halide grains by directly adding the same to a reaction solution for the formation of the silver halide grains, or to an aqueous solution of the halide for the formation of the silver halide grains, or to another solution and then to the reaction solution for the grain formation. It is also preferable that a metal complex is incorporated into the silver halide grains by physical aging with fine grains having metal complex previously incorporated therein. Further, it can be also contained into the silver halide grains by a combination of these methods.

In case where these complexes are doped (incorporated) to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain.

In the present invention, particularly in the second embodiment, it is preferable that a silver halide emulsion layer contains at least two silver halide emulsions with 90 mole % or more of silver chloride and different sensitivities from each other. Although the number of the emulsions with different sensitivities from each other is enough to be 2 or more, 2 or 3 kinds of emulsions are preferred from the viewpoint of designing a light-sensitive material. When 3 or more kinds of emulsions with different sensitivities from each other are used, the present invention is applied to the 2 kinds of emulsions arbitrarily selected from these emulsions. In the 2 kinds of emulsions, the size, halogen composition and structure of the emulsion grains, and kinds and amounts of additives such as sensitizing dyes, chemical sensitizing agents and antifogging agents may be different from each other, or identical. However, the 2 kinds of emulsions having a silver chloride content of 90 mole % or more have preferably a different sensitivity. A difference in sensitivity that is obtained by imagewise exposure of $10^{-4}$ sec. and color development using the light-sensitive material that is intended to use actually is preferably from 0.05 to 0.8, more preferably from 0.15 to 0.5, in terms of log E respectively.

The at least two silver halide emulsions with 90 mole % or more of silver chloride and different sensitivities from each other are preferably mixed in the same silver halide emulsion layer. However, they may be separately incorporated in different emulsion layers, so long as these layers have substantially the same color sensitivity or coloring hue. Here, the term "substantially the same color sensitivity" refers to, for example, a pair of blue sensitivity, a pair of green sensitivity, or a pair of red sensitivity in a case of a color photographic light-sensitive material, and a spectral sensitivity in two layers may be different, if the color region is same. Besides, the term "substantially the same color hue" refers to, for example, a pair of yellow development, a pair of magenta development, or a pair of cyan development in a case of a color photographic light-sensitive material, and a coloring hue in two layers may be different, if the color region is same.

At least one of the at least two silver halide emulsions with 90 mole % or more of silver chloride and different sensitivities from each other contains at least one of the metal complexes described above. Said metal complex is preferably incorporated in both of the two silver halide emulsions with different sensitivities from each other, and more preferably in all silver halide emulsions in the silver halide emulsion layer.

In the at least two silver halide emulsions with 90 mole % or more of silver chloride and different sensitivities from each other, it is preferable that a content of above-said metal complex per mole of silver halide is greater in a lower sensitivity emulsion than in a higher sensitivity emulsion. Further, it is preferable that an average content of above-said metal complex per one silver halide grain is greater in a lower sensitivity emulsion than in a higher sensitivity emulsion. In these cases, the higher sensitivity emulsion may not contain above-said metal complex, but in a smaller amount than the lower sensitivity emulsion.

In the at least two silver halide emulsions with 90 mole % or more of silver chloride and different sensitivities from each other, it is preferable that a degree of desensitization due to the above-said metal complex is greater in a lower sensitivity emulsion than in a higher sensitivity emulsion. The term "degree of desensitization due to the metal complex" herein used is a difference in sensitivities obtained between absence and presence of the metal complex in the same emulsion and a trend of desensitization is indicated as a positive value. Besides, a degree of desensitization is assumed to be 0 (zero) in the case where one of the at least two silver halide emulsions does not contain the above-said metal complex. A degree of desensitization of the higher sensitivity emulsion and the lower sensitivity emulsion is preferably from 0 (zero) to 0.8, more preferably from 0.1 to 0.5, respectively in terms of log E.

A degree of desensitization due to the above-said metal complex in a lower sensitivity emulsion is preferably greater by 0.1 to 0.8 times, more preferably greater by 0.1 to 0.5 times in terms of log E than that of a higher sensitivity emulsion.

In the present invention, particularly in the third embodiment, the silver halide grains may contain not only the afore-mentioned iridium compounds but also another iridium compound. As such additional iridium compound, a six-coordination complex having 6 ligands and iridium as a central metal is preferred to incorporate the iridium compound uniformly in a silver halide crystal. As a preferable embodiment of the iridium compound employed in the present invention, particularly in the third embodiment, a six-coordination complex having Cl, Br or I as a ligand, and iridium as a central metal is preferred. A six coordination complex having 6 ligands, all of which are Cl, Br or I, and iridium as a central metal, is more preferred. In this case, Cl, Br or I may be a mixture of them in the six-coordination complex. The six-coordination complex having Cl, Br or I as a ligand, and iridium as a central metal is particularly preferably incorporated in a silver bromide-containing phase in order to obtain hard gradation upon high illuminance exposure.

The specific silver halide grains in the silver halide emulsion that is used in the present invention may contain not only the iridium complex represented by formula (I) but also another iridium complex in which all of 6 ligands are made of Cl, Br or I. In this case, Cl, Br or I may be a mixture of them in the six-coordination complex. The iridium complex having Cl, Br or I as a ligand is particularly preferably incorporated in a silver bromide-containing phase for obtaining hard gradation upon high illuminance exposure.

Specific examples of the iridium complex in which all of 6 ligands are made of Cl, Br or I are shown below. However, the present invention is not limited to these complexes.

$[IrCl_6]^{2-}$ $[IrCl_6]^{3-}$ $[IrBr_6]^{2-}$ $[IrBr_6]^{3-}$ $[IrI_6]^{3-}$

In the present invention, metal ion other than iridium can be doped in the inside and/or on the surface of the silver halide grains. As the metal ion used, a transition metal is preferable, and iron, ruthenium, osmium, lead, cadmium or zinc is especially preferable. It is more preferable that these metal ions are used in the form of a six-coordination complex of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion are preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with the iridium compound. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver. In the present invention, particularly the first embodiment, in case of a ruthenium complex and an osmium complex, nitrosyl ion, thionitrosyl ion, water molecule and chloride ion are preferably used as ligands, singly or in combination. More preferably these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

The equivalent-sphere diameter is expressed as a diameter of a sphere having the same volume as that of the individual grain.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred in the present invention, particularly the first, second and fourth embodiment. The variation coefficient of the equivalent-sphere diameter is expressed as in a percentage as compared with an average of the standard deviation for the equivalent-sphere of the individual grain. For obtaining a wide latitude, it is also preferred to blend the above-described monodisperse emulsions in the same layer or to form a multilayer structure using the monodisperse emulsions.

In the present specification, the equivalent-sphere diameter is indicated by a diameter of a sphere having the same volume as that of individual grain. An average of the equivalent-sphere diameter of individual grain is referred to as average grain size. The sentence "an average equivalent-sphere diameter of entire silver halide emulsion grains contained in said silver halide emulsion layers is 0.50 μm or less" referring to in the present invention means that an average grain size measured by involving silver halide emulsion grains in all silver halide emulsion layers is 0.50 μm or less (preferably in the range of 0.10 μm to 0.50 μm), preferably 0.40 μm or less (preferably in the range of 0.15 μm to 0.40 μm), and furthermore preferably 0.35 μm or less (preferably in the range of 0.15 μm to 0.35 μm).

The grain having an equivalent-sphere diameter of 0.50 μm is equivalent to a cubic grain of a side length of about 0.40 μm. The grain having an equivalent-sphere diameter of 0.40 μm is equivalent to a cubic grain of a side length of about 0.32 μm. The grain having an equivalent-sphere diameter of 0.35 μm is equivalent to a cubic grain having a side length of about 0.28 μm.

A measurement of grain size can be conducted by observation by SEM. Specifically the size of grains in each silver halide emulsion layer may be measured by observing a cross-section of the light-sensitive material. Alternatively, a measurement can be conducted in the direction of the depth in each silver halide emulsion layer, while shaving off membranes of the light-sensitive material.

It is preferable for the silver halide emulsion for use in the present invention, particularly in the third embodiment, that the distribution of the grain size is a mono-dispersion of grains.

The term "mono-dispersion" used herein means that the variation coefficient of the equivalent-sphere diameter of all grains in the emulsion is 20% or less, preferably 15% or less, and more preferably 10% or less. The term "variation coefficient of the equivalent-sphere diameter" is indicated by the percentage of (the standard deviation of the equivalent-sphere diameter of individual grains in the emulsion) divided by (the average equivalent-sphere diameter of individual grains in the emulsion). In this case, it is also preferred to blend a plurality of the above-mentioned mono-dispersion emulsions in one identical layer, or to coat the same as separate layers to obtain wide latitude.

It is a preferable embodiment that silver halide emulsion grains contained in the silver halide emulsion layer are mono-dispersion, in the present invention, particularly the third embodiment. This means that entire silver halide emulsion grains contained in the silver halide emulsion layer are involved. In other words, even though plural emulsions are used as a blend in an emulsion layer, entire grains in the emulsion layer are involved. In this case, the "mono-dispersion" means that the variation coefficient of the equivalent-sphere diameter of entire grains contained in one emulsion layer is 20% or less, preferably 15% or less, and more preferably 10% or less. Regarding all silver halide emulsions that are used in the present invention, it is preferable that silver halide emulsion grains contained in these silver halide emulsion layers are mono-dispersion.

In the present invention, particularly the first embodiment, regarding the silver halide emulsion of a silver halide emulsion layer containing a yellow dye-forming coupler, the equivalent-sphere diameter of grains contained therein is preferably 0.6 μm or less (preferably in the range of 0.1 μm to 0.6 μm), more preferably 0.5 μm or less (preferably in the range of 0.15 μm to 0.5 μm), and most preferably 0.4 μm or less (preferably in the range of 0.2 μm to 0.4 μm).

In the present invention, particularly the second embodiment, regarding the silver halide emulsion of a silver halide emulsion layer containing a yellow dye-forming coupler, the equivalent-sphere diameter of grains contained therein is preferably 0.6 μm or less, more preferably 0.5 μm or less, and most preferably 0.4 μm or less.

In the present invention, particularly the fourth embodiment, regarding the silver halide emulsion of a silver halide emulsion layer containing a yellow dye-forming coupler, the equivalent-sphere diameter of grains contained therein is generally 0.35 to 0.65 μm, preferably 0.45 to 0.65 μm, and more preferably 0.45 to 0.55 μm.

In the present invention, particularly the first embodiment, regarding the silver halide emulsions of silver halide emulsion layers containing a magenta dye-forming coupler and a cyan dye-forming coupler respectively, the equivalent-sphere diameter of grains contained therein is preferably 0.5 μm or less (preferably in the range of 0.1 μm to 0.5 μm), more preferably 0.4 μm or less (preferably in the range of 0.15 μm to 0.4 μm), and most preferably 0.3 μm or less (preferably in the range of 0.15 μm to 0.3 μm).

In the present invention, particularly the second embodiment, regarding the silver halide emulsions of a silver halide emulsion layers containing a magenta dye-forming coupler and a cyan dye-forming coupler respectively, the equivalent-sphere diameter of grains contained therein is preferably 0.5 μm or less, more preferably 0.4 μm or less, and most preferably 0.3 μm or less.

In the present invention, particularly the fourth embodiment, regarding the silver halide emulsions of a silver halide emulsion layer containing a magenta dye-forming coupler and a cyan dye-forming coupler respectively, the equivalent-sphere diameter of grains contained therein is preferably 0.35 to 0.65 μm, more preferably 0.35 to 0.55 μm, and most preferably 0.45 to 0.55 μm.

In the present specification, particularly in the first, second and fourth embodiments, the equivalent-sphere diameter is indicated by a diameter of a sphere having the same volume as that of individual grain. The average equivalent-sphere diameter is expressed as an average value of the equivalent-sphere diameters of all silver halide grains contained in the emulsion layer.

The grain having an equivalent-sphere diameter of 0.65 μm is equivalent to a cubic grain having a side length of about 0.52 μm. The grain having an equivalent-sphere diameter of 0.6 μm is equivalent to a cubic grain having a side length of about 0.48 μm. The grain having an equivalent-sphere diameter of 0.55 μm is equivalent to a cubic grain having a side length of about 0.44 μm. The grain having an equivalent-sphere diameter of 0.5 μm is equivalent to a cubic grain having a side length of about 0.40 μm. The grain having an equivalent-sphere diameter of 0.45 μm is equivalent to a cubic grain having a side length of about 0.36 μm. The grain having an equivalent-sphere diameter of 0.4 μm is equivalent to a cubic grain having a side length of about 0.32 μm. The grain having an equivalent-sphere diameter of 0.35 μm is equivalent to a cubic grain having a side length of about 0.28 μm. The grain having an equivalent-sphere diameter of 0.3 μm is equivalent to a cubic grain having a side length of about 0.24 μm.

The silver halide emulsion for use in the present invention, particularly in the first, second and fourth embodiments, may also contain silver halide grains other than silver halide grains that must be incorporated in the silver halide emulsion defined in the present invention, i.e., specific silver halide grains.

However, the silver halide emulsion defined in the present invention, in particularly the first, second and fourth embodiments, may need to contain silver halide grains defined in the present invention, said grains accounting for 50% or more, preferably 80% or more, and further preferably 90% or more, of entire projected area of the total grains, respectively.

The silver halide emulsion defined in the present invention may be incorporated in any of the silver halide emulsion layers, but particularly preferably in the silver halide emulsion layer containing a yellow dye-forming coupler.

The silver halide emulsion defined as in the present invention, particularly in the first embodiment, may be used in any of the silver halide emulsion layers, is preferably used in the emulsion layer of the silver halide emulsion containing a yellow dye-forming coupler, and is further preferably used in all the silver halide emulsion layer.

In the present invention, particularly in the fourth embodiment, the interlayer difference of the average equivalent-sphere diameter among said silver halide emulsion of the silver halide emulsion layer containing a yellow dye-forming coupler, said silver halide emulsion of the silver halide emulsion layer containing a magenta dye-forming coupler and said silver halide emulsion of the silver halide emulsion layer containing a cyan dye-forming coupler is preferably within 50%, more preferably within 30%, and most preferably within 15%, respectively. The term "interlayer difference of the average equivalent-sphere diameter" herein used is defined by the following equation.

Interlayer difference of the average equivalent-sphere diameter={(the larger average equivalent-sphere diameter/the smaller average equivalent-sphere diameter)−1}×100

In the equation, the relation of "larger average equivalent-sphere diameter" to "smaller average equivalent-sphere diameter" is relatively determined between the emulsions of arbitrarily selected two layers.

The silver halide emulsion for use in the present invention is preferably gold-sensitized according to gold sensitization known in the art. By the gold sensitization, sensitivity of the emulsion can be highly enhanced and fluctuation of photographic performance upon scanning exposure employing, for example, a laser beam can be lessen. For gold sensitization, various kinds of inorganic gold compounds, metal (I) complexes having an inorganic ligand, or metal (I) complexes having an organic ligand can be used. As the inorganic gold compounds, for example, chloroauric acid or a salt thereof can be used. As the metal (I) complexes having an inorganic ligand, for example, dithiocyanato gold (I) compounds such as potassium dithiocyanatoaulite and dithiosulfate gold (I) compounds such as tri-sodium dithiosulfatoaulite can be used.

As the gold (I) compounds having an organic ligand, the bis gold (I) mesoionic heterocycles described in JP-A-4-267249, for example, bis(1,4,5-trimethyl-1,2,4-triazolium-3-thiolate) aurate (I) tertafluoroborate, the organic mercapto gold (I) complexes described in JP-A-11-218870, for example, potassium bis(1-[3-(2-sulfonatobenzamido)phenyl]-5-mercaptotetrazole potassium salt) aurate (I) pentahydrate, and the gold (I) compound with a nitrogen compound anion coordinated therewith described in JP-A-4-268550, for example, gold (I) bis (1-methylhydantoinate) sodium salt tetrahydrate may be used. There can be used these gold (I) compounds having an organic ligand, which has been synthesized in advance and purified (separated). Further, by mixing an organic ligand and a gold compound (such as chloroauric acid and a salt thereof) to obtain the target compound without separation from the others such as a solvent, the target compound can be added to the emulsion. Furthermore, an organic ligand and gold compound (such as chloroauric acid salt thereof) may be respectively and separately added to the emulsion to generate a gold (I) compounds having an organic ligand in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. No. 5,620,841, U.S. Pat. No. 5,912,112, U.S. Pat. No. 5,939,245, and U.S. Pat. No. 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention is preferably subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996).

The above-mentioned Research Disclosure discloses a method using a thiocyanate ion at a producing a colloidal gold sulfite. However, in place thereof, there can be used a thioether compound such as methionine and thiodiethanol.

The colloidal gold sulfide can be used in a wide range of size. Specifically, it is preferable to use compounds of 50 nm or less, more preferably 10 nm or less, and furthermore preferably 3 nm or less, in terms of average grain size respectively. The grain size can be measured from a TEM photograph. The composition of the colloidal gold sulfide may be $Au_2S_1$ or a composition of excess sulfur such as $Au_2S_1$—$Au_2S_2$, with the composition of excess sulfur being preferred. $Au_2S_{1.1}$—$Au_2S_{1.8}$ is more preferable.

The chemical composition analysis can be carried out by the steps of taking gold sulfide particles and measuring the content of gold and the content of sulfur using analytical methods such as IPC and iodometry. If gold ions or sulfur ions (including hydrogen sulfide and its salt) dissolved in a liquid phase exist in a colloid dispersion of gold sulfide, they give an adverse influence on the chemical composition analysis. Therefore, gold sulfide particles are separated by, for example, an ultrafiltration before analysis. An addition amount of the colloid dispersion of gold sulfide can vary over a wide range according to the occasions. But, the amount in terms of gold is generally in the range of $5\times10^{-7}$ to $5\times10^{-3}$ mole, preferably in the range of $5\times10^{-6}$ to $5\times10^{-4}$ mole, per mole of silver halide respectively.

Chalcogen sensitization and gold sensitization can be conducted simultaneously using the same molecule such as a molecule capable of releasing $AuCh^-$ in which Au represents Au (I), and Ch represents a sulfur atom, a selenium atom or a tellurium atom. Examples of the molecule capable of releasing $AuCh^-$ include gold compounds represented by AuCh—L in which $L^I$ represents an atomic group bonding to AuCh to form a molecule. Further one or more ligands may co-ordinate to Au together with Ch—L. The gold compounds represented by AuCh—L have a tendency to form AgAuS (Ch═S), AgAuSe (Ch═Se), or AgAuTe (Ch═Te), when the gold compounds are reacted in a solvent in the presence of silver ions. Examples of the gold compounds include those compounds in which L is an acyl group. In addition, gold compounds represented by the following formula (AuCh1), formula (AuCh2), or formula (AuCh3) are exemplified.

$R_1$—X—M—ChAu Formula (AuCh1), wherein Au represents Au (I); Ch represents a sulfur atom, a selenium atom or a tellurium atom; M represents a substituted or unsubstituted methylene group; X represents an oxygen atom, a sulfur atom, a selenium atom or $NR_2$; $R_1$ represents an atomic group bonding to X to form a molecule (organic groups such as alkyl, aryl and heterocyclic groups); $R_2$ represents a hydrogen atom or a substituent (organic groups such as alkyl, aryl and heterocyclic groups); and $R_1$ and M may combine together to form a ring.

Regarding the compound represented by formula (AuCh 1), Ch is preferably a sulfur atom or a selenium atom; X is preferably an oxygen atom or a sulfur atom; and $R_1$ is preferably an alkyl group or an aryl group. Examples of more specific compounds include Au(I) salts of thiosugar (for example, gold thioglucose (such as αgold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Here, the terms "thiosugar", "selenosugar" and "tellurosugar" mean the compounds in which a hydroxyl group in the anomer position of the sugar is substituted with a SH group, a SeH group and a TeH group respectively.

$W_1(W_2)C{=}C(R_3)ChAu$ Formula (AuCh2), (This may be expressed by $W_1W_2C{=}CR_3ChAu$.)

wherein Au represents Au(I); Ch represents a sulfur atom, a selenium atom or a tellurium atom; $R_3$ and $W_2$ each independently represent a hydrogen atom or a substituent (a halogen atom, or organic groups such as alkyl, aryl and heterocyclic groups); $W_1$ represents an electron-withdrawing group having a positive value of the Hammett's substituent constant $\sigma_p$ value; and $R_3$ and $W_1$, $R_3$ and $W_2$, or $W_1$ and $W_2$ may bond together to form a ring respectively. The substituent in $R_3$ and/or $W_2$ can include a hydrogen atom. And then, a hydrogen atom and a substituent may be handled as same.

Regarding the compound represented by formula (AuCh 2), Ch is preferably a sulfur atom or a selenium atom; $R_3$ is preferably a hydrogen atom or an alkyl group; and each of $W_1$ and $W_2$ is preferably an electron-withdrawing group having the Hammett's substituent constant $\sigma_p$ value of 0.2 or more. Examples of more specific compounds include $(NC)_2C{=}CHSAu$, $(CH_3OCO)_2C{=}CHSAu$, and $CH_3CO(CH_3OCO)C{=}CHSAu$.

$W_3$—E—ChAu Formula (AuCh3), wherein Au represents Au(I); Ch represents a sulfur atom, a selenium atom or a tellurium atom; E represents a substituted or unsubstituted ethylene group; $W_3$ represents an electron-withdrawing group having a positive value of the Hammett's substituent constant $\sigma_p$ value.

Regarding the compound represented by formula (AuCh 3), Ch is preferably a sulfur atom or a selenium atom; E is preferably an ethylene group with an electron-withdrawing group having a positive value of the Hammett's substituent constant $\sigma_p$ value; and $W_3$ is preferably an electron-withdrawing group having the Hammett's substituent constant $\sigma_p$ value of 0.2 or more. An addition amount of these compounds can vary over a wide range according to the occasions. But, the amount is generally in the range of $5\times10^{-7}$ to $5\times10^{-3}$ mole, preferably in the range of $3\times10^{-6}$ to $3\times10^{-4}$ mole, per mole of silver halide respectively.

In the present invention, the above-mentioned gold sensitization may be combined with other chemical sensitization such as sulfur sensitization, selenium sensitization, tellurium sensitization, reduction sensitization and noble metal sensitization using noble metals other than gold compounds. Particularly, the gold sensitization is preferably combined with sulfur sensitization, or selenium sensitization.

Various compounds or precursors thereof can be included in the silver halide emulsion for use in the present invention to prevent fogging from occurring or to stabilize photographic performance during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 are also preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts of these acids); hydroxylamines represented by the formula (A) described in U.S. Pat. No. 5,556,741 (the description of line 56 in column 4 to line 22 in column 11 of U.S. Pat. No. 5,556,741 is preferably acceptable for the present specification and is incorporated herein); water-soluble reducing agents represented by formula (I), (II), or (III) of JP-A-11-102045.

Spectral sensitization can be carried out for the purpose of imparting a so-called spectral sensitivity in a desired light wavelength region to the light-sensitive emulsion in each layer of the photosensitive material for use in the present invention.

Spectral sensitizing dyes which are used in the photosensitive material for use in the present invention for spectral sensitization of blue, green and red light regions include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide color photographic light-sensitive material (hereinafter sometimes simply referred to as "light-sensitive material") of the present invention, particularly in the first embodiment, comprises a support and coated thereon at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer that does not develop a color, wherein at least one of said silver halide emulsion layers contains silver halide emulsion defined by the present invention.

The light-sensitive material of the present invention, particularly in the second embodiment, preferably comprises a support and coated thereon at least one silver halide emulsion layer containing a yellow dye-forming coupler, at least one silver halide emulsion layer containing a magenta dye-forming coupler and at least one silver halide emulsion layer containing a cyan dye-forming coupler, wherein at least one of said silver halide emulsion layers preferably contains silver halide emulsion defined by the present invention.

The light-sensitive material of the present invention, particularly in the third embodiment, comprises a support and coated thereon at least one silver halide emulsion layer containing a yellow dye-forming coupler, at least one silver halide emulsion layer containing a magenta dye-forming coupler and at least one silver halide emulsion layer containing a cyan dye-forming coupler, wherein at least one of said silver halide emulsion layers preferably contains silver halide emulsion defined by the present invention.

The light-sensitive material of the present invention, particularly in the fourth embodiment, preferably comprises a support and coated thereon at least one silver halide emulsion layer containing a yellow dye-forming coupler, at least one silver halide emulsion layer containing a magenta dye-forming coupler and at least one silver halide emulsion layer containing a cyan dye-forming coupler, wherein at least one of said silver halide emulsion layers preferably contains silver halide emulsion defined by the present invention.

In the present invention, the above-mentioned silver halide emulsion layers each containing a yellow dye-forming coupler, a magenta dye-forming coupler, and a cyan dye-forming coupler act as a yellow dye-forming layer, a magenta dye-forming layer, and a cyan dye-forming layer respectively. The silver halide emulsions that are incorporated in each of said yellow color-forming layer, said magenta color-forming layer, and said cyan color-forming layer preferably have photosensitivity to light in a different wavelength range from each other (such as three different light in a blue color range, a green color range and a red color range). The light-insensitive and non-color-developable hydrophilic colloidal layer is not particularly limited. Particularly, in the first embodiment, examples of the hydrophilic colloidal layer preferably include a color mixing preventing layer, a UV absorbing layer and a protective layer.

In addition to the yellow color developing layer, the magenta color developing layer, and the cyan color developing layer, the photosensitive material according to the present invention may have a hydrophilic colloid layer, an antihalation layer, an intermediate layer and coloring layer as desired.

Other conventionally-known photographic materials and additives may be used in the silver halide photographic light-sensitive material of the present invention.

For example, as a photographic support (base), a transmissive type support and a reflective type support may be used. As the transmissive type support, it is preferred to use transparent supports, such as a cellulose nitrate film, and a transparent film of polyethyleneterephthalate, or a polyester of 2,6-naphthalenedicarboxylic acid (NDCA) and ethylene glycol (EG), or a polyester of NDCA, terephthalic acid and EG, provided thereon with an information-recording layer such as a magnetic layer. As the reflective type support, it is especially preferable to use a reflective support having a substrate laminated thereon with a plurality of polyethylene layers or polyester layers, at least one of the water-proof resin layers (laminate layers) contains a white pigment such as titanium oxide.

A more preferable reflective support for use in the present invention is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/m$^1$, more preferably in the range of 0.50 to 0.70 g/m$^1$. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/m$^1$. As to the reflective support for use in the present invention, preferable embodiments of the polyolefin layer provide on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent may also be dispersed in a hydrophilic colloid layer of the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support.

Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer side or the reverse side of the support. In particular, it is preferable that the transmission density of support is adjusted to the range of 0.35 to 0.8 so that a display may be enjoyed by means of both transmitted and reflected rays of light.

In the light-sensitive material of the present invention, in order to improve, e.g., the sharpness of an image, a dye (particularly an oxonole-series dye) that can be discolored by processing, as described in European Patent No. 0337490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcoholes (e.g., trimethylolethane) to a water-proof resin layer of the support.

The light-sensitive material for use in the present invention preferably contains, in their hydrophilic colloid layers, dyes (particularly oxonole dyes and cyanine dyes) that can be discolored by processing, as described in European Patent No. 0337490 A2, pages 27 to 76, in order to prevent irradiation or halation or enhance safelight safety (immunity). Further, dyes described in European Patent No. 0819977 are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with a light-sensitive emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only one layer selected from them may be provided. In addition, it is possible to provide a colored layer subjected to coloring so as to match a plurality of primary-color regions. About the optical reflection density of the colored layer, it is preferred that, at the wavelength which shows the highest optical density in a range of wavelengths used for exposure (a visible light region from 400 nm to 700 nm for an ordinary printer exposure, and the wavelength of the light generated from the light source in the case of scanning exposure), the optical density is within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the methods of incorporating fine particles of dye and of using a colloidal silver.

The silver halide color photographic light-sensitive material of the present invention can be used for a color negative film, a color positive film, a color reversal film, particularly in the first and fourth embodiments, a display light-sensitive material, a cinema color negative, a cinema color positive, a digital color proof for scanning exposure, particularly in the first to fourth embodiments, a color reversal photographic paper, and a color photographic paper. Among them, the use of a color photographic paper is preferable. The color photographic paper has preferably at least a yellow color-forming silver halide emulsion layer, at least a magenta color-forming silver halide emulsion layer, and at least a cyan color-forming silver halide emulsion layer. These silver halide emulsion layers are generally arranged in the above-mentioned order (i.e. yellow, magenta and cyan color-forming silver halide emulsion layers) from a support.

However, another layer arrangement which is different from the above, may be adopted.

In the present invention, a yellow coupler-containing silver halide emulsion layer may be disposed at any position on a support. However, in the case where silver halide tabular grains are contained in the yellow coupler-containing layer, it is preferable that the yellow coupler-containing layer be positioned more apart from a support than at least one of a magenta coupler-containing silver halide emulsion layer and a cyan coupler-containing silver halide emulsion layer. Further, it is preferable that the yellow coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan coupler-containing silver halide emulsion layer be disposed in the middle of other silver halide emulsion layers, from the viewpoint of reducing blix fading. On the other hand, it is preferable that the cyan coupler-containing silver halide emulsion layer be the lowest layer, from the viewpoint of reducing light fading. Further, each of the yellow-color-forming layer, the magenta-color-forming layer and the cyan-color-forming layer may be composed of two or three layers. It is also preferable that a color forming layer be formed by disposing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic materials and additives for processing are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, and an anti-fogging agent, the methods of chemical sensitization (sensitizers), the methods of spectral sensitization (spectral sensitizers), the cyan, magenta, and yellow couplers and the emulsifying and dispersing methods thereof, the dye image stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following Table 1 are particularly preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |

TABLE 1-continued

| Element | JP-A-7-104448 | JP-A-7-77775 | JP-A-7-301895 |
|---|---|---|---|
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coated film of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As cyan, magenta and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right lower column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it may be and is preferred for the present invention to add compounds represented by formula (II) or (III) in WO 98/33760 and compounds represented by formula (D) described in JP-A-10-221825.

As the cyan dye-forming coupler (hereinafter also referred to as "cyan coupler") which can be used in the present invention, pyrrolotriazole-series couplers are preferably used, and more specifically, couplers represented by any of formulae (I) and (II) in JP-A-5-313324 and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. As cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, the cyan dye-forming coupler according to the present invention can also be a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrazole cyan coupler described in European Patent No. 0456226 A1; and a pyrroloimidazole cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated in the present specification by reference.

The magenta dye-forming couplers (which may be referred to simply as a "magenta coupler" hereinafter) that can be used in the present invention are 5-pyrazolone magenta couplers and pyrazoloazole magenta couplers such as those described in the above-mentioned patent publications in Table 1. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A2 and 0294785 A, in view of the hue and stability of image to be formed therefrom and color-forming property of the couplers. Particularly as the magenta coupler, pyrazoloazole couplers represented by formula (M-I) described in JP-A-8-122984 are preferred. The descriptions of paragraph Nos. 0009 to 0026 of the patent publication JP-A-8-122984 are entirely applied to the present invention and therefore are incorporated in the specification of this application as a part thereof by reference. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" hereinafter), preferably used in the present invention are acylacetamide yellow couplers in which the acyl group has a 3-membered to 5-membered cyclic structure, such as those described in European Patent No. 0447969 A1; malondianilide yellow couplers having a cyclic structure, as described in European Patent No. 0482552 A1; pyrrol-2 or 3-yl or indol-2 or 3-yl carbonyl acetic acid anilide-series couplers, as described in European Patent (laid open to public) Nos. 953870 A1, 953871 A1, 953872 A1, 953873 A1, 953874 A1 and 953875 A1; acylacetamide yellow couplers having a dioxane structure such as those described in U.S. Pat. No. 5,118,599, in addition to the compounds described in the above-mentioned table. Above all, acylacetamide yellow couplers in which the acyl group is an 1-alkylcyclopropane-1-carbonyl group, and malondianilide yellow couplers in which one anilide constitute an indoline ring are especially preferably used. These couplers may be used singly or as combined.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homopolymers and co-polymers as disclosed in U.S. Pat. No. 4,857,449, from column 7 to column 15 and WO 88/00723, from page 12 to page 30. The use of methacrylate-series or acrylamide-series polymers, especially acrylamide-series polymers are more preferable in view of color-image stabilization and the like.

In the present invention, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19629142 A1, may be used. Particularly, in order to accelerate developing speed by increasing the pH of a developing solution, redox compounds described in, for example, German Patent No. 19,618,786 A1, European Patent Nos. 0,839,623 A1 and 0,842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, those described in the following patent publications can be used. These compounds are preferably added to the light-sensitive layer or/and the light-nonsensitive layer. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid which can be used in the light-sensitive material according to the present invention, gelatin is used advantageously, but another hydrophilic colloid can be used singly or in combination with gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the film of the light-sensitive material is preferably in the range of 4.0 to 7.0, more preferably in the range of 4.0 to 6.5.

In the first embodiment of the present invention, a total coating amount of a hydrophilic binder on the emulsion layer-coating side of the support is generally 6.0 g/m$^2$ or less (preferably from 3 g/m$^2$ to 6 g/m$^2$). Said coating amount is more preferably in the range of 3 g/m$^2$ to 5 g/m$^2$.

In the present invention, particularly in the second and fourth embodiments, a total coating gelatin amount in the photographic constituent layer is preferably 3 g/m$^2$ to 6 g/m$^2$ and more preferably 3 g/m$^2$ to 5 g/m$^2$. In the present invention, particularly the third embodiment, a total coating gelatin amount of the photographic constituent layer in the silver halide color photosensitive material is generally 3.0 g/m$^2$ to 6.0 g/m$^2$, preferably 3.0 g/m$^2$ to 5.5 g/m$^2$ and more preferably 3.0 g/m$^2$ to 5.0 g/m$^2$.

For satisfactory achievement of progressiveness of development as well as bleach-fixing performances and residual color even in an ultra-rapid processing, a film thickness of the entire photographic constituent layers, particularly in the first embodiment, is preferably in the range of 3 μm to 7.5 μm, and more preferably in the range of 3 μm to 6.5 μm, particularly in the second embodiment, is preferably 3 μm to 7.5 μm and more preferably 3 μm to 6.5 μm, particularly in the third embodiment, is preferably 3.0 μm to 7.5 μm, more preferably 3.5 μm to 7.0 μm and further preferably 4.0 μm to 6.5 μm, and particularly in the fourth embodiment, is preferably 3 μm to 7.5 μm and more preferably 3 μm to 6.5 μm.

A dry film thickness can be measured by the change of film thickness before and after peeling the dried film, or by observation of the cross section using an optical microscope, or electron microscope.

In the present invention, a wet (swollen) film thickness, particularly in the first embodiment, is preferable in the range of 8 μm to 19 μm, more preferably in the range of 9 μm to 18 μm, particularly in the second embodiment, is preferably 8 μm to 19 μm and more preferably 9 μm to 18 μm, particularly in the third embodiment, is preferably 5.0 μm to 19.0 μm, more preferably 6.0 μm to 14.0 μm and most preferably 7.0 to 12.0 μm, and particlarly in the fourth embodiment is preferably 8 μm to 19 μm and more preferably 9 μm to 18 μm so that both progressiveness of development and drying rate can be improved. As the measurement of the wet film thickness, the dried light-sensitive material is immersed in an aqueous solution at 35° C. to swell it, and in a sufficiently equilibrated state of the swollen light-sensitive material, the wet film thickness can be measured according to an ordinary method. As the hydrophilic binder, various kinds of synthetic polymers may be used. Among them, gelatin is preferable.

Further, it is preferable that the light-sensitive material of the present invention, particularly in the first embodiment, has the total amount of a hydrophilic binder in the above-mentioned range and also at the same time the total coating amount of silver in the entire photographic constituent layers in the above-mentioned range. Specifically, the embodiment in which a total amount of a hydrophilic binder is 6.0 g/m$^2$ or less (preferably from 3 g/m$^2$ to 6 g/m$^2$) and a total coating amount of silver in the entire photographic constituent layers is in the range of 0.2 g/m$^2$ to 0.5 g/m$^2$ is preferred.

In the present invention, particularly in the fourth embodiment, the less coating amount of silver, the more remarkable effects of the present invention can be obtained. The total coating amount of silver in the silver halide emulsion layer containing a yellow dye-forming coupler, the silver halide emulsion layer containing a magenta dye-forming coupler and the silver halide emulsion layer containing a cyan dye-forming coupler is preferably in the range of 0.25–0.46 g/m$^2$, more preferably in the range of 0.3–0.4 g/m$^2$. The coating amount of silver in each of the silver halide emulsion layer containing a yellow dye-forming coupler, the silver halide emulsion layer containing a magenta dye-forming coupler and the silver halide emulsion layer containing a cyan dye-forming coupler is preferably in the range of 0.07 to 0.20 g/m$^2$, more preferably in the range of 0.08 to 0.18 g/m$^2$. Particularly it is most preferable that the coating amount of silver in the silver halide emulsion layer containing a yellow dye-forming coupler is in the range of 0.07 to 0.15 g/m$^2$.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is particularly preferred. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but generally in the range of $1\times10^{-5}$ to 1 g/m$^2$, preferably in the range of $1\times10^{-5}$ to $1\times10^{-1}$ g/m$^2$, and more preferably in the range of $1\times10^{-3}$ to $1\times10^{-2}$ g/m$^2$.

The photosensitive material for use in the present invention can form an image by an exposure step in which the photosensitive material is irradiated with light according to image information, and a development step in which the photosensitive material irradiated with light is developed.

The light-sensitive material for use in the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred from the viewpoint of high quality enhancement, because a cathode ray tube having a high resolving power can be used.

The light-sensitive material for use in the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

In the case of using these light sources for scanning exposure, the wavelength of the spectral sensitivity maximum provided by the light-sensitive material of the present invention can be set arbitrarily in accordance with the wavelength of the light source to be used. As an oscillation wavelength of a laser can be made half using a SHG light source comprising a combination of a nonlinear optical crystal with a solid state laser using a semiconductor laser as an excitation light source, or a semiconductor laser, a blue light and a green light can be obtained. Accordingly, the spectral sensitivity maximum of the light-sensitive material can be set in normal three wavelength regions of blue, green and red respectively. The exposure time in such a scanning exposure is defined as a time required for exposing a pixel size with the pixel density being 400 dpi. A preferable exposure time is $10^{-4}$ second or less and more preferably $10^{-6}$ second or less.

For the silver halide color photosensitive material in the present invention, the imagewise exposure is preferably carried out with a coherent light as a blue light having a wavelength of 420 to 460 nm from a laser. Among lasers for a blue light, semiconductor laser for a blue light is especially preferable. In particular, an emittung wavelength is preferably within 430 to 450 nm from viewpoint of obtaining an effect of the present invention.

Examples of the semiconductor laser include blue light semiconductor laser having a wavelength of 430 to 450 nm (Presentation by Nichia Corporation at the $48^{th}$ Applied Physics Related Joint Meeting in March of 2001), a blue laser at about 470 nm obtained by wavelength modulation of a semiconductor laser (oscillation wavelength about 940 nm) with a SHG crystal of $LiNbO_3$ having a reversed domain structure in the form of a wave guide, a green laser at about 530 nm obtained by wavelength modulation of a semiconductor laser (oscillation wavelength about 1,060 nm) with a SHG crystal of $LiNbO_3$ having a reversed domain structure in the form of a wave guide, a red light semiconductor laser at about 685 nm (Type No. HL6738MG (trade name) manufactured by Hitachi, Ltd.), and a red light semiconductor laser at about 650 nm (Type No. HL6501MG (trade name) manufactured by Hitachi, Ltd.).

It is one of preferable embodiments of the present invention, particularly in the fourth embodiment, that a scanning exposure is conducted using the afore-mentioned laser as a light source. The light-sensitive material of the present invention, particularly in the fourth embodiment, is preferably applied to a silver halide color photographic light-sensitive material for laser exposure and rapid processing.

When the so-called "latent image-holding time" from completion of the exposure as mentioned above to starting of a color development is a short period of within 9 seconds (preferably from 0.1 second to 9 seconds), effects of the present invention are exerted. A remarkable effect can be obtained preferably when the latent image-holding time is within 6 seconds (preferably from 1 second to 6 seconds). In the system of which an exposing equipment and a processor are separate and independent, because a latent image-holding time necessarily becomes longer, no effect of the present invention, particularly in the fourth embodiment, is exerted. On the other hand, in the system of which an exposing equipment and a processor are integrated in a printer, thereby a total printing time being remarkably shortened, effects of the present invention, particularly in the fourth embodiment, are exerted.

The silver halide color photosensitive material for use in the present invention is preferably used in combination with the exposure and development systems described in the following known materials. Example of the development system include the automatic print and development system described in JP-A-10-333253, the photosensitive material conveying apparatus described in JP-A-2000-10206, a recording system including the image reading apparatus described in JP-A-11-215312, exposure systems with the color image recording method described in JP-A-11-88619 and JP-A-10-202950, a digital photo print system including the remote diagnosis method described in JP-A-10-210206, and a photo print system including the image recording apparatus described in JP-A-2000-310822.

The preferred scanning exposure methods which can be applied to the present invention are described in detail in the table shown above.

It is preferred to use a band stop filter, as described in U.S. Pat. No. 4,880,726, when the photographic material for use in the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patent publications listed in the above Table are preferably used.

The color photosensitive material can be subjected to an ordinary manner, but it is preferably used as a light-sensitive material having a rapid processability.

Namely, the present invention can be properly applied to a light-sensitive material with a rapid processing suitability. A color developing time is in the range of generally 28 sec. or less (preferably 28 sec. to 6 sec.), preferably 28 sec. to 2 sec., more preferably in the range of 25 sec. to 6 sec., and most preferably in the range of 20 sec. to 6 sec. After color-developing, it is preferable to conduct bleach-fixing step (or bleaching step and fixing step), washing step with water or stabilizing step, and drying step. Likewise, a bleach-fixing time is generally 30 sec. or less (preferably 30 sec. to 6 sec.), preferably in the range of 30 sec. to 2 sec., more preferably in the range of 25 sec. to 6 sec., and further more preferably in the range of 20 sec. to 6 sec. A washing or stabilizing time is generally 60 sec. or less (preferably 60 sec. to 6 sec.), preferably in the range of 60 sec. to 2 sec., more preferably in the range of 40 sec. to 6 sec. and most preferably 20 sec. to 6 sec. A drying time is generally in the range of 20 sec. to 5 sec., and preferably in the range of 10 sec. to 5 sec.

Here, the term "color developing time" means a period of time ranging from just after a light-sensitive material has entered into a developing solution to until the light-sensitive material has entered into a bleach-fixing solution at the subsequent processing step. For example, in a case where a processing is conducted using an automatic processor or the like, the total of a period of time when a light-sensitive material has been immersed in a developing solution (so-called "in-liquid time") and a period of time when after leaving from the developing solution, the light-sensitive material has been transferred toward a bleach-fixing bath at the subsequent processing step (so-called "in-air time") is designated as a color developing time. Likewise, the term "bleach-fixing time" means a period of time ranging from just after a light-sensitive material has entered into a bleach-fixing solution to until the light-sensitive material has entered into a washing or stabilizing bath at the subsequent processing step. Further, the term "washing or stabilizing time" means a period of time ranging from just after a light-sensitive material has entered into a washing or stabilizing solution to until the light-sensitive material has been in the solution toward the drying step (so-called "in-liquid time").

In the method of forming images of the present invention, particularly in the first embodiment, after exposure, particularly by a laser scanning exposure, the exposed light-sensitive material is subjected to a development processing in a "Dry to Dry" time of 90 sec. or less, preferably in the range of 15 sec. to 90 sec., and more preferably in the range of 15 sec. to 75 sec. Here, the term "Dry to Dry" time in the present invention means a total processing time including from a color developing time to a drying time in the development processing steps.

As a method for developing a light-sensitive material after exposure, there are known a method of developing a light-sensitive material with a developing solution containing an alkali agent and a developing agent (preferably, p-phenylene diamine-series developing agents) and a wet. system such as a developing method wherein a developing agent is being incorporated in the light-sensitive material and an activator solution, e.g., a developing agent-free alkaline solution is employed for development. In addition to the above, a heat development system using no processing solution is also known. The present invention can be applied to a conventional developing method in which a developing solution containing an alkali agent and a developing agent is employed. As a preferable conventional developing method using a developing solution containing an alkali agent and developing agent, in particular, there is indicated the above-mentioned method described in JP-A-2-207250, referred to in the description from in line 1 on right lower column on page 26 to in line 9 on right upper column on page 34. This portion of the JP-A-2-207250 is preferably incorporated in the present specification to make it a part of the present specification.

According to the silver halide color photographic light-sensitive material of the first embodiment in the present invention, rapid processing suitability, high sensitivity, excellent pressure resistance, and hard gradation are excellently obtained even upon a digital exposure such as a laser scanning exposure.

Further, according to the method of forming images of the first embodiment in the present invention, high contrast images with high sensitivity but without pressure desensitization can be excellently obtained by an ultra-rapid processing.

For the silver halide photographic light-sensitive material of the second embodiment in the present invention, digital exposure by a laser scanning exposure is suitable and said light-sensitive material, even when subjected to an ultra-rapid processing, always shows a stable photographic performance, which is particularly suitable for a color print.

According to the silver halide color photographic light-sensitive material of the third embodiment in the present invention, stable photographic performances can be obtained using an identical light-sensitive material even in the conventional processing process or even in a rapid processing process, whether the exposing time is long or short and less difference in photographic performances between digital exposure system and analogue exposure system.

According to the fourth embodiment in the present invention, a silver halide color photographic light-sensitive material that is excellent in storability of the light-sensitive material, rapid processability and processing stability is obtained. More particularly, a silver halide color photographic light-sensitive material suitable for color prints, that is capable of lessening deterioration of a white ground resulting from storage of the light-sensitive material even for a long period of time, and capable of providing the maximum density upon a rapid color development as well as a stable photographic performance against a fluctuation in the processing factors, is obtained.

Hereinafter, the present invention will be described in more detail based on examples given below, but the present invention is not meant to be limited thereto.

EXAMPLES

Example 1

Preparation of Emulsion B-0

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 50° C. An aqueous solution of $K_4[Ru(CN)_6]$ was added at the step of from 80% to 90% addition of the entire silver nitrate amount, so that the Ru amount became $3\times10^{-5}$ mole per mole of the finished silver halide. An aqueous solution of $K_2[IrCl_6]$ was added at the step of from 82% to 88% addition of the entire silver nitrate amount, so that the Ir amount became $5.3\times10^{-8}$ mole per mole of the finished silver halide. After desalting at 40° C., 168 g of a lime-processed gelatin was added, and then pH and pCl were adjusted to 5.5 and 1.8 respectively. The obtained emulsion contained cubic silver chloride grains having an equivalent-sphere diameter of 0.51 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B, 1-phenyl-5-mercaptotetrazole, 1-(5-methylureidophenyl)-5-mercaptotetrazole, and potassium bromide were added in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of silver halide respectively, thereby Emulsion B-0 being prepared.

Preparation of Emulsion B-1

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 50° C. An aqueous solution of KBr was added at the step of from 80% to 90% addition of the entire silver nitrate amount, so that the Br amount became 3 mole % per mole of the finished silver halide. As well, an aqueous solution of $K_4[Ru(CN)_6]$ was added at the step of from 80% to 90% addition of the entire silver nitrate amount, so that the Ru amount became $3\times10^{-5}$ mole per mole of the finished silver halide. An aqueous solution of $K_2[IrCl_6]$ was added at the step of from 82% to 88% addition of the entire silver nitrate amount, so that the Ir amount became $5.3\times10^{-8}$ mole per mole of the finished silver halide. An aqueous solution of KI was added at the step of 90% addition of the entire silver nitrate amount, so that the I amount became 0.3 mole % per mole of the finished silver halide. After desalting at 40° C., 168 g of a lime-processed gelatin was added, and then pH and pCl were adjusted to 5.5 and 1.8 respectively.

The obtained emulsion contained cubic silver chlorobromoiodide grains having an equivalent-sphere diameter of 0.51 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B, 1-phenyl-5-mercaptotetrazole, 1-(5-methylureidophenyl)-5-mercaptotetrazole, and potassium bromide were added in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of silver halide respectively, thereby Emulsion B-1 being prepared.

(Sensitizing dye A)

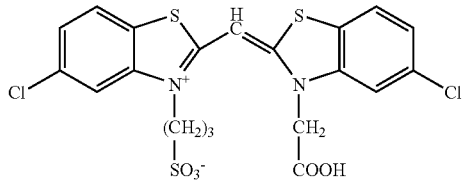

(Sensitizing dye B)

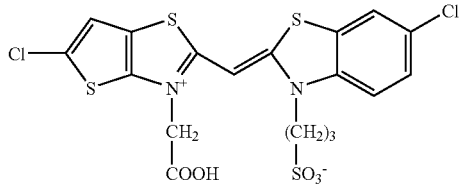

In this example, the sensitizing dye B may be same as in the following EXAMPLE 4.

Preparation of Emulsion B-2

An emulsion was prepared in the same manner as in the afore-mentioned preparation of Emulsion B-1, except that an aqueous solution of $K_4[Fe(CN)_6]$ was added in place of an aqueous solution of $K_4[Ru(CN)_6]$ at the step of from 80% to 90% addition of the entire silver nitrate amount, so that the Fe amount became $3\times10^{-5}$ mole per mole of the finished silver halide. The resulting emulsion was designated as Emulsion B-2.

Preparation of Emulsion B-3

An emulsion was prepared in the same manner as in the afore-mentioned preparation of Emulsion B-1, except that an aqueous solution of $K_4[Fe(CN)_6]$ was added in place of an aqueous solution of $K_4[Ru(CN)_6]$ at the step of from 80% to 90% addition of the entire silver nitrate amount, so that the Fe amount became $3\times10^{-5}$ mole per mole of the finished silver halide; an aqueous solution of $K_2[IrCl_6]$ was added at the step of from 82% to 88% addition of the entire silver nitrate amount, so that the Ir amount became $3.6\times10^{-8}$ mole per mole of the finished silver halide; and also an aqueous solution of $K_2[IrBr_6]$ was added at the step of the addition of from 82% to 88% of the entire silver nitrate amount, so that the Ir amount became $4.0\times10^{-8}$ mole per mole of the finished silver halide. The resulting emulsion was designated as Emulsion B-3.

Preparation of Emulsion B-4

An emulsion was prepared in the same manner as in the afore-mentioned preparation of Emulsion B-1, except that an aqueous solution of $K_2[IrCl_6]$ was added at the step of from 82% to 88% addition of the entire silver nitrate amount, so that the Ir amount became $3.6\times10^{-8}$ mole per mole of the finished silver halide; and further an aqueous solution of $K_2[Ir(H_2O)Cl_5]$ was added at the step of from 92% to 98% addition of the entire silver nitrate amount, so that the Ir amount became $1.6\times10^{-8}$ mole per mole of the finished silver halide. The resulting emulsion was designated as Emulsion B-4.

Preparation of Emulsion B-5

An emulsion was prepared in the same manner as in the afore-mentioned preparation of Emulsion B-1, except that an aqueous solution of $K_2[IrCl_6]$ was added at the step of from 82% to 88% addition of the entire silver nitrate amount, so that the Ir amount became $1.2\times10^{-8}$ mole per mole of the finished silver halide; and further an aqueous solution of $K_2[Ir(5\text{-methlthiazole})Cl_5]$ was added at the step of from 92% to 98% addition of the entire silver nitrate amount, so that the Ir amount became $1.0\times10^{-6}$ mole per mole of the finished silver halide. The resulting emulsion was designated as Emulsion B-5.

Preparation of Emulsion B-6

An emulsion was prepared in the same manner as in the afore-mentioned preparation of Emulsion B-1, except that an aqueous solution of $K_2[IrCl_6]$ was added at the step of from 82% to 88% addition of the entire silver nitrate amount, so that the Ir amount became $8.0\times10^{-9}$ mole per mole of the finished silver halide; and further at the step of from 92% to 98% addition of the entire silver nitrate amount, an aqueous solution of $K_2[Ir(5\text{-methylthiazole})Cl_5]$ was added so that the Ir amount became $8.0\times10^{-6}$ mole and an aqueous solution of $K_2[Ir(H_2O)Cl_5]$ was added so that the Ir amount became $1.1\times10^{-6}$ mole, per mole of the finished silver halide respectively. The resulting emulsion was designated as Emulsion B-6.

Preparation of Emulsion B-7

An emulsion was prepared in the same manner as in the afore-mentioned preparation of Emulsion B-1, except that an aqueous solution of $K_2[IrCl_6]$ was added at the step of from 82% to 88% addition of the entire silver nitrate amount, so that the Ir amount became $1.0\times10^{-8}$ mole per mole of the finished silver halide; and further at the step of from 82% to 88% addition of the entire silver nitrate amount, an aqueous solution of $K_2[Ir(2\text{-chloro-5-fluorothiadiazole})Cl_5]$ was added so that the Ir amount became $7.2\times10^{-7}$ mole per mole of the finished silver halide respectively. The resulting emulsion was designated as Emulsion B-7.

Here, the afore-mentioned Emulsions B-2 to B-7 are cubic silver iodobromochloride emulsions containing silver halide grains having an equivalent-sphere diameter of 0.51 μm and a variation coefficient of 9%.

Preparation of Emulsion B-8

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 50° C. An aqueous solution of KBr was added at the step of from 80% to 90% addition of the entire silver nitrate amount, so that the Br amount became 3 mole % per mole of the finished silver halide. As well, an aqueous solution of $K_4[Ru(CN)_6]$ was added at the step of from 80% to 90% addition of the entire silver nitrate amount, so that the Ru amount became $3\times10^{-5}$ mole per mole of the finished silver halide. An aqueous solution of $K_2[IrCl_6]$ was added at the step of from 82% to 88% addition of the entire silver nitrate amount, so that the Ir amount became $1.0\times10^{-8}$ mole per mole of the finished silver halide. As well, an aqueous solution of $K_2$[Ir(2-chloro-5-fluorothiadiazole)$Cl_5$] was added at the step of from 82% to 88% addition of the entire silver nitrate amount, so that the Ir amount became $7.2\times10^{-7}$ mole per mole of the finished silver halide. After desalting at 40° C., 168 g of a lime-processed gelatin was added, and then pH and pCl were adjusted to 5.5 and 1.8 respectively. The obtained emulsion contained cubic silver bromochloride grains having an equivalent-sphere diameter of 0.51 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B, 1-phenyl-5-mercaptotetrazole, 1-(5-methylureidophenyl)-5-mercaptotetrazole, and potassium bromide were added in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of silver halide respectively, thereby Emulsion B-8 being prepared.

Preparation of Emulsion B-9

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 50° C. An aqueous solution of $K_4$[Ru$(CN)_6$] was added at the step of from 80% to 90% addition of the entire silver nitrate amount, so that the Ru amount became $3\times10^{-5}$ mole per mole of the finished silver halide. An aqueous solution of $K_2[IrCl_6]$ was added at the step of from 82% to 88% addition of the entire silver nitrate amount, so that the Ir amount became $1.0\times10^{-8}$ mole per mole of the finished silver halide. As well, an aqueous solution of $K_2$[Ir(2-chloro-5-fluorothiadiazole)$Cl_5$] was added at the step of from 82% to 88% addition of the entire silver nitrate amount, so that the Ir amount became $7.2\times10^{-7}$ mole per mole of the finished silver halide. An aqueous solution of KI was added at the step of 90% addition of the entire silver nitrate amount, so that the I amount became 0.3 mole % per mole of the finished silver halide. After desalting at 40° C., 168 g of a lime-processed gelatin was added, and then pH and pCl were adjusted to 5.5 and 1.8 respectively. The obtained emulsion contained cubic silver iodochloride grains having an equivalent-sphere diameter of 0.51 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B, 1-phenyl-5-mercaptotetrazole, 1-(5-methylureidophenyl)-5-mercaptotetrazole, and potassium bromide were added in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of silver halide respectively, thereby Emulsion B-9 being prepared.

Preparation of Emulsion G-1

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 40° C. An aqueous solution of $K_3[RhBr_6]$ was added at the step of from 60% to 80% addition of the entire silver nitrate amount, so that the Rh amount became $5.8\times10^{-9}$ mole per mole of the finished silver halide. Potassium bromide (KBr) was added to the reaction solution with vigorous stirring at the step of from 80% to 100% addition of the entire silver nitrate amount used in emulsion grain formation, so that the KBr amount became 4.3 mole % per mole of the finished silver halide. An aqueous solution of $K_4[Ru(CN)_6]$ was added at the step of from 80% to 90% addition of the entire silver nitrate amount, so that the Ru amount became $3.0\times10^{-5}$ mole per mole of the finished silver halide. An aqueous solution of $K_2[IrCl_6]$ was added at the step of from 83% to 88% addition of the entire silver nitrate amount, so that the Ir amount became $5.0\times10^{-8}$ mole per mole of the finished silver halide. When the 90% addition of the entire silver nitrate amount was completed, an aqueous solution of potassium iodide (KI) was added with vigorous stirring, so that the KI amount became 0.15 mole % per mole of the finished silver halide. An aqueous solution of $K_2$[Ir(5-methylthiazole)$Cl_5$] was added at the step of from 92% to 95% addition of the entire silver nitrate amount, so that the Ir amount became $5.0\times10^{-7}$ mole per mole of the finished silver halide. Further at the step of from 95% to 98% addition of the entire silver nitrate amount, an aqueous solution of $K_2[Ir(H_2O)Cl_5]$ was added so that the Ir amount became $5.0\times10^{-7}$ mole, per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.35 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and gold thioglucose as a gold sensitizer. After cooling to 40° C., a sensitizing dye C, 1-phenyl-5-mercaptotetrazole, 1-(5-methylureidophenyl)-5-mercaptotetrazole, and potassium bromide were added in an amount of $6\times10^{-4}$ mole, $2\times10^{-4}$ mole, $8\times10^{-4}$ mole, and $7\times10^{-3}$ mole, per mole of silver halide respectively. The resulting emulsion was designated as Emulsion G-1.

(Sensitizing dye C)

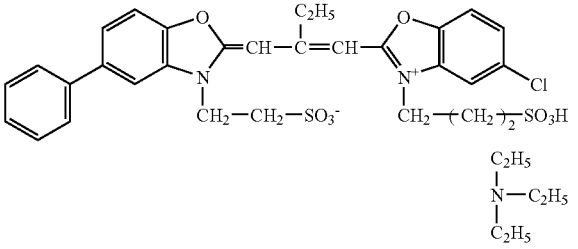

-continued (Sensitizing dye D)

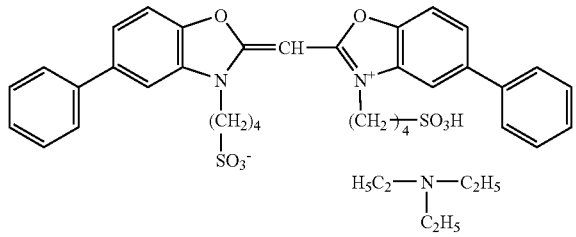

(Sensitizing dye E)

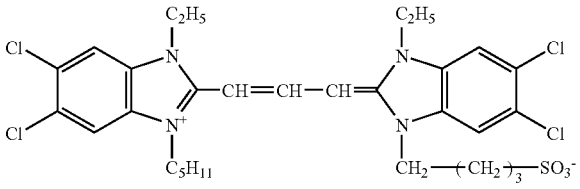

Preparation of Emulsion G-0

An emulsion was prepared in the same manner as in the afore-mentioned preparation of Emulsion G-1, except that $K_2[Ir(5\text{-methylthiazole})Cl_5]$ and $K_2[Ir(H_2O)Cl_5]$ were omitted. The resulting emulsion was designated as Emulsion G-0.

Preparation of Emulsion R-1

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 40° C. An aqueous solution of $K_3[RhBr_6]$ was added at the step of from 60% to 80% addition of the entire silver nitrate amount, so that the Rh amount became $5.8\times10^{-9}$ mole per mole of the finished silver halide. Potassium bromide (KBr) was added to the reaction solution with vigorous stirring at the step of from 80% to 100% addition of the entire silver nitrate amount used in emulsion grain formation, so that the KBr amount became 4.3 mole % per mole of the finished silver halide. An aqueous solution of $K_4[Ru(CN)_6]$ was added at the step of from 80% to 90% addition of the entire silver nitrate amount, so that the Ru amount became $3.0\times10^{-5}$ mole per mole of the finished silver halide. An aqueous solution of $K_2[IrCl_6]$ was added at the step of from 83% to 88% addition of the entire silver nitrate amount, so that the Ir amount became $5.0\times10^{-9}$ mole per mole of the finished silver halide. When the 90% addition of the entire silver nitrate amount was completed, an aqueous solution of potassium iodide (KI) was added with vigorous stirring, so that the KI amount became 0.1 mole % per mole of the finished silver halide. An aqueous solution of $K_2[Ir(5\text{-methylthiazole})Cl_5]$ was added at the step of from 92% to 95% addition of the entire silver nitrate amount, so that the Ir amount became $5.0\times10^{-7}$ mole per mole of the finished silver halide. Further at the step of from 95% to 98% addition of the entire silver nitrate amount, an aqueous solution of $K_2[Ir(H_2O)Cl_5]$ was added so that the Ir amount became $5.0\times10^{-7}$ mole, per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.35 μm and a variation coefficient of 9%.

To the emulsion dissolved at 40° C. was added sodium thiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye H, 1-phenyl-5-mercaptotetrazole, 1-(5-methylureidophenyl)-5-mercaptotetrazole, a compound I and potassium bromide were added in an amount of $2\times10^{-4}$ mole, $2\times10^{-4}$ mole, $8\times10^{-4}$ mole, $1\times10^{-3}$ mole, and $7\times10^{-3}$ mole, per mole of silver halide respectively. The resulting emulsion was designated as Emulsion R-1.

(Sensitizing dye H)

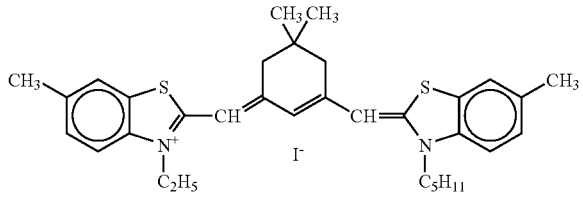

(Compound I)

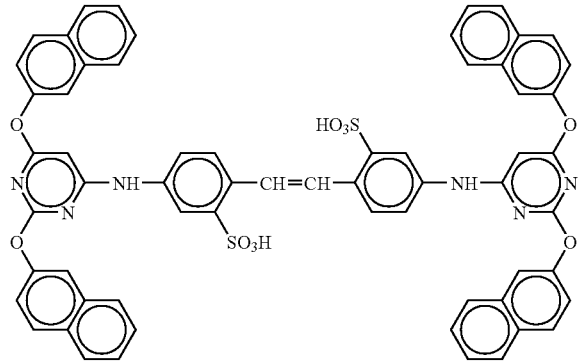

Preparation of Emulsion R-0

An emulsion was prepared in the same manner as in the afore-mentioned preparation of Emulsion R-1, except that $K_2[Ir(5\text{-methylthiazole})Cl_5]$ and $K_2[Ir(H_2O)Cl_5]$ were omitted. The resulting emulsion was designated as Emulsion R-0.

The surface of a paper support laminated on both sides with a polyethylene resin was corona discharged. The support was provided with a gelatin undercoat layer containing sodium dodecylbenzenesulfonate and, further, the first to seventh photographic constituent layers were coated in order on the undercoat layer to prepare silver halide color photographic light-sensitive material samples having the following composition. The coating solution of each photographic constituent layer was prepared as follows.

(Preparation of a Coating Solution for the First Layer)

Into 21 g of a solvent (Solv-1) and 80 ml of ethyl acetate were dissolved 57 g of a yellow coupler (ExY-1), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsion B-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.)

(H-1) Hardener

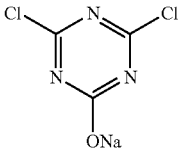

(used in an amount 1.4 mass % per gelatin)

(H-2) Hardener

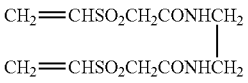

(H-3) Hardener

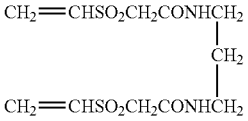

(Ab-1) Antiseptic

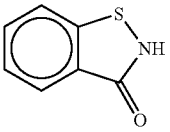

(Ab-2) Antiseptic

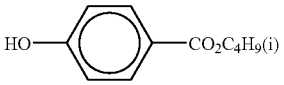

(Ab-3) Antiseptic

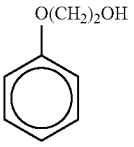

-continued (Ab-4) Antiseptic

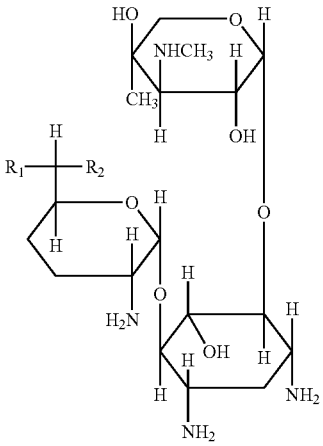

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d Further, to the green-sensitive emulsion layer and the red-sensitive emulsion layer, was added 1-phenyl-5-mercaptotetrazole in amounts of $1.0\times10^{-3}$ mol and $5.9\times10^{-4}$ mol, per mol of the silver halide, respectively.

Further, to the second layer, the fourth layer, and the sixth layer, it was added in amounts of 0.2 mg/m$^2$, 0.2 mg/m$^2$, and 0.6 mg/m$^2$, respectively.

To the red-sensitive emulsion layer, was added a copolymer latex of methacrylic acid and butyl acrylate (1:1 in mass ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added (the coating amount is shown in parentheses).

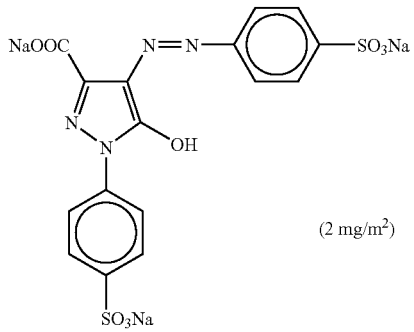

(2 mg/m$^2$)

-continued

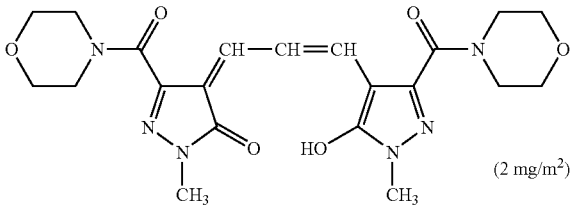

(2 mg/m²)

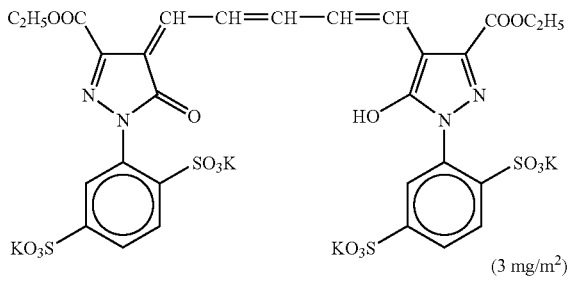

(3 mg/m²)

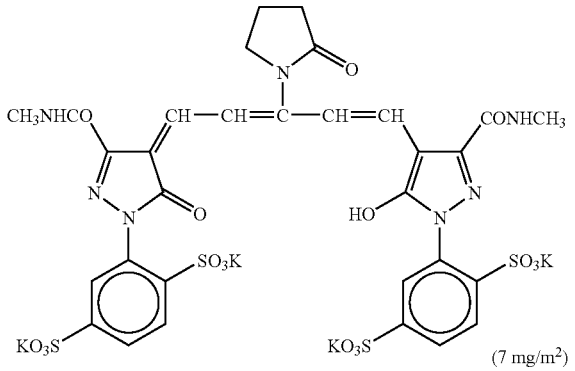

(7 mg/m²)

(Layer Constitution)

The composition of each layer is shown below. The numbers show coating amounts (g/m²). In the case of the silver halide emulsion, the coating amount is in terms of silver.

Support

Polyethylene Resin-laminated Paper

[The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)].

| | |
|---|---|
| First Layer (Blue-Sensitive Emulsion Layer) | |
| Emulsion B-1 | 0.19 |
| Gelatin | 1.00 |
| Yellow coupler (ExY-1) | 0.46 |
| Color-image stabilizer (Cpd-1) | 0.06 |
| Color-image stabilizer (Cpd-2) | 0.03 |
| Color-image stabilizer (Cpd-3) | 0.06 |
| Color-image stabilizer (Cpd-8) | 0.02 |
| Solvent (Solv-1) | 0.17 |
| Second Layer (Color-Mixing Preventing Layer) | |
| Gelatin | 0.50 |
| Color-mixing inhibitor (Cpd-4) | 0.05 |
| Color-image stabilizer (Cpd-5) | 0.01 |
| Color-image stabilizer (Cpd-6) | 0.06 |
| Color-image stabilizer (Cpd-7) | 0.01 |

-continued

| | |
|---|---|
| Solvent (Solv-1) | 0.03 |
| Solvent (Solv-2) | 0.11 |
| Third Layer (Green-Sensitive Emulsion Layer) | |
| Emulsion G-0 | 0.12 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Preventing Layer) | |
| Gelatin | 0.36 |
| Color mixing-inhibitor (Cpd-4) | 0.03 |
| Color-image stabilizer (Cpd-5) | 0.006 |
| Color-image stabilizer (Cpd-6) | 0.05 |
| Color-image stabilizer (Cpd-7) | 0.004 |
| Solvent (Solv-1) | 0.02 |
| Solvent (Solv-2) | 0.08 |
| Fifth Layer (Red-Sensitive Emulsion Layer) | |
| Emulsion R-0 | 0.10 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1-4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

(ExY-1) Yellow coupler A mixture in 70:30 (molar ratio) of

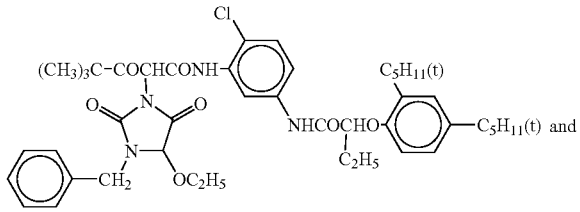

-continued
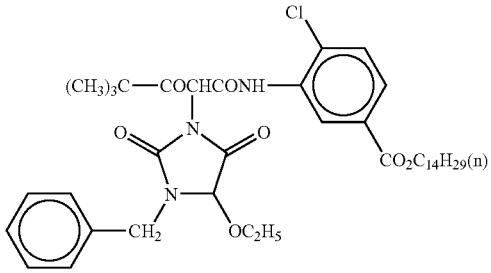
(ExM) Magenta coupler A mixture in 40:40:20 (molar ratio) of
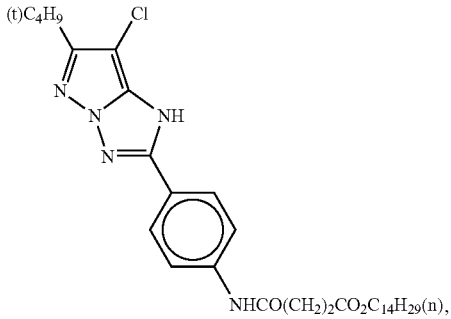
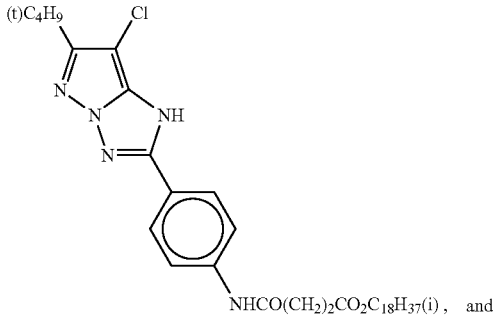
and
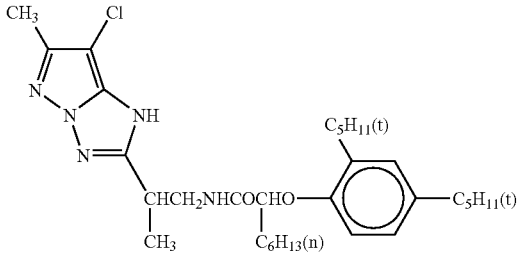
(ExC-2) Cyan coupler
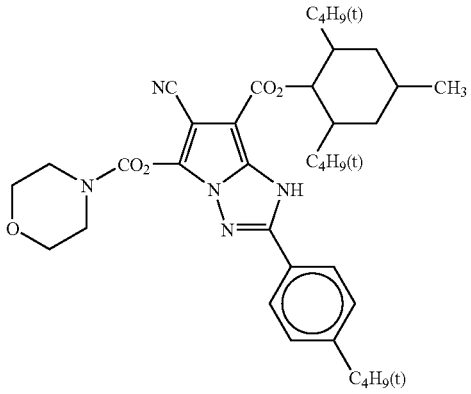
-continued
(ExC-3) Cyan coupler A mixture in 50:25:25 (molar ratio) of
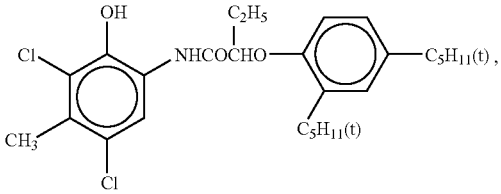
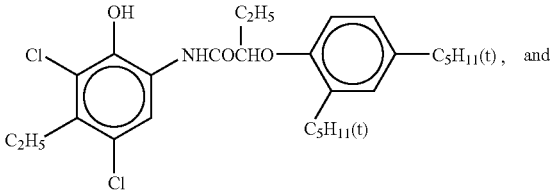
and
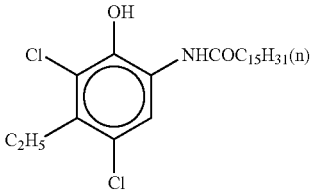
(Cpd-1) Color-image stabilizer
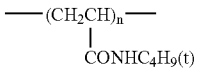
number-average molecular weight 60,000
(Cpd-2) Color-image stabilizer
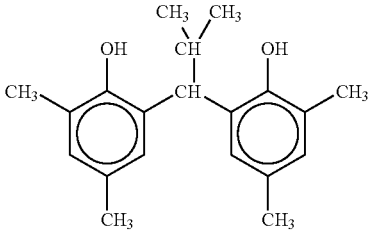
(Cpd-3) Color-image stabilizer
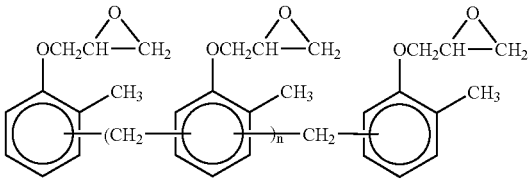
n = 7~8 (average value)
(Cpd-4) Color-mixing inhibitor
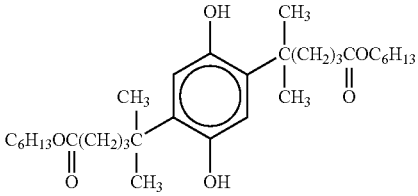
(Cpd-5) Color-image stabilizer
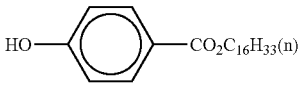

-continued
(Cpd-6) Color-image stabilizer
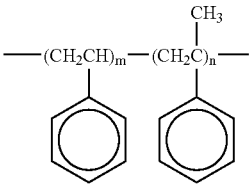
number-average molecular weight 600
m/n = 10/90
(Cpd-7) Color-image stabilizer
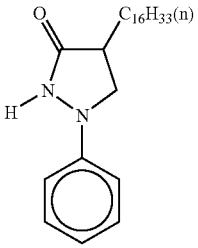
(Cpd-8) Color-image stabilizer
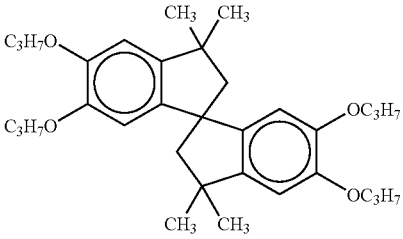
(Cpd-9) Color-image stabilizer
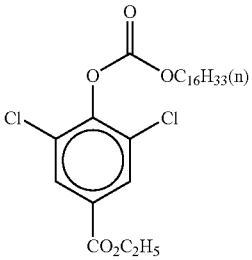
(Cpd-10) Color-image stabilizer
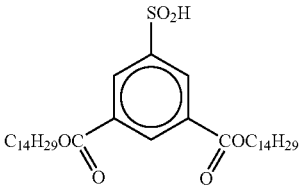
(Cpd-11)
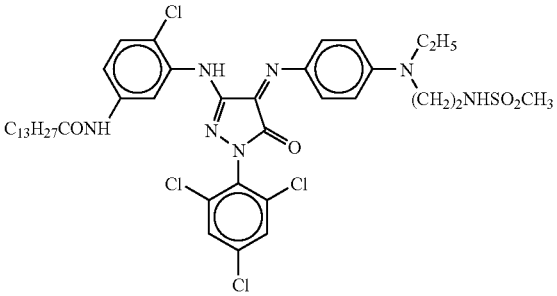
-continued
(Cpd-13) Surface-active agent A mixture in 7:3 (molar ratio) of
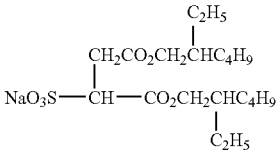
and
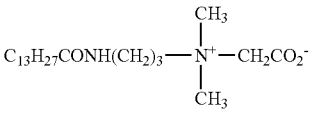
(Cpd-14)
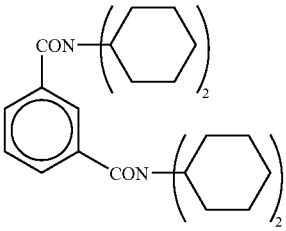
(Cpd-15)
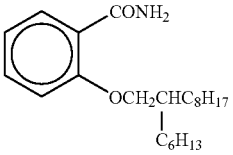
(Cpd-16)
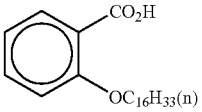
(Cpd-17)
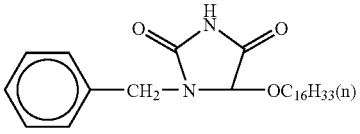
(Cpd-18)
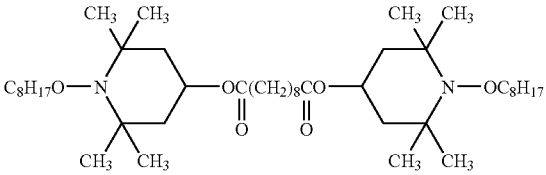
(Cpd-19) Color-mixing inhibitor
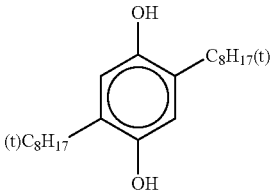
(UV-1) Ultraviolet absorbing agent
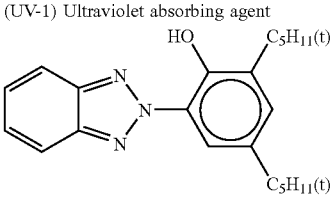

-continued (UV-2) Ultraviolet absorbing agent

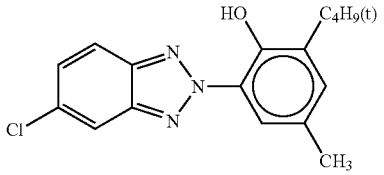

(UV-3) Ultraviolet absorbing agent

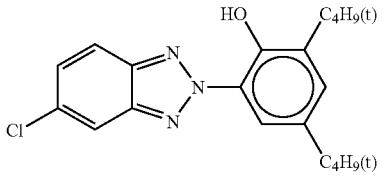

(UV-4) Ultraviolet absorbing agent

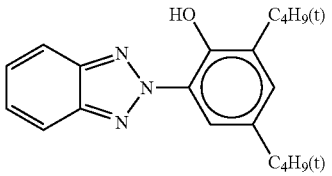

(UV-5) Ultraviolet absorbing agent

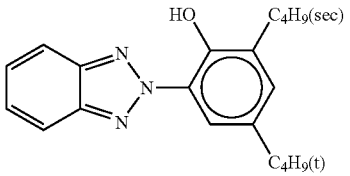

(UV-6) Ultraviolet absorbing agent

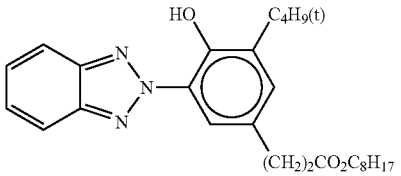

(UV-7) Ultraviolet absorbing agent

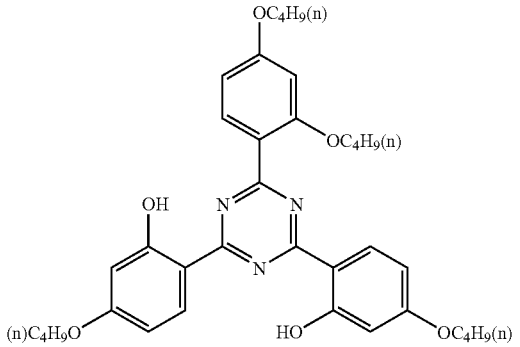

UV-A: A mixture of UV-1/UV-2/UV-3/UV-4 = 4/2/2/3 (mass ratio)
UV-B: A mixture of UV-1/UV-2/UV-3/UV-4/UV-5/UV-6 = 9/3/3/4/5/3 (mass ratio)
UV-C: A mixture of UV-2/UV-3/UV-6/UV-7 = 1/1/1/2 (mass ratio)
(Solv-1)

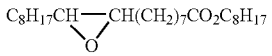

(Solv-2)

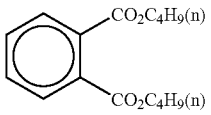

-continued (Solv-3)

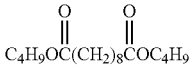

(Solv-4)
$O{=}P(OC_6H_{13}(n))_3$
(Solv-5)

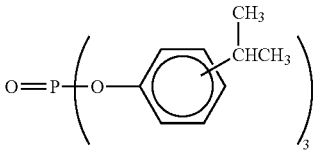

(Solv-7)

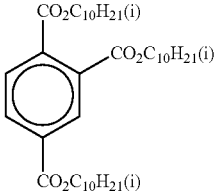

(Solv-8)

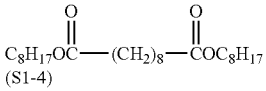

(S1-4)

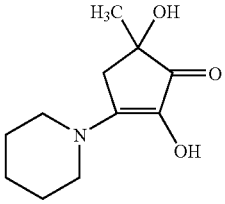

The thus-obtained sample was designated as sample 101. Samples were prepared in the same manner as sample 101 except that the emulsion of the blue-sensitive emulsion layer was replaced with Emulsions B-0, B-2 to B-9 respectively. These samples were designated as samples 100, 102 to 109 respectively. In these samples 104 to 109, the emulsion of the green-sensitive emulsion layer was replaced with Emulsion G-1, and the emulsion of the red-sensitive emulsion layer was replaced with Emulsion R-1. With respect to each sample, the emulsion used in the first layer and its composition, the total hydrophilic binder on the emulsion layer-coating side of a support (in Table, Total coating amount of gelatin) and the total coating amount of silver (in Table, Total coating amount of silver) are shown in Table 2.

For examining photographic performances of these samples thus prepared, the following experiment was performed.

Each coating sample was subjected to gradation exposure for sensitometry using a sensitometer for high luminance exposure (HIE Model manufactured by Yamashita Denso Corporation). High luminance exposure of $10^{-6}$ second was given through a SP-1 filter (trade name) manufactured by Fuji Photo Film Co., Ltd.

Further to examine pressure characteristics of these samples, the following experiment was performed.

A uniform exposure was given to each coating sample so as to become 1.5 of a yellow density, by means of a sensitometer for high luminance exposure (HIE Model manufactured by Yamashita Denso Corporation). High luminance exposure of $10^{-6}$ second was given through an SP-1 filter (trade name) manufactured by Fuji Photo Film Co., Ltd.

The thus-obtained samples were subjected to color-development process with processing A.

The processing steps will be described hereinafter.

Processing A

The foregoing light-sensitive material 101 was made into a roll having a width of 127 mm. The resulting roll was exposed to light image-wise, using a Mini-lab Printer Processor PP1258AR (trade name) manufactured by Fuji Photo Film Co., Ltd., and then processed continuously (running processing) according to the processing steps mentioned below, until the amount of the replenisher to the color developer tank became two times the capacity of the color developer tank. The processing in which the resulting running solution was used, was designated as "processing A".

| Processing Step | Temperature | Time | Replenishing rate* |
|---|---|---|---|
| Color Development | 38.5° C. | 45 sec. | 45 ml |
| Bleach-fixing | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 30 sec. | 121 ml |

*The replenishment rates were amounts per $m^2$ of light-sensitive material to be processed.
**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.
(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 800 ml |
| Dimethylpolysiloxane-series surfactant (Silicone KF351A (trade name) manufactured by Shin-Etsu Chemical Co., Ltd.) | 0.1 g | 0.1 g |
| Tri(isopropanol)amine | 8.8 g | 8.8 g |
| Ethylenediamine tetraacetic acid | 4.0 g | 4.0 g |
| Polyethyleneglycol (Molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent brightening agent (Hakkol FWA-SF (trade name) manufactured by Showa Chemical Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |

-continued

| | [Tank solution] | [Replenisher] |
|---|---|---|
| N-ethyl-N-(β-methanesulfonamidoethyl)-3-methyl-4-amino-4-aminoaniline.3/2 sulfuric acid.1 $H_2O$ | 5.0 g | 15.7 g |
| Potassium carbonate | 26.3 g | 26.3 g |
| Water to make | 1000 ml | 1000 ml |
| pH (at 25° C./adjusted with potassium hydroxide and sulfuric acid) | 10.15 | 12.50 |
| [Bleach - fixing solution] | | |
| Water | 700 ml | 600 ml |
| Ethylenediamine tetraacetic acid iron (III) ammonium | 47.0 g | 94.0 g |
| Ethylenediamine tetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (at 25° C./adjusted with acetic acid and ammonia) | 6.0 | 6.0 |
| [Rinse solution] | | |
| Sodium chlorinated-isocyanurate | 0.02 g | 0.02 g |
| Deionized water (conductivity: 5 μS/cm or less) | 1000 ml | 1000 ml |
| pH | 6.5 | 6.5 |

(Evaluation of High Luminance Graduation)

After giving the afore-mentioned gradation exposure to each of samples 100 to 109, the development processing described above was carried out. The high luminance gradation was evaluated by the logarithm of a ratio of the exposure amount necessary to give a density of 2.0 to the exposure amount necessary to give a density of 1.0. The results thus obtained are shown in Table 2. The smaller value indicates a higher contrast that is preferable.

(Evaluation of Pressure Resistance)

After giving the afore-mentioned uniform exposure to each of samples 100 to 109, the development processing described above was carried out. In 3 seconds after start of the development processing, the sample was scratched by a 0.8 mm diameter of a corundum needle to which 100 g of load was given. A pressure-induced density variation at the scratched portion (in Table, Pressure-induced density variation) is shown in Table 2. Here, the value of pressure-induced density variation was measured by a difference in densities between the scratched portion and the non-scratched portion. A negative value means desensitization. The smaller negative value is, the more excellent in pressure resistance is.

TABLE 2

| | Emulsion of First layer | | | | Total coating | Total | | |
|---|---|---|---|---|---|---|---|---|
| Sample | Kind of Emulsion | Structure of Grain | Silver chloride Content (mole %) | Ir dopant | amount of gelatin ($g/m^2$) | coating amount of silver ($g/m^2$) | Gradation | Pressure-induced density variation |
| 100 | B-0 | — | 100 | $[IrCl_6]^{2-}$ | 5.79 | 0.41 | 0.52 | −0.04 |
| 101 | B-1 | Having a silver bromide-containing phase and a silver iodide-containing phase each formed in the layer state | 96.7 | $[IrCl_6]^{2-}$ | 5.79 | 0.41 | 0.42 | −0.11 |
| 102 | B-2 | Having a silver bromide-containing phase and a silver iodide-containing phase each formed in the layer state | 96.7 | $[IrCl_6]^{2-}$ | 5.79 | 0.41 | 0.43 | −0.12 |
| 103 | B-3 | Having a silver bromide-containing phase and a silver iodide-containing phase each formed in the layer state | 96.7 | $[IrCl_6]^{2-}$ and $[IrBr_6]^{2-}$ | 5.79 | 0.41 | 0.41 | −0.11 |
| 104 | B-4 | Having a silver bromide-containing phase and a silver iodide-containing phase each formed in the layer state | 96.7 | $[IrCl_6]^{2-}$ and $[Ir(H_2O)Cl_5]^{2-}$ | 5.79 | 0.41 | 0.41 | −0.06 |
| 105 | B-5 | Having a silver bromide-containing phase and a silver iodide-containing phase each formed in the layer state | 96.7 | $[IrCl_6]^{2-}$ and [Ir(5-methylthiazole) $Cl_5]^{2-}$ | 5.79 | 0.41 | 0.40 | −0.06 |
| 106 | B-6 | Having a silver bromide-containing phase and a silver iodide-containing phase each formed in the layer state | 96.7 | $[IrCl_6]^{2-}$, $[Ir(H_2O)Cl_5]^{2-}$ and [Ir(5-methylthiazole)$Cl_5]^{2-}$ | 5.79 | 0.41 | 0.39 | −0.05 |
| 107 | B-7 | Having a silver bromide-containing phase and a silver iodide-containing phase each formed in the layer state | 96.7 | $[IrCl_6]^{2-}$ and [Ir(2-chloro-5-fluorthiadiazole) $Cl_5]^{2-}$ | 5.79 | 0.41 | 0.39 | −0.05 |
| 108 | B-8 | Having a silver bromide-containing phase formed in the layer state | 97 | $[IrCl_6]^{2-}$ and [Ir(2-chloro-5-fluorothiadiazole) $Cl_5]^{2-}$ | 5.79 | 0.41 | 0.43 | −0.05 |
| 109 | B-9 | Having a silver iodide-containing phase formed in the layer state | 99.7 | $[IrCl_6]^{2-}$ and [Ir(2-chloro-5-fluorothiadiazole)$Cl_5]^{2-}$ | 5.79 | 0.41 | 0.44 | −0.06 |

As is apparent from the results in Table 2, it is seen that the use of a silver halide emulsion of a 90 mole % or more silver chloride content with a silver bromide-containing phase and/or a silver iodide-containing phase each formed in the layer state considerably increases pressure desensitization (compare sample 100 to samples 101 to 103). In contrast, it is understood that the pressure desensitization is outstandingly improved by the samples having the composition of the present invention (compare samples 101 to 103 to samples 104 to 109). Further, the samples of the present invention each exhibited high sensitivity.

Example 2

A thin-layered sample was prepared in the same manner as sample 101, except that photographic constituent layers were replaced as set forth below.

| First Layer (Blue-Sensitive Emulsion Layer) | |
|---|---|
| Emulsion B-1 | 0.14 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| **Second Layer (Color-Mixing Preventing Layer)** | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| **Third Layer (Green-Sensitive Emulsion Layer)** | |
| Emulsion G-0 | 0.12 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| **Fourth Layer (Color-Mixing Preventing Layer)** | |
| Gelatin | 0.48 |
| Color mixing-inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| **Fifth Layer (Red-Sensitive Emulsion Layer)** | |
| Emulsion R-0 | 0.10 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| **Sixth Layer (Ultraviolet Absorbing Layer)** | |
| Gelatin | 0.32 |
| Ultraviolet absorbing agent (UV-C) | 0.42 |
| Solvent (Solv-7) | 0.08 |

-continued

| Seventh Layer (Protective Layer) | |
|---|---|
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

(ExY-2)

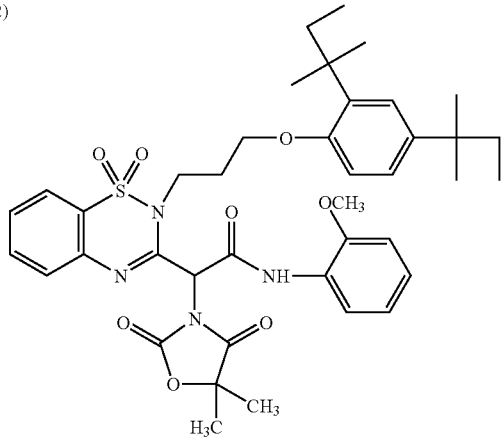

The-thus obtained sample was designated as sample 201. Samples were prepared in the same manner as sample 201 except that the emulsion of the blue-sensitive emulsion layer was replaced with Emulsions B-0, B-2 to B-9 respectively. These samples were designated as samples 200, 202 to 209 respectively. In these samples 204 to 209, the emulsion of the green-sensitive emulsion layer was replaced with Emulsion G-1, and the emulsion of the red-sensitive emulsion layer was replaced with Emulsion R-1. With respect to each sample, the emulsion used in the first layer and its composition, the total hydrophilic binder on the emulsion layer-coating side of a support (in Table, Total coating amount of gelatin) and the total coating amount of silver (in Table, Total coating amount of silver) are shown in Table 3.

To examine high luminance gradation and pressure characteristics of these samples thus prepared, the same experiments as in Example 1 were performed. After exposure, a color developing processing B as set forth below was carried out. The processing steps are shown below.

[Processing B]

The continuous processing was performed using the sample 201 until a color developing replenisher used in the following steps was replenished two times the amount of the color developing tank capacity. The processing using a running solution prepared in the continuous processing was designated as processing B.

| Processing Step | Temperature | Time | Replenishing rate* |
|---|---|---|---|
| Color Development | 45.0° C. | 16 sec. | 45 ml |
| Bleach-fixing | 40.0° C. | 16 sec. | 35 ml |
| Rinse (1)** | 40.0° C. | 8 sec. | — |
| Rinse (2)** | 40.0° C. | 8 sec. | — |
| Rinse (3)** | 40.0° C. | 8 sec. | — |

-continued

| Processing Step | Temperature | Time | Replenishing rate* |
|---|---|---|---|
| Rinse (4)** | 38.0° C. | 8 sec. | 121 ml |
| Dry | 80.0° C. | 16 sec. | |

*The replenishment rates were amounts per $m^2$ of light-sensitive material to be processed.
**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (which may be (4)) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.
(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 600 ml |
| Fluorescent whitening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.5 g |
| 4-Amino-3-methyl-N-ethyl-N-(β-methanesulfonamidoethyl) aniline. 3/2 sulfuric acid.1 $H_2O$ | 10.0 g | 22.0 g |
| Potassium carbonate | 26.3 g | 26.3 g |
| Water to make | 1000 ml | 1000 ml |
| pH (at 25° C./adjusted with potassium hydroxide and sulfuric acid) | 10.35 | 12.6 |
| [Bleach - fixing solution] | | |
| Water | 800 ml | 600 ml |
| Ammonium thiosulfate (750 g/liter) | 107 ml | 214 ml |

-continued

| | [Tank solution] | [Replenisher] |
|---|---|---|
| Succinic acid | 29.5 g | 59.0 g |
| Ethylenediamine tetraacetic acid iron (III) ammonium | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (at 25° C./adjusted with nitric acid and ammonia) | 6.00 | 6.00 |

| Rinse solution | Tank Solution | Replenisher |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

FL-1

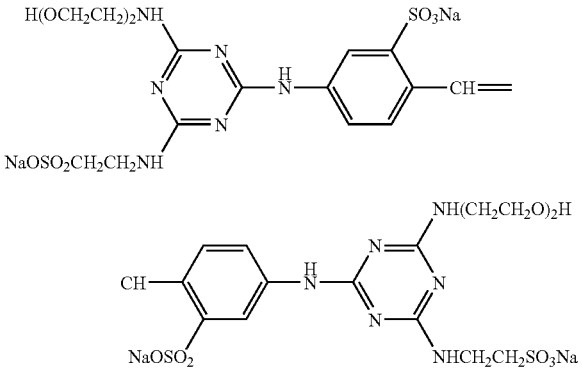

The result of Example 2 evaluated in the same manner as in Example 1 was shown in Table 3.

TABLE 3

| | Emulsion of First layer | | | | Total coating | Total | | |
|---|---|---|---|---|---|---|---|---|
| Sample | Kind of Emulsion | Structure of Grain | Silver chloride Content (mole %) | Ir dopant | amount of gelatin ($g/m^2$) | coating amount of silver ($g/m^2$) | Gradation | Pressure-induced density variation |
| 200 | B-0 | — | 100 | $[IrCl_6]^{2-}$ | 4.17 | 0.36 | 0.55 | −0.05 |
| 201 | B-1 | Having a silver bromide-containing phase and a silver iodide-containing phase each formed in the layer state | 96.7 | $[IrCl_6]^{2-}$ | 4.17 | 0.36 | 0.44 | −0.12 |
| 202 | B-2 | Having a silver bromide-containing phase and a silver iodide-containing | 96.7 | $[IrCl_6]^{2-}$ | 4.17 | 0.36 | 0.44 | −0.12 |

TABLE 3-continued

| Sample | Emulsion of First layer: Kind of Emulsion | Structure of Grain | Silver chloride Content (mole %) | Ir dopant | Total coating amount of gelatin ($g/m^2$) | Total coating amount of silver ($g/m^2$) | Gradation | Pressure-induced density variation |
|---|---|---|---|---|---|---|---|---|
| | | phase each formed in the layer state | | | | | | |
| 203 | B-3 | Having a silver bromide-containing phase and a silver iodide-containing phase each formed in the layer state | 96.7 | $[IrCl_6]^{2-}$ and $[IrBr_6]^{2-}$ | 4.17 | 0.36 | 0.45 | −0.13 |
| 204 | B-4 | Having a silver bromide-containing phase and a silver iodide-containing phase each formed in the layer state | 96.7 | $[IrCl_6]^{2-}$ and $[Ir(H_2O)Cl_5]^{2-}$ | 4.17 | 0.36 | 0.43 | −0.07 |
| 205 | B-5 | Having a silver bromide-containing phase and a silver iodide-containing phase each formed in the layer state | 96.7 | $[IrCl_6]^{2-}$ and [Ir(5-methylthiazole) $Cl_5]^{2-}$ | 4.17 | 0.36 | 0.42 | −0.07 |
| 206 | B-6 | Having a silver bromide-containing phase and a silver iodide-containing phase each formed in the layer state | 96.7 | $[IrCl_6]^{2-}$, $[Ir(H_2O)Cl_5]^{2-}$ and [Ir(5-methylthiazole) $Cl_5]^{2-}$ | 4.17 | 0.36 | 0.42 | −0.06 |
| 207 | B-7 | Having a silver bromide-containing phase and a silver iodide-containing phase each formed in the layer state | 96.7 | $[IrCl_6]^{2-}$ and [Ir(2-chloro-5-fluorothiadiazole) $Cl_5]^{2-}$ | 4.17 | 0.36 | 0.41 | −0.06 |
| 208 | B-8 | Having a silver bromide-containing phase formed in the layer state | 97 | $[IrCl_6]^{2-}$ and [Ir(2-chloro-5-fluorothiadiazole) $Cl_5]^{2-}$ | 4.17 | 0.36 | 0.45 | −0.06 |
| 209 | B-9 | Having a silver iodide-containing phase formed in the layer state | 99.7 | $[IrCl_6]^{2-}$ and [Ir(2-chloro-5-fluorothiadiazole) $Cl_5]^{2-}$ | 4.17 | 0.36 | 0.44 | −0.06 |

As is apparent from the results in Table 3, it is understood that the samples of the present invention each exhibit the same effects as in Example 1 and further have rapid processing suitability.

Example 3

For image formation, each of samples prepared in Examples 1 and 2 was subjected to laser scanning exposure.

For the laser light source, 473 nm taken out by changing the wavelength of a YAG solid state laser (the emitting wavelength: 946 nm) using as an excited light source a semiconductor laser GaAlAs (the emitting wavelength: 808.5 nm), by a SHG crystal of $LiNbO_3$ having an inversion domain structure; and 532 nm taken out by changing the wavelength of a $YVO_4$ solid state laser (the emitting wavelength: 1064 nm) using as an excited light source a semiconductor laser GaALAs (the emitting wavelength: 808.7 nm), by an SHG crystal of $LiNbO_3$ having an inversion domain structure; and AlGaInP (the emitting wavelength: about 680 nm; Type No. LN9R20 manufactured by Matsushita Electric Industrial Co., Ltd.) were used. The scanning exposure was conducted in such a manner that each of three-color laser beams can move in the direction vertical to the scanning direction by the reflection on polygonal mirrors (rotating polyhedrons), and successively scan a sample. The temperature of the semiconductor laser was kept by using a Pertier device to prevent the quantity of light from being changed by temperature. An effective beam diameter was 80 μm. The scanning pitch was 42.3 μm (600 dpi) and the average exposure time per pixel was $1.7\times10^{-7}$ sec.

The samples after exposure were processed according to the color processing B and evaluated as in Examples 1 and 2 and it was confirmed that the same excellent results as in Examples 1 and 2 were also obtained in the image formation by the laser scanning exposure and ultra-rapid processing.

Example 4

The following formulae mentioned in Examples 4 and 5, which have the same reference numbers as in Examples 1 to 3, may represent the different chemical significance from that in Examples 1 to 3. That is, the descriptions of reference letters for Examples 4 and 5 have the precedence to that for Examples 1 to 3.

However, in this matter, the descriptions of reference letters for an Example may have the same chemical significance of that for another Example.

As a rule, however, otherwise a specific notification, the chemical significance of the numeral reference mentioned in an Example confirms that mentioned in the nearest and above Example.

(Preparation of Emulsion B-H)

Using a conventional method in which silver nitrate and sodium chloride were mixed at the same time with stirring to an aqueous gelatin solution, a cubic high silver chloride emulsion having an equivalent-sphere diameter of 0.55 μm and a variation coefficient of 10% was prepared. In this preparation, however, at the step of from 80% to 90% addition of the entire silver nitrate amount, potassium bromide (3 mole % per mole of the finished silver halide) and $K_4[Ru(CN)_6]$ were added. $K_2[IrCl_6]$ was added at the step of from 83% to 88% addition of the entire silver nitrate amount. Potassium iodide (0.3 mole % per mole of the finished silver halide) was added at the step of completing 90% addition of the entire silver nitrate amount. After desalting for the obtained emulsion, gelatin was added to the resulting emulsion for re-dispersion.

To the emulsion, sodium benzene thiosulfonate and sensitizing dye A and sensitizing dye B' were added, and the resulting emulsion was optimally ripened with a colloid dispersion of gold sulfide as a sensitizer. Further, 1-phenyl-5-mercaptotetrazole and 1-(5-methylureidophenyl)-5-mercapto tetrazole were added. The thus-obtained emulsion was referred to as Emulsion B-H.

(Sensitizing dye B')

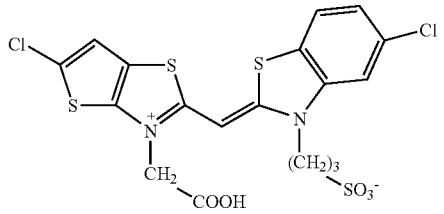

In Example 4 and 5, a sensitizing dye A was same as in Example 1.

(Preparation of Emulsion B-L)

A cubic high silver chloride emulsion having an equivalent-sphere diameter of 0.45 μm and a variation coefficient of 10% was prepared in the same manner as Emulsion B-H, except that only an addition rate of silver nitrate and sodium chloride was changed. The thus-obtained emulsion was referred to as Emulsion B-L.

(Preparation of Emulsion G-201)

Using a conventional method in which silver nitrate and sodium chloride were mixed at the same time with stirring to an aqueous gelatin solution, a cubic high silver chloride emulsion (95.8 mole % of silver chloride) having an equivalent-sphere diameter of 0.40 μm and a variation coefficient of 10% was prepared. In this preparation, however, $K_4[Ru(CN)_6]$ was added at the step of from 80% to 90% addition of the entire silver nitrate amount. Potassium bromide (4 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercapto tetrazole, 1-(5-methylureidophenyl)-5-mercaptotetrazole and potassium bromide were added. The thus-obtained emulsion was referred to as Emulsion G-201.

Here was used the same one as the sensitizing dye C in the above mentioned Example 1.

(Preparation of Emulsion G-202)

An emulsion (95.8 mole % of silver chloride) was prepared in the same manner as Emulsion G-201, except that $K_2[Ir(5\text{-methylthiazole})Cl_5]$ was added at the step of from 92% to 97% addition of the entire silver nitrate amount, so that the Ir amount became $5\times10^{-7}$ mole per mole of the finished silver halide. The thus-obtained emulsion was referred to as Emulsion G-202.

(Preparation of Emulsion G-203)

An emulsion (95.8 mole % of silver chloride) was prepared in the same manner as Emulsion G-201, except that $K_3[RhBr_6]$ was added at the step of from 60% to 80% addition of the entire silver nitrate amount, so that the Rh amount became $1\times10^{-8}$ mole per mole of the finished silver halide. The thus-obtained emulsion was referred to as Emulsion G-203.

(Preparation of Emulsion G-204)

An emulsion (95.8 mole % of silver chloride) was prepared in the same manner as Emulsion G-201, except that $K_3[RhBr_6]$ was added at the step of from 60% to 80% addition of the entire silver nitrate amount, so that the Rh amount became $3\times10^{-8}$ mole per mole of the finished silver halide. The thus-obtained emulsion was referred to as Emulsion G-204.

(Preparation of Emulsion G-205)

A cubic high silver chloride emulsion (silver chloride content: 95.8 mole %) having an equivalent-sphere diameter of 0.35 μm and a variation coefficient of 10% was prepared in the same manner as Emulsion G-201, except that only an addition rate of silver nitrate and sodium chloride was changed. The thus-obtained emulsion was referred to as Emulsion G-205.

(Preparation of Emulsion G-206)

An emulsion (95.8 mole % of silver chloride) was prepared in the same manner as Emulsion G-205, except that $K_2[Ir(5\text{-methylthiazole})Cl_5]$ was added at the step of from 92% to 97% addition of the entire silver nitrate amount, so that the Ir amount became $1\times10^{-6}$ mole per mole of the finished silver halide. The thus-obtained emulsion was referred to as Emulsion G-206.

(Preparation of Emulsion G-207)

An emulsion (95.8 mole % of silver chloride) was prepared in the same manner as Emulsion G-205, except that $K_3[RhBr_6]$ was added at the step of from 60% to 80% addition of the entire silver nitrate amount, so that the Rh amount became $2.7\times10^{-8}$ mole per mole of the finished silver halide. The thus-obtained emulsion was referred to as Emulsion G-207.

(Preparation of Emulsion G-208)

A cubic high silver chloride emulsion (95.8 mole % of silver chloride) having an equivalent-sphere diameter of 0.29 μm and a variation coefficient of 10% was prepared in the same manner as Emulsion G-201, except that only an addition rate of silver nitrate and sodium chloride was changed. The thus-obtained emulsion was referred to as Emulsion G-208.

(Preparation of Emulsion G-209)

An emulsion (95.8 mole % of silver chloride) was prepared in the same manner as Emulsion G-208, except that $K_3[RhBr_6]$ was added at the step of from 60% to 80% addition of the entire silver nitrate amount, so that the Rh amount became $8\times10^{-9}$ mole per mole of the finished silver halide. The thus-obtained emulsion was referred to as Emulsion G-209.

(Preparation of Emulsion R-H)

Using a conventional method in which silver nitrate and sodium chloride were mixed at the same time with stirring to an aqueous gelatin solution, a cubic high silver chloride emulsion having an equivalent-sphere diameter of 0.35 μm and a variation coefficient of 10% was prepared. In this preparation, however, $K_4[Ru(CN)_6]$ was added at the step of from 80% to 90% addition of the entire silver nitrate amount. Potassium bromide (4.3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.15 mole % per mole of the finished silver halide) was added at the step of completing 90% addition of the entire silver nitrate amount. After desalting for the resulting emulsion, gelatin was added to the resulting emulsion for re-dispersion.

To the emulsion, sodium benzene thiosulfonate was added, and the resulting emulsion was optimally ripened with a sodium thiosulfate penta-hydrate as a sulfur sensitizer and bis(1,4,5-trimethyl-1,2,4-triazolium-3-thiolate)aurate (I) tetrafluoroborate as a gold sensitizer. Further, a sensitizing dye H, 1-phenyl-5-mercapto tetrazole, 1-(5-methylureidophenyl)-5-mercaptotetrazole, a compound I and potassium bromide were added. The thus-obtained emulsion was referred to as Emulsion R-H.

Here were used the same ones as the sensitizing dye H and the compound I in the above mentioned Example 1.

(Preparation of Emulsion R-L)

A cubic high silver chloride emulsion having an equivalent-sphere diameter of 0.28 μm and a variation coefficient of 10% was prepared in the same manner as Emulsion R-H, except that only an addition rate of silver nitrate and sodium chloride was changed. The thus-obtained emulsion was referred to as Emulsion R-L.

The following samples were prepared to examine each of the sensitivities in Emulsions G-201 to G-209.

The surface of a paper support laminated on both sides with a polyethylene resin was corona discharged. The support was provided with a gelatin undercoat layer containing sodium dodecylbenzenesulfonate and, further, the first to seventh photographic constituent layers were coated in order on the undercoat layer to prepare silver halide color photographic light-sensitive material samples having the following composition. The coating solution of each photographic constituent layer was prepared as follows.

(Preparation of a Coating Solution for the First Layer)

Into 21 g of a solvent (Solv-1) and 80 ml of ethyl acetate were dissolved 57 g of a yellow coupler (ExY-1), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions B-H and B-L were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

Here were used the same ones as the hardener (H-1), (H-2) and (H-3) and antiseptics Ab-1, Ab-2, Ab-3 and Ab-4 in the above mentioned Example 1 respectively.

Further, to the green-sensitive emulsion layer and the red-sensitive emulsion layer was added 1-phenyl-5-mercaptotetrazole in amounts of $1.0\times10^{-3}$ mol and $5.9\times10^{-4}$ mol, per mol of the silver halide, respectively.

Further, to the second layer, the fourth layer, and the sixth layer, it was added in amounts of 0.2 mg/m$^2$, 0.2 mg/m$^2$, and 0.6 mg/m$^2$ respectively.

To the red-sensitive emulsion layer, was added a copolymer latex of methacrylic acid and butyl acrylate (1:1 in mass ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the dyes were added.

Here were used the same as the dyes to neutralize irradiation in the above-mentioned Example 1 respectively. The coating amount for the dyes to neutralize irradiation were same as in Example 1 respectively.

(Layer Constitution)

The composition of each layer is shown below. The numbers show coating amounts (g/m$^2$). In the case of the silver halide emulsion, the coating amount is in terms of silver.

Support

Polyethylene Resin-laminated Paper

[The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)].

| First Layer (Blue-Sensitive Emulsion Layer) | |
|---|---|
| Emulsion B-H | 0.09 |
| Emulsion B-L | 0.10 |
| Gelatin | 1.00 |
| Yellow coupler (ExY-1) | 0.46 |
| Color-image stabilizer (Cpd-1) | 0.06 |
| Color-image stabilizer (Cpd-2) | 0.03 |
| Color-image stabilizer (Cpd-3) | 0.06 |

-continued

| | |
|---|---|
| Color-image stabilizer (Cpd-8) | 0.02 |
| Solvent (Solv-1) | 0.17 |
| Second Layer (Color-Mixing Preventing Layer) | |
| Gelatin | 0.50 |
| Color-mixing inhibitor (Cpd-4) | 0.05 |
| Color-image stabilizer (Cpd-5) | 0.01 |
| Color-image stabilizer (Cpd-6) | 0.06 |
| Color-image stabilizer (Cpd-7) | 0.01 |
| Solvent (Solv-1) | 0.03 |
| Solvent (Solv-2) | 0.11 |
| Third Layer (Green-Sensitive Emulsion Layer) | |
| Emulsion G-1 | 0.12 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Preventing Layer) | |
| Gelatin | 0.36 |
| Color mixing-inhibitor (Cpd-4) | 0.03 |
| Color-image stabilizer (Cpd-5) | 0.006 |
| Color-image stabilizer (Cpd-6) | 0.05 |
| Color-image stabilizer (Cpd-7) | 0.004 |
| Solvent (Solv-1) | 0.02 |
| Solvent (Solv-2) | 0.08 |
| Fifth Layer (Red-Sensitive Emulsion Layer) | |
| Emulsion R-H | 0.05 |
| Emulsion R-L | 0.05 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |

-continued

| | |
|---|---|
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1-4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

Here were used the yellow coupler ExY-1, the magenta coupler ExM, the cyan couplers ExC-2 and ExC-3, the color-image stabilizers Cpd-1 to Cpd-3, the color-mixing inhibitor Cpd-4, the color-image stabilizers Cpd-5 to Cpd-11, the surface active agent Cpd-13, the color-image stabilizers Cpd-14 to Cpd-18, the color-mixing Cpd-19, the ultraviolet absorbing agents UV-1 to UV-7, UV-A, UV-B and UV-C, the solvents Solv-1 to Solv-5, Solv-7 and Solv-8, and the compound S1-4 in the above-mentioned example 1 respectively.

The thus-obtained sample was referred to as sample 2101. In order to examine sensitivities of Emulsion G-201 to Emulsion G-209, samples were prepared in the same manner as sample 2101, except that the emulsion of the green-sensitive emulsion layer was replaced respectively as shown in Table 4. The thus-obtained samples were referred to as samples 2102 to 2109.

TABLE 4

| | Green-sensitive emulsion | | | | | |
|---|---|---|---|---|---|---|
| | | | Metal complex corresponding to formula (I) or (II) | | | |
| Sample | Kind | Equivalent-sphere diameter (μm) | Kind | In terms of silver halide (mol/mol Ag) | In terms of 1 grain (relative value) | Sensitivity (log E) |
| 2101 | G-201 | 0.40 | — | — | — | 0 |
| 2102 | G-202 | 0.40 | $IrCl_5$(5-Me-thia) | $5.0 \times 10^{-7}$ | 1* | −0.03 |
| 2103 | G-203 | 0.40 | $RhBr_6$ | $1.0 \times 10^{-8}$ | 1** | −0.11 |
| 2104 | G-204 | 0.40 | $RhBr_6$ | $3.0 \times 10^{-8}$ | 3** | −0.30 |
| 2105 | G-205 | 0.35 | — | — | — | −0.12 |
| 2106 | G-206 | 0.35 | $IrCl_5$(5-Me-thia) | $1.0 \times 10^{-6}$ | 1.3* | −0.18 |
| 2107 | G-207 | 0.35 | $RhBr_6$ | $2.7 \times 10^{-8}$ | 1.8** | −0.31 |
| 2108 | G-208 | 0.29 | — | — | — | −0.27 |
| 2109 | G-209 | 0.29 | $RhBr_6$ | $8.0 \times 10^{-9}$ | 0.3** | −0.32 |

$IrCl_5$(5-Me-thia); $K_2$[Ir(5-methylthiazole)$Cl_5$]
$RhBr_6$; $K_3$[$RhBr_6$]
*A relative value as an average content of [$IrCl_5$(5-Me-thia)] per 1 grain of Emulsion G-202 being 1
**A relative value as an average content of [$RhBr_6$] per 1 grain of Emulsion G-203 being 1
Sensitivity (log E); A relative value to the sensitivity of Emulsion G-1

Each coating sample was stood under the 10° C. 30% RH atmosphere and it was subjected to high illuminance gradation exposure of $10^{-4}$ sec. for sensitometry through a green filter using a sensitometer for high luminance exposure (HIE Model manufactured by Yamashita Denso Corporation). After 6 seconds of exposure, the exposed sample was subjected to a color development processing as shown below.

Processing steps are shown below.

[Processing]

The continuous processing was performed until a color developing replenisher used in the following steps was replenished to be half of the amount of the color developing tank capacity.

| Processing Step | Temperature | Time | Replenishing rate* |
|---|---|---|---|
| Color Development | 45.0° C. | 16 sec. | 45 ml |
| Bleach-fixing | 40.0° C. | 16 sec. | 35 ml |
| Rinse (1) | 40.0° C. | 8 sec. | — |
| Rinse (2) | 40.0° C. | 8 sec. | — |
| Rinse (3)** | 40.0° C. | 8 sec. | — |
| Rinse (4)** | 38.0° C. | 8 sec. | 121 ml |
| Dry | 80.0° C. | 16 sec. | |

*The replenishment rates were amounts per $m^2$ of light-sensitive material to be processed.
**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.
(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 600 ml |
| Fluorescent whitening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.5 g | 0.5 g |
| Disodium-N,N-bis(sulfonatoethyl) hydroxylamine | 8.5 g | 14.5 g |
| 4-Amino-3-methyl-N-ethyl-N-(β-methanesulfonamidoethyl) aniline•3/2 sulfuric acid•1 $H_2O$ | 10.0 g | 22.0 g |
| Potassium carbonate | 26.3 g | 26.3 g |
| Water to make | 1000 ml | 1000 ml |
| pH (at 25° C./adjusted with potassium hydroxide and sulfuric acid) | 10.35 | 12.6 |
| [Bleach - fixing solution] | | |
| Water | 800 ml | 800 ml |
| Ammonium thiosulfate (750 g/liter) | 107 ml | 214 ml |
| Succinic acid | 29.5 g | 59.0 g |

-continued

| | [Tank solution] | [Replenisher] |
|---|---|---|
| Ethylenediamine tetraacetic acid iron (III) ammonium | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (at 25° C./adjusted with nitric acid and ammonia) | 6.00 | 6.00 |
| [Rinse solution] | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Here was used the same one as the same fluorescent whitening agent FL-1 in the above-mentioned Example 2.

After processing, a magenta coloring density of each sample was measured to obtain a characteristic curve owing to a high illuminance exposure of $10^{-4}$ sec. Sensitivity of each emulsion was read from logarithm of the exposure amount E required to give the magenta coloring density of 0.7 for each sample. The sensitivity was evaluated by a relative value to sensitivity of Emulsion G-201 and denoted as log E. In other words, the more negative value is, the lower sensitivity is. The results are shown in Table 4. For each size, a difference in sensitivity between Emulsion G-201, Emulsion G-205, or Emulsion G-208 containing no metal complex corresponding to formula (I) or (II) and the same emulsion except for containing the metal complex is a degree of desensitization due to the metal complex.

Further to examine photographic performances obtained by a mixture comprising 2 kinds of emulsions selected from among Emulsion G-201 to Emulsion G-209, samples were prepared in the same manner except that the emulsion of the green-sensitive emulsion layer was replaced as compared with sample 2101 respectively with a mixture comprising 2 kinds of emulsions as shown in Table 5. These samples were referred to as samples 2110 to 2123. A coating amount of 2 kind emulsions in terms of silver was 0.06 ($g/m^2$) respectively.

In order to examine photographic performances obtained by these samples, the following experiment was carried out.

Each coating sample was stood under the 20° C. 30% RH atmosphere and it was subjected to high illuminance gradation exposure of $10^{-6}$ sec. for sensitometry through a gray filter using a sensitometer for high luminance exposure (HIE Model manufactured by Yamashita Denso Corporation). After 6 seconds or 60 seconds of exposure, the exposed sample was subjected to a color development as shown above for 16 sec. Similarly, after 6 seconds or 60 seconds of exposure, the exposed sample was color developed as mentioned above except that the color developing time was changed to 26 sec. Further, the same color developing solution as mentioned above except for 0.5 ml of bleach-fixing solution per liter of the developing solution being mixed therein was prepared. Similarly, after 6 seconds or 60 seconds of exposure, the exposed sample was color developed with the thus-prepared color developing solution for 16 sec.

After processing, a magenta coloring reflection density of each sample was measured to obtain a characteristic curve owing to a high illuminance exposure of $10^{-6}$ sec.

The following gradation γ was measured from (D-0.3)/0.5 by reading a coloring density D on the characteristic curve, said coloring density D being a density corresponding to an exposure amount by 0.5 in terms of log E more than the exposure amount required to give a coloring density of 0.3. For each sample, γ in the case where an ordinary color development for 16 seconds was carried out after 6 seconds of exposure was measured. In case of a digital exposure by a laser scanning exposure, the γ value is preferably in the range of 2.2±0.2, and a difference between the measured γ value and the optimum central gradation of 2.2 was denoted as Δγ1 (deviation from the optimum gradation) respectively. A positive value means a higher contrast than the optimum central gradation, whereas a negative value means a lower contrast. An absolute value is preferably within 0.2.

For each sample, γ in the case where an ordinary color development for 16 seconds was carried out after 6 seconds of exposure, and γ in the case where an ordinary color development for 26 seconds was carried out after 6 seconds of exposure were read. A difference between these measured γ values was denoted as Δγ2. A positive value means that a contrast becomes higher with a prolonged developing time. It denotes that as the absolute value becomes smaller, a gradation preferably becomes stable even to a fluctuation in processing factors. Further for each sample, γ in the case where an ordinary color development for 16 seconds was carried out after 6 seconds of exposure, and γ in the case where color development for 16 seconds was carried out after 6 seconds of exposure with a developing solution in which a bleach-fixing solution was mixed were read. A difference between these measured γ values was denoted as Δγ3. A positive value means that a contrast becomes higher by the mixed bleach-fixing solution. It denotes that as the absolute value becomes smaller, a gradation preferably becomes stable even to a fluctuation in processing factors such as mixing of bleach-fixing solution.

The obtained results are shown in Table 5.

TABLE 5

| | Green-sensitive emulsion | | | | |
|---|---|---|---|---|---|
| Sample | Kind | Metal complex | Δγ1 | Δγ2 | Δγ3 |
| 2101 | G-201 | — | 0.23 | 0.13 | 0.38 |
| 2102 | G-202 | $IrCl_5$(5-Me-thia) | 0.24 | 0.12 | 0.32 |
| 2103 | G-203 | $RhBr_6$ | 0.28 | 0.12 | 0.22 |
| 2104 | G-204 | $RhBr_6$ | 0.32 | 0.10 | 0.20 |
| 2105 | G-205 | — | 0.22 | 0.15 | 0.40 |
| 2106 | G-206 | $IrCl_5$(5-Me-thia) | 0.22 | 0.14 | 0.38 |
| 2107 | G-207 | $RhBr_6$ | 0.27 | 0.11 | 0.31 |
| 2108 | G-208 | — | 0.21 | 0.18 | 0.45 |
| 2109 | G-209 | $RhBr_6$ | 0.23 | 0.17 | 0.42 |
| 2110 | G-201/G-205 | — | 0.11 | 0.21 | 0.45 |
| 2111 | G-201/G-208 | — | −0.19 | 0.23 | 0.48 |
| 2112 | G-205/G-208 | — | −0.05 | 0.24 | 0.46 |
| 2113 | G-201/G-206 | $IrCl_5$(5-Me-thia) | 0.11 | 0.08 | 0.16 |
| 2114 | G-202/G-206 | $IrCl_5$(5-Me-thia) | 0.12 | 0.06 | 0.11 |
| 2115 | G-201/G-203 | $RhBr_6$ | 0.04 | 0.04 | 0.11 |
| 2116 | G-201/G-204 | $RhBr_6$ | −0.04 | 0.03 | 0.06 |
| 2117 | G-201/G-207 | $RhBr_6$ | −0.14 | 0.04 | 0.09 |
| 2118 | G-203/G-204 | $RhBr_6$ | 0.07 | 0.03 | 0.04 |
| 2119 | G-203/G-207 | $RhBr_6$ | −0.02 | 0.03 | 0.06 |
| 2120 | G-203/G-208 | $RhBr_6$ | −0.07 | 0.09 | 0.18 |
| 2121 | G-203/G-209 | $RhBr_6$ | −0.04 | 0.08 | 0.16 |
| 2122 | G-205/G-204 | $RhBr_6$ | 0.05 | 0.03 | 0.09 |
| 2123 | G-205/G-207 | $RhBr_6$ | −0.04 | 0.04 | 0.12 |

$IrCl_5$(5-Me-thia); $K_2$ [Ir(5-methylthiazole)$Cl_5$]
$RhBr_6$; $K_3$ [$RhBr_6$]

It is seen from Table 5 that a gradation suitable for digital exposure by a laser scanning exposure can be obtained by mixing the emulsions according to the present invention, and further the gradation can be also kept stably even though the processing factors fluctuate. Particularly, the afore-mentioned effects become remarkable, if the metal complex, with a high content, according to the present invention is incorporated in the lower sensitivity emulsion. However, when color development was started for each sample after 60 seconds of exposure, no fluctuation in gradation was measured even though such was not shown in Table 5.

Example 5

(Preparation of Emulsion B-201)

Using a conventional method in which silver nitrate and sodium chloride were mixed at the same time with stirring to an aqueous gelatin solution, a cubic high silver chloride emulsion having an equivalent-sphere diameter of 0.53 μm and a variation coefficient of 10% was prepared. In this preparation, however, at the step of from 80% to 90% addition of the entire silver nitrate amount, potassium bromide (2 mole % per mole of the finished silver halide) and $K_4[Ru(CN)_6]$ were added. $K_2[IrCl_6]$ was added at the step of from 83% to 88% addition of the entire silver nitrate amount. Potassium iodide (0.23 mole % per mole of the finished silver halide) was added at the step of completing 90% addition of the entire silver nitrate amount. After desalting for the obtained emulsion, gelatin was added to the resulting emulsion for re-dispersion.

To the emulsion, sodium benzene thiosulfonate and sensitizing dye A and sensitizing dye B' were added, and the resulting emulsion was optimally ripened with a colloid dispersion of gold thioglucose as a sensitizer. Further, 1-phenyl-5-mercaptotetrazole and 1-(5-methylureidophenyl)-5-mercapto tetrazole were added. The thus-obtained emulsion was referred to as Emulsion B-201.

(Preparation of Emulsion B-202)

Using a conventional method in which silver nitrate and sodium chloride were mixed at the same time with stirring to an aqueous gelatin solution, a cubic high silver chloride emulsion having an equivalent-sphere diameter of 0.43 μm and a variation coefficient of 10% was prepared. In this preparation, however, at the step of from 80% to 90% addition of the entire silver nitrate amount, potassium bromide (2 mole % per mole of the finished silver halide) and $K_4[Ru(CN)_6]$ were added. $K_2[IrCl_6]$ was added at the step of from 83% to 88% addition of the entire silver nitrate amount. Potassium iodide (0.23 mole % per mole of the finished silver halide) was added at the step of completing 90% addition of the entire silver nitrate amount. After desalting for the obtained emulsion, gelatin was added to the resulting emulsion for re-dispersion.

To the emulsion, sodium benzene thiosulfonate and sensitizing dye A and sensitizing dye B' were added, and the resulting emulsion was optimally ripened with a colloid dispersion of gold thioglucose as a sensitizer. Further, 1-phenyl-5-mercaptotetrazole and 1-(5-methylureidophenyl)-5-mercapto tetrazole were added. The thus-obtained emulsion was referred to as Emulsion B-202.

(Preparation of Emulsion B-203)

Using a conventional method in which silver nitrate and sodium chloride were mixed at the same time with stirring to an aqueous gelatin solution, a cubic high silver chloride emulsion (96.69 mole % of silver chloride) having an equivalent-sphere diameter of 0.55 μm and a variation coefficient of 10% was prepared. In this preparation, however, $Cs_2[OSCl_5(NO)]$ was added at the step of from 50% to 80% addition of the entire silver nitrate amount, so that the amount of Os became $2\times10^{-9}$ mole per mole of the finished silver halide. Potassium bromide (3 mole % per mole of the finished silver halide) and $K_4[Ru(CN)_6]$ were added at the step of from 80% to 90% addition of the entire silver nitrate amount. $K_2[IrCl_6]$ was added at the step of from 83% to 88% addition of the entire silver nitrate amount. Potassium iodide (0.31 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $2\times10^{-7}$ mole per mole of silver halide. After desalting, gelatin was added to the resulting emulsion for re-dispersion.

To the emulsion, sodium benzene thiosulfonate as well as sensitizing dye A and sensitizing dye B' were added, and the resulting emulsion was optimally ripened with gold thioglucose as a sensitizer. Further, 1-phenyl-5-mercaptotetrazole and 1-(5-methylureidophenyl)-5-mercaptotetrazole were added. The thus-obtained emulsion was referred to as Emulsion B-203.

(Preparation of Emulsion B-204)

Using a conventional method in which silver nitrate and sodium chloride were mixed at the same time with stirring to an aqueous gelatin solution, a cubic high silver chloride emulsion (96.69 mole % of silver chloride) having an equivalent-sphere diameter of 0.45 μm and a variation coefficient of 10% was prepared. In this preparation, however, $Cs_2[OSCl_5(NO)]$ was added at the step of from 50% to 80% addition of the entire silver nitrate amount, so that the amount of Os became $5\times10^{-9}$ mole per mole of the finished silver halide. Potassium bromide (3 mole % per mole of the finished silver halide) and $K_4[Ru(CN)_6]$ were added at the step of from 80% to 90% addition of the entire silver nitrate amount. $K_2[IrCl_6]$ was added at the step of from 83% to 88% addition of the entire silver nitrate amount. Potassium iodide (0.31 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $5\times10^{-7}$ mole per mole of silver halide. After desalting, gelatin was added to the resulting emulsion for re-dispersion.

To the emulsion, sodium benzene thiosulfonate as well as sensitizing dye A and sensitizing dye B' were added, and the resulting emulsion was optimally ripened with gold thioglucose as a sensitizer. Further, 1-phenyl-5-mercaptotetrazole and 1-(5-methylureidophenyl)-5-mercaptotetrazole were added. The thus-obtained emulsion was referred to as Emulsion B-204.

(Preparation of Emulsion G-211)

Using a conventional method in which silver nitrate and sodium chloride were mixed at the same time with stirring to an aqueous gelatin solution, a cubic high silver chloride emulsion having an equivalent-sphere diameter of 0.38 μm and a variation coefficient of 10% was prepared. In this preparation, however, $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.15 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercapto tetrazole, 1-(5-methylureidophenyl)-5-mercaptotetrazole and potassium bromide were added. The thus-obtained emulsion was referred to as Emulsion G-211.

(Preparation of Emulsion G-212)

Using a conventional method in which silver nitrate and sodium chloride were mixed at the same time with stirring to an aqueous gelatin solution, a cubic high silver chloride emulsion having an equivalent-sphere diameter of 0.28 μm and a variation coefficient of 10% was prepared. In this preparation, however, $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.15 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercapto tetrazole, 1-(5-methylureidophenyl)-5-mercaptotetrazole and potassium bromide were added. The thus-obtained emulsion was referred to as Emulsion G-212.

(Preparation of Emulsion B-213)

Using a conventional method in which silver nitrate and sodium chloride were mixed at the same time with stirring to an aqueous gelatin solution, a cubic high silver chloride emulsion (96.8 mole % of silver chloride) having an equivalent-sphere diameter of 0.39 μm and a variation coefficient of 10% was prepared. In this preparation, however, $Cs_2[OsCl_5(NO)]$ was added at the step of from 50% to 80% addition of the entire silver nitrate amount, so that the amount of Os became $2\times10^{-8}$ mole per mole of the finished silver halide. $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver amount. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $4\times10^{-7}$ mole per mole of the finished silver halide. After desalting, gelatin was added to the resulting emulsion for re-dispersion.

To the emulsion, sodium benzene thiosulfonate was added, and the resulting emulsion was optimally ripened with a colloid dispersion of gold sulfite as a sensitizer.

Further, a sensitizing dye C, 1-phenyl-5-mercaptotetrazole, 1-(5-methylureidophenyl)-5-mercaptotetrazole, and potassium bromide were added. The thus-obtained emulsion was referred to as Emulsion G-213.

(Preparation of Emulsion G-214)

Using a conventional method in which silver nitrate and sodium chloride were mixed at the same time with stirring to an aqueous gelatin solution, a cubic high silver chloride emulsion (96.8 mole % of silver chloride) having an equivalent-sphere diameter of 0.29 μm and a variation coefficient of 10% was prepared. In this preparation, however, $Cs_2[OsCl_5(NO)]$ was added at the step of from 50% to 80% addition of the entire silver nitrate amount, so that the amount of Os became $6\times10^{-8}$ mole per mole of the finished silver halide. $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver amount. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $1.2\times10^{-6}$ mole per mole of the finished silver halide. After desalting, gelatin was added to the resulting emulsion for re-dispersion.

To the emulsion, sodium benzene thiosulfonate was added, and the resulting emulsion was optimally ripened with a colloid dispersion of gold sulfite as a sensitizer. Further, as a sensitizing dye C, 1-phenyl-5-mercaptotetrazole, 1-(5-methylureidophenyl)-5-mercaptotetrazole, and 1-(5-methylureidophenyl)-5-mercaptotetrazole were added. The thus-obtained emulsion was referred to as Emulsion G-214.

(Preparation of Emulsion R-201)

Using a conventional method in which silver nitrate and sodium chloride were mixed at the same time with stirring to an aqueous gelatin solution, a cubic high silver chloride emulsion having an equivalent-sphere diameter of 0.38 μm and a variation coefficient of 10% was prepared. In this preparation, however, $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.15 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a sodium thiosulfate pentahydrate as a sulfer sensitizer and bis(1,4,5-trimethyl-1,2,4-triazolium-3-thiolate)aurate (I) tetrafluoroborate as a gold sensitizer. Further, a sensitizing dye H, 1-phenyl-5-mercapto tetrazole, 1-(5-methylureidophenyl)-5-mercaptotetrazole, Compound I and potassium bromide were added. The thus-obtained emulsion was referred to as Emulsion R-201.

(Preparation of Emulsion R-202)

Using a conventional method in which silver nitrate and sodium chloride were mixed at the same time with stirring to an aqueous gelatin solution, a cubic high silver chloride emulsion having an equivalent-sphere diameter of 0.28 μm and a variation coefficient of 10% was prepared. In this preparation, however, $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.15 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a sodium thiosulfate pentahydrate as a sulfer sensitizer and bis(1,4,5-trimethyl-1,2,4-triazolium-3-thiolate)aurate (I) tetrafluoroborate as a gold sensitizer. Further, a sensitizing dye H, 1-phenyl-5-mercapto tetrazole, 1-(5-methylureidophenyl)-5-mercaptotetrazole, Compound I and potassium bromide were added. The thus-obtained emulsion was referred to as Emulsion R-202.

(Preparation of Emulsion R-203)

Using a conventional method in which silver nitrate and sodium chloride were mixed at the same time with stirring to an aqueous gelatin solution, a cubic high silver chloride emulsion (96.8 mole % of silver chloride) having an equivalent-sphere diameter of 0.39 μm and a variation coefficient of 10% was prepared. In this preparation, however, $Cs_2[OsCl_5(NO)]$ was added at the step of from 50% to 80% addition of the entire silver nitrate amount, so that the amount of Os became $2\times10^{-8}$ mole per mole of the finished silver halide. $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $4\times10^{-7}$ mole per mole of the finished silver halide. After desalting, gelatin was added to the resulting emulsion for re-dispersion.

To the emulsion, sodium benzene thiosulfonate was added, and the resulting emulsion was optimally ripened with sodium thiosulfate pentahydrate as a sulfur sensitizer and bis (1,4,5-trimethyl-1,2,4-triazoliume-3-thiolato)aurate (I).tetrafluoroborate as a gold sensitizer. Further, sensitizing dye H, 1-phenyl-5-mercaptotetrazole, 1-(5-methylureidophenyl)-5-mercaptotetrazole, Compound I and potassium bromide were added. The thus-obtained emulsion was referred to as Emulsion R-203.

(Preparation of Emulsion R-204)

Using a conventional method in which silver nitrate and sodium chloride were mixed at the same time with stirring to an aqueous gelatin solution, a cubic high silver chloride emulsion (96.8 mole % of silver chloride) having an equivalent-sphere diameter of 0.29 μm and a variation coefficient of 10% was prepared. In this preparation, however, $Cs_2[OSCl_5(NO)]$ was added at the step of from 50% to 80% addition of the entire silver nitrate amount, so that the amount of Os became $6\times10^{-8}$ mole per mole of the finished silver halide. $K_4[Ru(CN)_6]$ was added at the step of from 80% to 90% addition of the entire silver nitrate amount. Potassium bromide (3 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount, so that the amount of Ir became $1.2\times10^{-6}$ mole per mole of the finished silver halide. After desalting, gelatin was added to the resulting emulsion for re-dispersion.

To the emulsion, sodium benzene thiosulfonate was added, and the resulting emulsion was optimally ripened with sodium thiosulfate pentahydrate as a sulfur sensitizer and bis (1,4,5-trimethyl-1,2,4-triazoliume-3-thiolato)aurate (I).tetrafluoroborate as a gold sensitizer. Further, sensitizing dye H, 1-phenyl-5-mercaptotetrazole, 1-(5-methylureidophenyl)-5-mercaptotetrazole, Compound I and potassium bromide were added. The thus-obtained emulsion was referred to as Emulsion R-204.

The following samples were prepared with the above emulsions.

| | |
|---|---|
| First Layer (Blue-Sensitive Emulsion Layer) | |
| Emulsion B-201 | 0.07 |
| Emulsion B-202 | 0.07 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color-Mixing Preventing Layer) | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| Emulsion G-211 | 0.06 |
| Emulsion G-212 | 0.06 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-mixing inhibitor (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Preventing Layer) | |
| Gelatin | 0.48 |
| Color mixing-inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-201 | 0.05 |
| Emulsion R-202 | 0.05 |

-continued

| | |
|---|---|
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solv-ent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface active agent (Cpd-13) | 0.01 |
| Polydimethylsiloxane | 0.01 |
| Silicon dioxide | 0.003 |

Here was used the same one as the yellow coupler ExY-2 in the above-mentioned Example 2.

The thus-prepared sample was referred to as sample 2201. A sample was also prepared in the same manner as sample 2201 except that Emulsions B-201, B-202, G-211, G-212, R-201 and R-202 were replaced with Emulsions B-203, B-204, G-213, G-214, R-203 and R-204 respectively. The thus-prepared sample was referred to as sample 2202.

To examine photographic characteristics of these samples by laser scanning exposure, the following experiment was performed.

Three types of semiconductor laser were used as laser light sources, i.e., a blue semiconductor laser having a wavelength of about 440 nm (reported by NICHIA Corporation in the 48th symposium of Applied physics-relating Federation (March 2001)), a green (semiconductor) laser having a wavelength of about 530 nm taken out by changing the wavelength of a semiconductor laser (the emitting wavelength: about 1060 nm) by an SHG crystal of a wave guide-like $LiNbO_3$ having an inverting domain structure, and a red semiconductor laser having a wavelength of about 650 nm (HITACHI Type No. HL 6501 MG).

Each of three-color laser beams was made to be able to transfer vertically to scanning direction by a polygonal mirror and successively scanning exposure the sample. For restraining the fluctuation of light amount due to the change of temperature, the temperature of a semiconductor laser was maintained constant using Peltier element. The effective beam diameter was 80 μm, the scanning pitch was 42.3 μm (600 dpi) and the average exposure time per one pixel was $1.7\times10^{-7}$ second. According to this exposure process, a gradation exposure for sensitometry developing gray color was given under 20° C., 30% RH.

After exposure, each exposed sample was subjected to the same color development processing as in Example 4 except that said color development starts at the head of the sample after about 3 seconds of exposure, while it starts at the end of the sample after about 9 seconds of exposure.

Reflection yellow, magenta and cyan coloring densities of the processed sample were measured, and $\Delta\gamma1$, $\Delta\gamma2$ and $\Delta\gamma3$ were read in the same manner as in Example 4. The results are shown in Table 6.

TABLE 6

| Sample | Color-developing layer | Δγ1 | Δγ2 | Δγ3 |
|---|---|---|---|---|
| 2201 | Yellow | −0.04 | 0.11 | 0.18 |
| | Magenta | −0.12 | 0.13 | 0.38 |
| | Cyan | −0.14 | 0.09 | 0.44 |
| 2202 | Yellow | 0.09 | 0.03 | 0.06 |
| | Magenta | 0.02 | 0.04 | 0.04 |
| | Cyan | −0.04 | 0.02 | 0.05 |

As is apparent from the results from Table 6, both samples 2201 and 2202 provide gradation in an optimal range suitable for a laser scanning exposure. However, as compared to sample 2201, the gradation of sample 2202 of the present invention is kept more stably no matter with fluctuation in the processing factors, thereby a stable print quality being obtained.

Example 6

The following formulae mentioned in Examples 6 and 7, which have the same reference numbers as in Examples 1 to 5, may represent the different chemical significance from that in Examples 1 to 5. That is, the descriptions of reference letters for Examples 6 and 7 have the precedence to that for Examples 1 to 5.

However, in this matter, the descriptions of reference letters for an Example may have the same chemical significance of that for another Example.

Preparation of Emulsion B-301

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 50° C. An aqueous solution of $K_3[RhBr_6]$ was added at the step of from 60% to 80% addition of the entire silver nitrate amount, so that the Rh amount became $4.1\times10^{-9}$ mole per mole of the finished silver halide. KBr was added at the step of from 80% to 90% addition of the entire silver nitrate amount, so that the (Br) amount became 3 mole % per mole of the finished silver halide. An aqueous solution of $K_4[Fe(CN)_6]$ was added at the step of from 80% to 90% addition of the entire silver nitrate amount, so that the Fe amount became $3\times10^{-5}$ mole per mole of the finished silver halide. An aqueous solution of $K_2[Ir(5\text{-methylthiazole})Cl_5]$ was added at the step of from 92% to 98% addition of the entire silver nitrate amount, so that the Ir amount became $8.0\times10^{-7}$ mole per mole of the finished silver halide. An aqueous solution of KI was added and mixed with vigorous stirring at the step of completion of 90% addition of the entire silver nitrate amount, so that the I amount became 0.3 mole % per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.51 μm and a variation coefficient of 9%.

To the emulsion dissolved at 40° C. was added sodium benzenethiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B', 1-phenyl-5-mercaptotetrazole, 1-(5-methylureidophenyl)-5-mercaptotetrazole, and potassium bromide were added in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of silver halide respectively. The resulting emulsion was referred to as Emulsion B-301 (silver chloride content; 96.7 mole %).

Here were used the same ones as the sensitizing dye A in the above-mentioned EXAMPLE 1 and the sensitizing dye B in the above-mentioned EXAMPLE 4.

Preparation of Emulsion B-302

An emulsion was prepared in the same manner as in the afore-mentioned preparation of Emulsion B-301, except that the temperature and the addition rate at the time when an aqueous solution containing 2.12 mole of silver nitrate and an aqueous solution containing 2.2 mole of sodium chloride were added and mixed were changed to the conditions whereby the emulsion of cubic silver iodobromochloride grains having an equivalent-sphere diameter of 0.42 μm and a variation coefficient of 9% was obtained. The resulting emulsion was referred to as Emulsion B-302 (silver chloride content; 96.7 mole %).

Preparation of Emulsion B-303

An emulsion was prepared in the same manner as in the afore-mentioned preparation of Emulsion B-301, except that the temperature and the addition rate at the time when an aqueous solution containing 2.12 mole of silver nitrate and an aqueous solution containing 2.2 mole of sodium chloride were added and mixed were changed to the conditions whereby the emulsion of cubic silver iodobromochloride grains having an equivalent-sphere diameter of 0.35 μm and a variation coefficient of 9% was obtained.

The amounts to be added of the sulfur sensitizer, the gold sensitizer, the sensitizing dye(s) and the mercapto compound were changed so that the amount per the unit surface thereof could be same as that of Emulsion B-301.

The resulting emulsion was referred to as Emulsion B-303 (silver chloride content; 96.7 mole %).

Preparation of Emulsion G-301

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were added and mixed to the above-mentioned aqueous gelatin solution at the same time with vigorous stirring at 40° C. An aqueous solution of $K_3[RhBr_6]$ was added at the step of from 60% to 80% addition of the entire silver nitrate amount, so that the Rh amount became $5.8\times10^{-9}$ mole per mole of the finished silver halide. KBr was added with vigorous stirring at the step of from 80% to 100% addition of the entire silver nitrate amount, so that the (Br) amount became 4.3 mole % per mole of the finished silver halide. An aqueous solution of $K_4[Fe(CN)_6]$ was added at the step of from 80% to 90% addition of the entire silver nitrate amount, so that the Fe amount became $3.0\times10^{-5}$ mole per mole of the finished silver halide. An aqueous solution of $K_2[IrCl_6]$ was added at the step of from 83% to 88% addition of the entire silver nitrate amount, so that the Ir amount became $5.0\times10^{-8}$ mole per mole of the finished silver halide. An aqueous solution of KI was added and mixed with vigorous stirring at the step of completion of 90% addition of the entire silver nitrate amount, so that the I amount became 0.15 mole % per mole of the finished silver halide. An aqueous solution of $K_2[Ir$ (5-methylthiazole)$Cl_5$] was added at the step of from 92% to 95% addition of the entire silver nitrate amount, so that the Ir amount became $5.0\times10^{-7}$ mole per mole of the finished silver halide. An aqueous solution of $K_2[Ir(H_2O)Cl_5]$ was added at the step of from 95% to 98% addition of the entire silver nitrate amount, so that the Ir amount became $5.0\times10^{-7}$ mole per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.35 μm and a variation coefficient of 9%.

To the emulsion dissolved at 40° C. was added sodium benzenethiosulfonate in an amount of $2\times10^{-5}$ mole per mole of silver halide, and the resulting emulsion was optimally ripened at 60° C. with sodium thiosulfate penta-hydrate as a sulfur sensitizer and gold thioglucose as a gold sensitizer. After cooling to 40° C., a sensitizing dye C, 1-phenyl-5-mercapto tetrazole, 1-(5-methylureidophenyl)-5-mercaptotetrazole, and potassium bromide were added in an amount of $6\times10^{-4}$ mole, $2\times10^{-4}$ mole, $8\times10^{-4}$ mole, and $7\times10^{-3}$ mole, per mole of silver halide respectively. The resulting emulsion was referred to as Emulsion G-301 (silver chloride content; 95.54 mole %).

Here was used the same one as the sensitizing dye C in the above mentioned EXAMPLE 1.

Preparation of Emulsion R-301

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were added and mixed to the above-mentioned aqueous gelatin solution at the same time with vigorous stirring at 40° C. An aqueous solution of $K_3[RhBr_6]$ was added at the step of from 60% to 80% addition of the entire silver nitrate amount, so that the Rh amount became $5.8\times10^{-9}$ mole per mole of the finished silver halide. KBr was added with vigorous stirring at the step of from 80% to 100% addition of the entire silver nitrate amount, so that the Br amount became 4.3 mole % per mole of the finished silver halide. An aqueous solution of $K_4[Fe(CN)_6]$ was added at the step of from 80% to 90% addition of the entire silver nitrate amount, so that the Fe amount became $3.0\times10^{-5}$ mole per mole of the finished silver halide. An aqueous solution of $K_2[IrCl_6]$ was added at the step of from 83% to 88% addition of the entire silver nitrate amount, so that the Ir amount became $5.0\times10^{-9}$ mole per mole of the finished silver halide. An aqueous solution of KI was added and mixed with vigorous stirring at the step of completion of 90% addition of the entire silver nitrate amount, so that the I amount became 0.1 mole % per mole of the finished silver halide. An aqueous solution of $K_2[Ir$(5-methylthiazole)$Cl_5$] was added at the step of from 92% to 95% addition of the entire silver nitrate amount, so that the Ir amount became $5.0\times10^{-7}$ mole per mole of the finished silver halide. An aqueous solution of $K_2[Ir(H_2O)Cl_5]$ was added at the step of from 95% to 98% addition of the entire silver nitrate amount, so that the Ir amount became $5.0\times10^{-7}$ mole per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.35 μm and a variation coefficient of 9%.

To the emulsion dissolved at 40° C. was added sodium benzenethiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolate)aurate (I) tetrafluoroborate as a gold sensitizer. After cooling to 40° C., a sensitizing dye H, 1-phenyl-5-mercapto tetrazole, 1-(5-methylureidophenyl)-5-mercaptotetrazole, Compound I and potassium bromide were added in an amount of $2\times10^{-4}$ mole, $2\times10^{-4}$ mole, $8\times10^{-4}$ mole, $1\times10^{-3}$ mole, and $7\times10^{-3}$ mole, per mole of silver halide respectively. The resulting emulsion was referred to as Emulsion R-301 (silver chloride content; 95.6 mole %).

Here were used the same ones as the sensitizing dye H and Compound I in the above mentioned EXAMPLE 1 respectively.

The surface of a paper support laminated on both sides with a polyethylene resin was corona discharged. The support was provided with a gelatin undercoat layer containing sodium dodecylbenzenesulfonate and, further, the first to seventh photographic constituent layers were coated in order on the undercoat layer to prepare silver halide color photographic light-sensitive material samples having the following composition. The coating solution of each photographic constituent layer was prepared as follows.

(Preparation of a Coating Solution for the First Layer)

Into 21 g of a solvent (Solv-1) and 80 ml of ethyl acetate were dissolved 57 g of a yellow coupler (ExY-1), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsion B-301 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

Here were used the same ones as the hardener H-1 to H-3 and antiseptics Ab-1 to Ab-4 in the above mentioned EXAMPLE 1 respectively.

Further, to the green-sensitive emulsion layer and the red-sensitive emulsion layer, was added 1-phenyl-5-mercaptotetrazole in amounts of $1.0\times10^{-3}$ mol and $5.9\times10^{-4}$ mol, per mol of the silver halide, respectively.

Further, to the second layer, the fourth layer, and the sixth layer, it was added in amounts of 0.2 mg/m$^2$, 0.2 mg/m$^2$, and 0.6 mg/m$^2$, respectively.

To the red-sensitive emulsion layer, was added a copolymer latex of methacrylic acid and butyl acrylate (1:1 in mass ratio; average molecular weight, 200,000 to 400,000) in an amount of 0.05 g/m$^2$, Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the dyes were added.

Here were used the same ones as the dyes to neutralize irradiation in the above-mentioned EXAMPLE 1 respectively. The coating amount for the dyes to neutralize irradiation were same as in Example 1 respectively.

(Layer Constitution)

The composition of each layer is shown below. The numbers show coating amounts ($g/m^2$). In the case of the silver halide emulsion, the coating amount is in terms of silver.

Support

Polyethylene Resin-laminated Paper

[The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)].

| | |
|---|---|
| First Layer (Blue-Sensitive Emulsion Layer) | |
| Emulsion B-301 | 0.24 |
| Gelatin | 1.27 |
| Yellow coupler (ExY-1) | 0.46 |
| Color-image stabilizer (Cpd-1) | 0.06 |
| Color-image stabilizer (Cpd-2) | 0.03 |
| Color-image stabilizer (Cpd-3) | 0.06 |
| Color-image stabilizer (Cpd-8) | 0.02 |
| Solvent (Solv-1) | 0.17 |
| Second Layer (Color-Mixing Preventing Layer) | |
| Gelatin | 1.14 |
| Color-mixing inhibitor (Cpd-4) | 0.10 |
| Color-image stabilizer (Cpd-5) | 0.01 |
| Color-image stabilizer (Cpd-6) | 0.06 |
| Color-image stabilizer (Cpd-7) | 0.01 |
| Solvent (Solv-1) | 0.03 |
| Solvent (Solv-2) | 0.11 |
| Third Layer (Green-Sensitive Emulsion Layer) | |
| Emulsion G-301 | 0.15 |
| Gelatin | 1.21 |
| Magenta coupler (ExM) | 0.15 |
| Ultraviolet absorbing agent (UV-A) | 0.14 |
| Color-image stabilizer (Cpd-2) | 0.02 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Preventing Layer) | |
| Gelatin | 0.71 |
| Color mixing-inhibitor (Cpd-4) | 0.06 |
| Color-image stabilizer (Cpd-5) | 0.006 |
| Color-image stabilizer (Cpd-6) | 0.05 |
| Color-image stabilizer (Cpd-7) | 0.004 |
| Solvent (Solv-1) | 0.02 |
| Solvent (Solv-2) | 0.08 |
| Fifth Layer (Red-Sensitive Emulsion Layer) | |
| Emulsion R-301 | 0.15 |
| Gelatin | 0.95 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |

-continued

| | |
|---|---|
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.34 |
| Ultraviolet absorbing agent (UV-B) | 0.45 |
| Compound (S1-4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface active agent (Cpd-13) | 0.01 |

Here were used the same ones as the yellow coupler ExY-1, the magenta coupler ExM, the cyan couplers ExC-2 and ExC-3, the color-image stabilizers Cpd-1 to Cpd-3, the color-mixing inhibitor Cpd-4, the color-image stabilizers Cpd-5 to Cpd-11, the surface active agent Cpd-13, the color-image stabilizers Cpd-14 to Cpd-18, the color-mixing inhibitor Cpd-19, the ultraviolet absorbing agents UV-1 to UV-7, UV-A, UV-B and UV-C, the solvents Solv-1 to Solv-5, Solv-7 and Solv-8, and the compound S1-4 in the above mentioned EXAMPLE 1 respectively.

The thus-obtained sample was referred to as sample 3101. A thin-layered sample 3102 was prepared as said sample 3101, except for changing the coating amounts as follows. The Emulsion B-301 and gelatin of the first layer were changed to yield coverage of 0.19 and 1.00, respectively. The gelatin and color-mixing inhibitor (Cpd-4) of the second layer were changed to yield coverage of 0.50 and 0.05, respectively. The Emulsion G-301 and gelatin of the third layer were changed to yield coverage of 0.12 and 1.36, respectively. The gelatin and color-mixing inhibitor (Cpd-4) of the forth layer were changed to yield coverage of 0.36 and 0.03, respectively. The Emulsion R-301 and gelatin of the fifth layer were changed to yield coverage of 0.10 and 1.11, respectively. The gelatin of the sixth layer was changed to yield coverage of 0.46.

A thin-layered sample 3103 was prepared in the same manner as sample 3101, except that photographic constituent layers were replaced as set forth below.

| | |
|---|---|
| First Layer (Blue Sensitive Emulsion Layer) | |
| Emulsion B-301 | 0.14 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color-Mixing Preventing Layer) | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |

-continued

| | |
|---|---|
| Third Layer (Green Sensitive Emulsion Layer) | |
| Emulsion G-301 | 0.12 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Preventing Layer) | |
| Gelatin | 0.48 |
| Color mixing-inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-301 | 0.10 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

Here was used the same one as the yellow coupler ExY-2 in the above mentioned EXAMPLE 2.

Samples 3104 to 3106 were prepared in the same manner as samples 3101 to 3103, except for replacing Emulsion B-301 of the first layer with Emulsion B-302. Likewise, samples 3107 to 3109 were prepared in the same manner as samples 3101 to 3103, except for replacing Emulsion B-301 of the first layer with Emulsion B-303. The total coating amount of silver, the total coating amount of gelatin and the average grain size of samples 3101 to 3109 are shown in Table 7.

TABLE 7

| Sample No. | Total coating amount of gelatin ($g/m^2$) | Total coating amount of silver ($g/m^2$) | Average grain size (μm) | Film thickness (μm) | Swollen film thickness (μm) |
|---|---|---|---|---|---|
| 3101 | 0.54 | 6.62 | 0.42 | 8.4 | 14.3 |
| 3102 | 0.41 | 5.34 | 0.42 | 7.4 | 12.5 |
| 3103 | 0.36 | 4.17 | 0.41 | 7.0 | 11.8 |
| 3104 | 0.54 | 6.62 | 0.38 | 8.4 | 14.3 |
| 3105 | 0.41 | 5.34 | 0.38 | 7.4 | 12.5 |
| 3106 | 0.36 | 4.17 | 0.38 | 7.0 | 11.8 |
| 3107 | 0.54 | 6.62 | 0.35 | 8.4 | 14.3 |
| 3108 | 0.41 | 5.34 | 0.35 | 7.4 | 12.5 |
| 3109 | 0.36 | 4.17 | 0.35 | 7.0 | 11.8 |

To examine photographic performances of these samples, the following experiment was performed.

Each coating sample was left under the 10° C. 30% RH atmosphere and subjected to high luminance gradation exposure of $10^{-6}$ second through a continuous wedge for sensitometry using a sensitometer for high luminance exposure (HIE Model (trade name) manufactured by Yamashita Denso Corporation). In this case, a spectral distribution of each coating sample was corrected in combination with a color-compensating filter, such that the processed sample should have visually a gradation of gray coloration. After 30 minutes of exposure, the exposed samples were subjected to color development processing according to the processing process A' and the processing process B' shown below. Each sample was also kept under the 10° C. 30% RH atmosphere for a period of time from end of exposure to start of processing.

The processing steps will be described hereinafter.

Processing A'

The foregoing light-sensitive material 3101 was made into a roll having a width of 127 mm. The resulting roll was exposed to light image-wise, using a Mini-lab Printer Processor PP1258AR (trade name) manufactured by Fuji Photo Film Co., Ltd., and then processed continuously (running processing) according to the processing steps mentioned below, until the amount of the replenisher to the color developer tank became two times the capacity of the color developer tank. The processing in which the resulting running solution was used, was designated as "processing A'".

| Processing Step | Temperature | Time | Replenishing rate* |
|---|---|---|---|
| Color Development | 38.5° C. | 45 sec. | 45 ml |
| Bleach-fixing | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 30 sec. | 121 ml |

*The replenishment rates were amounts per $m^2$ of light-sensitive material to be processed.

**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.

(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 800 ml |
| Dimethylpolysiloxane-series surfactant (Silicone KF351A (trade name) manufactured by Shin-Etsu Chemical Co., Ltd.) | 0.1 g | 0.1 g |
| Tri(isopropanol)amine | 8.8 g | 8.8 g |
| Ethylenediamine tetraacetic acid | 4.0 g | 4.0 g |
| Polyethyleneglycol (Molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent brightening agent (Hakkol FWA-SF (trade name) manufactured by Showa Chemical Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-amino-4-aminoaniline•3/2 sulfuric acid•1 $H_2O$ | 5.0 g | 15.7 g |
| Potassium carbonate | 26.3 g | 26.3 g |
| Water to make | 1000 ml | 1000 ml |
| pH (at 25° C./adjusted with potassium hydroxide and sulfuric acid) | 10.15 | 12.50 |
| [Bleach - fixing solution] | | |
| Water | 700 ml | 600 ml |
| Ethylenediamine tetraacetic acid iron (III) ammonium | 47.0 g | 94.0 g |
| Ethylenediaminete traacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (at 25° C./adjusted with acetic acid and ammonia) | 6.0 | 6.0 |
| [Rinse solution] | | |
| Sodium chlorinated-isocyanurate | 0.02 g | 0.02 g |
| Deionized water (conductivity: 5 μS/cm or less) | 1000 ml | 1000 ml |
| pH | 6.5 | 6.5 |

[Processing Process B']

The continuous processing was respectively performed using the samples 3101 to 3103 until a color developing replenisher used in the following steps was replenished two times the amount of the color developing tank capacity according to the processing process A'. For evaluation, samples 3101, 3104 and 3107 were processed with a running solution obtained by the continuous processing of the sample 3101. Likewise, the samples 3102, 3105 and 3108 were processed with a running solution obtained by the continuous processing of the sample 3102. Also, the samples 3103, 3106 and 3109 were processed with a running solution obtained by the continuous processing of the sample 3103.

| Processing Step | Temperature | Time | Replenishing rate* |
|---|---|---|---|
| Color Development | 45.0° C. | 16 sec. | 45 ml |
| Bleach-fixing | 40.0° C. | 16 sec. | 35 ml |
| Rinse (1) | 40.0° C. | 8 sec. | — |
| Rinse (2) | 40.0° C. | 8 sec. | — |
| Rinse (3)** | 40.0° C. | 8 sec. | — |
| Rinse (4) | 38.0° C. | 8 sec. | 121 ml |

*The replenishment rates were amounts per $m^2$ of light-sensitive material to be processed.

**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.

(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 600 ml |
| Fluorescent whitening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.5 g | 0.50 g |
| Disodium-N,N-bis(sulfonatoethyl) hydroxylamine | 8.5 g | 14.5 g |
| 4-Amino-3-methyl-N-ethyl-N-(β-methanesulfonamidoethyl) aniline•3/2 sulfuric acid•1 $H_2O$ | 10.0 g | 22.0 g |
| Potassium carbonate | 26.3 g | 26.3 g |
| Water to make | 1000 ml | 1000 ml |
| pH (at 25° C./adjusted with potassium hydroxide and sulfuric acid) | 10.35 | 12.6 |
| [Bleach - fixing solution] | | |
| Water | 800 ml | 800 ml |
| Ammonium thiosulfate (750 g/liter) | 107 ml | 214 ml |
| Succinic acid | 29.5 g | 59.0 g |
| Ethylenediaminete traacetic acid iron (III) ammonium | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (at 25° C./adjusted with nitric acid and ammonia) | 6.00 | 6.00 |
| [Rinse solution] | | |
| Sodium chlorinated-isocyanurate | 0.02 g | 0.02 g |
| Deionized water (conductivity: 5 μS/cm or less) | 1000 ml | 1000 ml |
| pH | 6.5 | 6.5 |

Here was used the same one as the fluorescent whitening agent FL-1 in the above mentioned EXAMPLE 2.

After processing, the yellow density, the magenta density and the cyan density of the each sample were each measured to obtain a characteristic curve. In order to evaluate the suitability for rapid processing, the maximum coloring density (Dmax) of the yellow-coloring layer that is the lowest layer and therefore has a disadvantage to the development progressiveness was measured for comparison of samples. Accordingly the characteristic curve relating a yellow density is described hereinafter. The results are shown in Table 8. The numerical values in Table 8 are indicated by a relative value, assuming that when processed according to the processing process A', the value obtained by the sample 3101 is 100.

TABLE 8

| Sample No. | Dmax according to Processing process A | Dmax according to Processing process B |
|---|---|---|
| 3101 | 100 | 80 |
| 3102 | 98 | 98 |
| 3103 | 100 | 100 |
| 3104 | 102 | 85 |
| 3105 | 101 | 101 |
| 3106 | 103 | 103 |
| 3107 | 103 | 88 |
| 3108 | 103 | 103 |
| 3109 | 105 | 105 |

As is apparent from the results in Table 8, comparison samples 3101, 3104 and 3107 fail to achieve the primary maximum coloring density in the processing process B' that is a rapid processing to be aimed by the present invention. In contrast, it is seen that the samples of the present invention each give substantially the same or higher maximum coloring density as compared to the comparison samples in the processing process A', and further the samples of the present invention do not suffer from a drop in the maximum coloring density in the processing process B', and therefore they are excellent in rapid processability.

Example 7

Preparation of Emulsion B-321

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were simultaneously added and mixed with vigorous stirring to the above-mentioned aqueous gelatin solution at 40° C. KBr was added with vigorous stirring at the step of from 80% to 100% addition of the entire silver nitrate amount, so that the Br amount became 4.3 mole % per mole of the finished silver halide. An aqueous solution of $K_4[Ru(CN)_6]$ was added at the step of from 80% to 90% addition of the entire silver nitrate amount, so that the Ru amount became $3\times10^{-5}$ mole per mole of the finished silver halide. An aqueous solution of $K_2[IrCl_6]$ was added at the step of from 83% to 88% addition of the entire silver nitrate amount, so that the Ir amount became $5.0\times10^{-8}$ mole per mole of the finished silver halide. An aqueous solution of KI were added with vigorous stirring at the step of completion of 90% addition of the entire silver nitrate amount, so that the I amount became 0.30 mole % per mole of the finished silver halide. After desalting at 40° C., 168 g of a lime-processed gelatin was added, and then pH and pCl were adjusted to 5.5 and 1.8 respectively. The obtained emulsion contained cubic silver iodobromochloride grains having an equivalent-sphere diameter of 0.35 μm and a variation coefficient of 9%.

To the emulsion dissolved at 40° C. was added sodium benzenethiosulfonate in an amount of $2\times10^{-5}$ mole per mole of silver halide, and the resulting emulsion was optimally ripened at 60° C. with sodium thiosulfate penta-hydrate as a sulfur sensitizer and bis(1,4,5-trimethyl-1,2,4-triazolium-3-thiolato)aurate(I) tetrafluoroborate as a gold sensitizer. After cooling to 40° C., a sensitizing dye A, a sensitizing dye B', 1-phenyl-5-mercaptotetrazole, 1-(5-methylureidophenyl)-5-mercaptotetrazole, and potassium bromide were added in an amount of $3.9\times10^{-4}$ mole, $2.0\times10^{-4}$ mole, $3.9\times10^{-4}$ mole, $3.9\times10^{-4}$ mole, and $3.9\times10^{-3}$ mole, per mole of silver halide respectively. The resulting emulsion was referred to as Emulsion B-321 (silver chloride content; 95.4 mole %).

Here were used the same ones as the sensitizing dyes A and B in the above mentioned EXAMPLE 6 respectively.

Preparation of Emulsion B-322

An emulsion was prepared in the same manner as in the afore-mentioned preparation of Emulsion B-321, except that an aqueous solution of $K_2[Ir(H_2O)Cl_5]$ was added at the step of from 95% to 98% addition of the entire silver nitrate amount, so that the Ir amount became $5.0\times10^{-7}$ mole per mole of the finished silver halide. The resulting emulsion was referred to as Emulsion B-322 (silver chloride content; 95.4 mole %).

Preparation of Emulsion B-323

An emulsion was prepared in the same manner as in the afore-mentioned preparation of Emulsion B-321, except that an aqueous solution of $K_2[Ir(5\text{-methylthiazole})Cl_5]$ was added at the step of from 95% to 98% addition of the entire silver nitrate amount, so that the Ir amount became $5.0\times10^{-7}$ mole per mole of the finished silver halide. The resulting emulsion was referred to as Emulsion B-323 (silver chloride content; 95.4 mole %).

Preparation of Emulsion B-324

An emulsion was prepared in the same manner as in the afore-mentioned preparation of Emulsion B-321, except that an aqueous solution of $K_2[Ir(2\text{-chloro-5-fluorothiadiazole})Cl_5]$ was added at the step of from 95% to 98% addition of the entire silver nitrate amount, so that the Ir amount became $5.0\times10^{-7}$ mole per mole of the finished silver halide. The resulting emulsion was referred to as Emulsion B-324 (silver chloride content; 95.4 mole %).

Preparation of Emulsion B-325

An emulsion was prepared in the same manner as in the afore-mentioned preparation of Emulsion B-321, except that an aqueous solution of $K_3[RhBr_6]$ was added at the step of from 60% to 80% addition of the entire silver nitrate amount, so that the Rh amount became $5.8\times10^{-9}$ mole per mole of the finished silver halide. The resulting emulsion was referred to as Emulsion B-325 (silver chloride content; 95.4 mole %).

Preparation of Emulsion B-326

An emulsion was prepared in the same manner as in the afore-mentioned preparation of Emulsion B-321, except that an aqueous solution of $Cs_2[Os(NO)CL_5]$ was added at the step of from 60% to 80% addition of the entire silver nitrate amount, so that the Os amount became $5.8\times10^{-9}$ mole per mole of the finished silver halide. The resulting emulsion was referred to as Emulsion B-326 (silver chloride content; 95.4 mole %).

Preparation of Emulsion B-327

An emulsion was prepared in the same manner as in the afore-mentioned preparation of Emulsion B-321, except that an aqueous solution of $K_2[Ir(H_2O)Cl_5]$ was added at the step of from 95% to 98% addition of the entire silver nitrate amount, so that the Ir amount became $5.0\times10^{-7}$ mole per mole of the finished silver halide, and an aqueous solution of $K_3[RhBr_6]$ was added at the step of from 60% to 80% addition of the entire silver nitrate amount, so that the Rh amount became $5.8\times10^{-9}$ mole per mole of the finished silver halide. The resulting emulsion was referred to as Emulsion B-327 (silver chloride content; 95.4 mole %).

Preparation of Emulsion B-328

An emulsion was prepared in the same manner as in the afore-mentioned preparation of Emulsion B-321, except that an aqueous solution of $K_2[Ir(H_2O)Cl_5]$ was added at the step of from 95% to 98% addition of the entire silver nitrate amount, so that the Ir amount became $5.0\times10^{-7}$ mole per mole of the finished silver halide, and an aqueous solution of $Cs_2[Os(NO)Cl_5]$ was added at the step of from 60% to 80% addition of the entire silver nitrate amount, so that the Os amount became $5.8\times10^{-9}$ mole per mole of the finished silver halide. The resulting emulsion was referred to as Emulsion B-328 (silver chloride content; 95.4 mole %).

Preparation of Emulsion B-329

An emulsion was prepared in the same manner as in the afore-mentioned preparation of Emulsion B-321, except that an aqueous solution of $K_2[Ir(5\text{-methylthiazole})Cl_5]$ was added at the step of from 95% to 98% addition of the entire silver nitrate amount, so that the Ir amount became $5.0\times10^{-7}$ mole per mole of the finished silver halide, and an aqueous solution of $K_3[RhBr_6]$ was added at the step of from 60% to 80% addition of the entire silver nitrate amount, so that the Rh amount became $5.8\times10^{-9}$ mole per mole of the finished silver halide. The resulting emulsion was referred to as Emulsion B-329 (silver chloride content; 95.4 mole %).

Preparation of Emulsion B-330

An emulsion was prepared in the same manner as in the afore-mentioned preparation of Emulsion B-321, except that an aqueous solution of $K_2[Ir(5\text{-methylthiazole})Cl_5]$ was added at the step of from 95% to 98% addition of the entire silver nitrate amount, so that the Ir amount became $5.0\times10^{-7}$ mole per mole of the finished silver halide, and an aqueous solution of $Cs_2[Os(NO)Cl_5]$ was added at the step of from 60% to 80% addition of the entire silver nitrate amount, so that the Os amount became $5.8\times10^{-9}$ mole per mole of the finished silver halide. The resulting emulsion was referred to as Emulsion B-330 (silver chloride content; 95.4 mole %).

Preparation of Emulsion B-331

An emulsion was prepared in the same manner as in the afore-mentioned preparation of Emulsion B-321, except that an aqueous solution of $K_2[Ir(2\text{-chloro-5-fluorothiadiazole})Cl_5]$ was added at the step of from 95% to 98% addition of the entire silver nitrate amount, so that the Ir amount became $5.0\times10^{-7}$ mole per mole of the finished silver halide, and an aqueous solution of $K_3[RhBr_6]$ was added at the step of from 60% to 80% addition of the entire silver nitrate amount, so that the Rh amount became $5.8\times10^{-9}$ mole per mole of the finished silver halide. The resulting emulsion was referred to as Emulsion B-331 (silver chloride content; 95.4 mole %).

Preparation of Emulsion B-332

An emulsion was prepared in the same manner as in the afore-mentioned preparation of Emulsion B-321, except that an aqueous solution of $K_2[Ir(2\text{-chloro-5-fluorothiadiazole})Cl_5]$ was added at the step of from 95% to 98% addition of the entire silver nitrate amount, so that the Ir amount became $5.0\times10^{-7}$ mole per mole of the finished silver halide, and an aqueous solution of $Cs_2[Os(NO)Cl_5]$ was added at the step of from 60% to 80% addition of the entire silver nitrate amount, so that the Os amount became $5.8\times10^{-9}$ mole per mole of the finished silver halide. The resulting emulsion was referred to as Emulsion B-332 (silver chloride content; 95.4 mole %).

Preparation of Emulsion G-321

Emulsion G-321 (silver chloride content; 95.4 mole %) was prepared in the same manner as Emulsion B-321, except that the chemical sensitization and the spectral sensitization for the cubic silver iodobromochloride emulsion of an equivalent-sphere diameter of 0.35 μm and a variation coefficient of 9% obtained by the preparation of Emulsion B-321 were replaced with the formulation for Emulsion G-301 in Example 6.

Preparation of Emulsion R-321

Emulsion R-321 (silver chloride content; 95.4 mole %) was prepared in the same manner as Emulsion B-321, except that the chemical sensitization and the spectral sensitization for the cubic silver iodobromochloride emulsion of an equivalent-sphere diameter of 0.35 μm and a variation coefficient of 9% obtained by the preparation of Emulsion B-321 were replaced with the formulation for Emulsion R-301 in Example 6.

Samples 3201 to 3212 were prepared in the same manner as sample 3103 in Example 6, except that Emulsion G-301 of the third layer was changed to Emulsion G-321, and Emulsion R-301 of the fifth layer was changed to Emulsion R-321, and Emulsion B-301 of the first layer was changed to Emulsions B-321 to B-332 respectively. Each sample was subjected to high luminance exposure of 10 second under the same conditions as in Example 6. After 30 minutes of exposure, the exposed samples were subjected to color development processing according to the processing process B in Example 6. A densitometry was carried out to obtain a characteristic curve. The following evaluation is based on the characteristic curve obtained by a measurement of yellow density, even though such is not explicitly mentioned hereinafter.

(Reciprocity Law Failure Characteristics)

For evaluation of reciprocity law failure characteristics, the same processing and measurement as mentioned above was carried out to obtain a characteristic curve, except that the exposing time was changed to 10 seconds. A sensitometer (FWH Model (trade name) manufactured by Fuji Photo Film Co., Ltd.), a color temperature of 3200K for the light sources, and a short wave cut filter SC-40 (trade name) were employed. Further, a spectral distribution of each sample was corrected in combination with a color-compensating filter, such that the processed sample should have visually a gradation of gray coloration.

The term "γ" designates the gradient between the point A and the point B, assuming that the point A is a point of density lower by 1.0 from the maximum density (Dmax), whereas the point B is a point of density lower by 0.1 from the maximum density of the characteristic curve. A ratio of γ of $10^{-6}$ sec. exposure $\gamma(10^{-6})$ to γ of 10 sec. exposure γ(10) was indicated by $\gamma_{rel.}=\gamma(10^{-6})/\gamma(10)\times100$, thereby the reciprocity law failure characteristics were evaluated. The closer $\gamma_{rel.}$ value to 100 is, the less difference in gradation between low illuminance exposure and high illuminance exposure is, and the more excellent in reciprocity law failure characteristics.

(Latent Image Stability)

For evaluation of latent image stability, the same exposure, processing and measurement as mentioned above was carried out to obtain a characteristic curve, except that after 10 seconds of the high illuminance exposure of $10^{-6}$ sec. a development processing was carried out. The fluctuation in sensitivity between the points As at the latent image times of 10 seconds and 30 minutes was designated as ΔSH, by which the latent image stability was evaluated. The fluctuation in sensitivity was indicated by a difference on the axis of the logarithm of exposure amount.

Further, the fluctuation in sensitivity at the point C was designated as ΔSL, assuming that the point C was a point of density by 0.2 higher than the minimum density (Dmin) of the characteristic curve. The value of ΔSL was also used for evaluation of the latent image stability. The fluctuation in sensitivity was also indicated by a difference on the axis of log. exposure amount.

The closer to 0 ΔSH and ΔSL are respectively, the less fluctuation in performances is, and the more excellent in latent image stability is.

(Storage Stability)

For evaluation of storage stability, such a compulsory test that each sample before exposure was left under the conditions of 60° C. 30% RH for 24 hours was conducted. These samples were subjected to high illuminance exposure of $10^{-6}$ sec. under the same conditions as in Example 6, and after 30 min. of exposure they were subjected to color development processing according to the processing process B of Example 6. A densitometry was carried out to obtain a characteristic curve.

The fluctuation in sensitivity at the point C in this compulsory test was designated as ΔSth, by which the storage stability was evaluated. The fluctuation in sensitivity was also indicated by a difference on the axis of the logarithm of exposure amount.

The closer to 0 (zero) ΔSth is, the less fluctuation in performances is, and the more excellent storage stability is.

The results in these evaluations are shown together in Table 9.

TABLE 9

| Sample No. | Reciprocity law failure characteristics $\gamma_{rel.}$ | Latent image stability Δ SL | Latent image stability Δ SH | Storage stability Δ Sth |
|---|---|---|---|---|
| 3201 | 57 | −0.03 | +0.06 | +0.02 |
| 3202 | 80 | −0.03 | +0.06 | +0.02 |
| 3203 | 87 | −0.03 | +0.06 | +0.02 |
| 3204 | 91 | 0.02 | +0.06 | +0.01 |
| 3205 | 63 | ±0.00 | +0.02 | +0.06 |
| 3206 | 65 | ±0.00 | +0.02 | +0.05 |
| 3207 | 83 | −0.01 | +0.03 | +0.03 |
| 3208 | 80 | −0.01 | +0.03 | +0.03 |
| 3209 | 91 | −0.01 | +0.02 | +0.02 |
| 3210 | 87 | −0.01 | +0.02 | +0.02 |
| 3211 | 95 | ±0.00 | +0.02 | ±0.00 |
| 3212 | 91 | ±0.00 | +0.02 | +0.01 |

The results in Table 9 clearly show that color photographic light-sensitive material of the present invention is excellent in reciprocity law failure characteristics, and improves latent image stability. The samples 3202, 3203 and 3204 each containing the compound represented by formula (I) each improve reciprocity law failure characteristics, but nothing with latent image stability. The samples 3205 and 3206 each containing the compound represented by formula (II) each improve latent image stability, but rather deteriorate storage stability. In contrast, regarding the samples 3207 to 3212 each containing the compound represented by formula (I) in combination with the compound represented by formula (II), a remarkable improvement in all the reciprocity law failure characteristics, latent image stability and storage stability was achieved. These were really unexpected results.

Example 8

(Preparation of Emulsion B-401)

Using a conventional method in which silver nitrate and sodium chloride were mixed at the same time with vigorous stirring to an aqueous gelatin solution, a cubic high silver chloride emulsion having an equivalent-sphere diameter of 0.70 μm and a variation coefficient of 10% was prepared. In this preparation, however, $Cs_2[Os(NO)Cl_5]$ was added at the step of from 60% to 80% addition of the entire silver nitrate amount. Further, at the step of from 80% to 90% addition of the entire silver nitrate amount, potassium bromide (2.5 mole % per mole of the finished silver halide) and $K_4[Ru(CN)_6]$ were added. $K_2[IrCl_6]$ was added at the step of from 83% to 88% addition of the entire silver nitrate amount. $K_2[Ir(5\text{-methylthiazole})Cl_5]$ was added at the step of from 92% to 98% addition of the entire silver nitrate amount. Potassium iodide (0.07 mole % per mole of the finished silver halide) was added at the step of completing 94% addition of the entire silver nitrate amount. After desalting, gelatin was added to the resulting emulsion for re-dispersion.

To the emulsion, sodium benzene thiosulfonate and sensitizing dye A and sensitizing dye B were added, and the resulting emulsion was optimally ripened with a colloid dispersion of gold sulfide as a sensitizer. Further, 1-phenyl-5-mercaptotetrazole and 1-(5-methylureidophenyl)-5-mercapto tetrazole were added. The thus-obtained emulsion was referred to as Emulsion B-401.

Here were used the same ones as the sensitizing dyes A and B in the above mentioned EXAMPLE 1 respectively.

(Preparation of Emulsion B-402)

A cubic high silver chloride emulsion having an equivalent-sphere diameter of 0.63 μm and a variation coefficient of 10% was prepared in the same manner as Emulsion B-401 except for changing the addition rate of silver nitrate and sodium chloride. In this preparation, however, the amount of potassium iodide to be added at the step of completing 94% addition of the entire silver nitrate amount was changed to 0.15 mole %. The thus-obtained emulsion was referred to as Emulsion B-402.

(Preparation of Emulsion B-403)

A cubic high silver chloride emulsion having an equivalent-sphere diameter of 0.52 μm and a variation coefficient of 10% was prepared in the same manner as Emulsion B-401 except for changing the addition rate of silver nitrate and sodium chloride. In this preparation, however, the amount of potassium iodide to be added at the step of completing 94% addition of the entire silver nitrate amount was changed to 0.25 mole %. The thus-obtained emulsion was referred to as Emulsion B-403.

(Preparation of Emulsion B-404)

A cubic high silver chloride emulsion having an equivalent-sphere diameter of 0.46 μm and a variation coefficient of 10% was prepared in the same manner as Emulsion B-401 except for changing the addition rate of silver nitrate and sodium chloride. In this preparation, however, the amount of potassium iodide to be added at the step of completing 94% addition of the entire silver nitrate amount was changed to 0.30 mole %. The thus-obtained emulsion was referred to as Emulsion B-404.

(Preparation of Emulsion G-401)

Using a conventional method in which silver nitrate and sodium chloride were mixed at the same time with vigorous stirring to an aqueous gelatin solution, a cubic high silver chloride emulsion having an equivalent-sphere diameter of 0.68 μm and a variation coefficient of 10% was prepared. In this preparation, however, $K_4[Ru(CN)_6]$ was added at the step of from 80% to 90% addition of the entire silver nitrate amount. Potassium bromide (4 mole % per mole of the finished silver halide) was added at the step of from 80% to 100% addition of the entire silver nitrate amount. $K_2[IrCl_6]$ was added at the step of from 83% to 88% addition of the entire silver nitrate amount. Potassium iodide (0.1 mole % per mole of the finished silver halide) was added at the step of completing 90% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercapto tetrazole, 1-(5-methylureidophenyl)-5-mercaptotetrazole and potassium bromide were added. The thus-obtained emulsion was referred to as Emulsion G-401.

Here was used the same one as the sensitizing dye C in the above mentioned EXAMPLE 1 respectively.

(Preparation of Emulsion G-402)

A cubic high silver chloride emulsion having an equivalent-sphere diameter of 0.59 μm and a variation coefficient of 10% was prepared in the same manner as Emulsion G-401 except for changing the addition rate of silver nitrate and sodium chloride. In this preparation, however, the amount of potassium iodide to be added at the step of completing 90% addition of the entire silver nitrate amount was changed to 0.15 mole %. The thus-obtained emulsion was referred to as Emulsion G-402.

(Preparation of Emulsion G-403)

A cubic high silver chloride emulsion having an equivalent-sphere diameter of 0.49 μm and a variation coefficient of 10% was prepared in the same manner as Emulsion G-401 except for changing the addition rate of silver nitrate and sodium chloride. In this preparation, however, the amount of potassium iodide to be added at the step of completing 90% addition of the entire silver nitrate amount was changed to 0.21 mole %. The thus-obtained emulsion was referred to as Emulsion G-403.

(Preparation of Emulsion G-404)

A cubic high silver chloride emulsion having an equivalent-sphere diameter of 0.42 μm and a variation coefficient of 10% was prepared in the same manner as Emulsion G-401 except for changing the addition rate of silver nitrate and sodium chloride. In this preparation, however, the amount of potassium iodide to be added at the step of completing 90% addition of the entire silver nitrate amount was changed to 0.25 mole %. The thus-obtained emulsion was referred to as Emulsion G-404.

(Preparation of Emulsion G-405)

A cubic high silver chloride emulsion having an equivalent-sphere diameter of 0.34 μm and a variation coefficient of 13% was prepared in the same manner as Emulsion G-401 except for changing the addition rate of silver nitrate and sodium chloride. In this preparation, however, the amount of potassium iodide to be added at the step of completing 90% addition of the entire silver nitrate amount was changed to 0.28 mole %. The thus-obtained emulsion was referred to as Emulsion G-405.

(Preparation of Emulsion R-401)

Using a conventional method in which silver nitrate and sodium chloride were mixed at the same time with vigorous stirring to an aqueous gelatin solution, a cubic high silver chloride emulsion having an equivalent-sphere diameter of 0.68 μm and a variation coefficient of 10% was prepared. In this preparation, however, $K_4[Ru(CN)_6]$ was added at the step of from 80% to 90% addition of the entire silver nitrate amount. Potassium bromide (4.3 mole % per mole of the finished silver halide) was added at the step of from 80% to 100% addition of the entire silver nitrate amount. $K_2[IrCl_6]$ was added at the step of from 83% to 88% addition of the entire silver nitrate amount. After desalting, gelatin was added to the resulting emulsion for re-dispersion.

To the emulsion, sodium benzene thiosulfate was added, and the resulting emulsion was optimally ripened with sodium thiosulfate pentahydrate as a sulfur sensitizer and bis(1,4,5-trimethyl-1,2,4-triazoluim-3-thiolate)aurate(I) tetrafuloroborate as a gold sensitizer. Further, a sensitizing dye H, 1-phenyl-5-mercapto tetrazole, 1-(5-methylureidophenyl)-5-mercaptotetrazole, Compound I and potassium bromide were added. The thus-obtained emulsion was referred to as Emulsion R-401.

Here were used the same ones as the sensitizing dye H and the compound I in the above mentioned EXAMPLE 4 respectively.

(Preparation of Emulsion R-402)

A cubic high silver chloride emulsion having an equivalent-sphere diameter of 0.59 μm and a variation coefficient of 10% was prepared in the same manner as Emulsion R-401 except for changing the addition rate of silver nitrate and sodium chloride. The thus-obtained emulsion was referred to as Emulsion R-402.

(Preparation of Emulsion R-403)

A cubic high silver chloride emulsion having an equivalent-sphere diameter of 0.49 μm and a variation coefficient of 10% was prepared in the same manner as Emulsion R-401 except for changing the addition rate of silver nitrate and sodium chloride. The thus-obtained emulsion was referred to as Emulsion R-403.

(Preparation of Emulsion R-404)

A cubic high silver chloride emulsion having an equivalent-sphere diameter of 0.42 μm and a variation coefficient of 10% was prepared in the same manner as Emulsion R-401 except for changing the addition rate of silver nitrate and sodium chloride. The thus-obtained emulsion was referred to as Emulsion R-404.

(Preparation of Emulsion R-405)

A cubic high silver chloride emulsion having an equivalent-sphere diameter of 0.34 μm and a variation coefficient of 13% was prepared in the same manner as Emulsion R-401 except for changing the addition rate of silver nitrate and sodium chloride. The thus-obtained emulsion was referred to as Emulsion R-405.

The surface of a paper support laminated on both sides with a polyethylene resin was corona discharged. The support was provided with a gelatin undercoat layer containing sodium dodecylbenzenesulfonate and, further, the first to seventh photographic constituent layers were coated in order on the undercoat layer to prepare silver halide color photographic light-sensitive material samples having the following composition. The coating solution of each photographic constituent layer was prepared as follows.

(Preparation of a Coating Solution for the First Layer)

Into 21 g of a solvent (Solv-1) and 80 ml of ethyl acetate were dissolved 57 g of a yellow coupler (ExY-1), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsion B-401 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

Here were used the same ones as the hardeners H-1 to H-3 and antiseptics Ab-1, Ab-2, Ab-3 and Ab-4 in the above mentioned EXAMPLE 1 respectively.

Further, to the green-sensitive emulsion layer and the red-sensitive emulsion layer was added 1-phenyl-5-mercaptotetrazole in amounts of $1.0\times10^{-3}$ mol and $5.9\times10^{-4}$ mol, per mol of the silver halide, respectively.

Further, to the second layer, the fourth layer, and the sixth layer, it was added in amounts of 0.2 mg/m$^2$, 0.2 mg/m$^2$, and 0.6 mg/m$^2$, respectively.

To the red-sensitive emulsion layer, was added a copolymer latex of methacrylic acid and butyl acrylate (1:1 in mass ratio; average molecular weight, 200,000 to 400,000) in an amount of 0.05 g/m$^2$.

Here were used the same ones as the dyes to neutralize irradiation in the above-mentioned EXAMPLE 1 respectively. The coating amount for the dyes to neutralize irradiation were same as in Example 1 respectively.

(Layer Constitution)

The composition of each layer is shown below. The numbers show coating amounts (g/m$^2$). In the case of the silver halide emulsion, the coating amount is in terms of silver.

Support

Polyethylene Resin-laminated Paper

[The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)].

| First Layer (Blue-Sensitive Emulsion Layer) | |
|---|---|
| Emulsion B-401 | 0.23 |
| Gelatin | 1.00 |
| Yellow coupler (ExY-1) | 0.46 |

-continued

| | |
|---|---|
| Color-image stabilizer (Cpd-1) | 0.06 |
| Color-image stabilizer (Cpd-2) | 0.03 |
| Color-image stabilizer (Cpd-3) | 0.06 |
| Color-image stabilizer (Cpd-8) | 0.02 |
| Solvent (Solv-1) | 0.17 |
| Second Layer (Color-Mixing Preventing Layer) | |
| Gelatin | 0.50 |
| Color-mixing inhibitor (Cpd-4) | 0.05 |
| Color-image stabilizer (Cpd-5) | 0.01 |
| Color-image stabilizer (Cpd-6) | 0.06 |
| Color-image stabilizer (Cpd-7) | 0.01 |
| Solvent (Solv-1) | 0.03 |
| Solvent (Solv-2) | 0.11 |
| Third Layer (Green-Sensitive Emulsion Layer) | |
| Emulsion G-401 | 0.13 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Preventing Layer) | |
| Gelatin | 0.36 |
| Color mixing-inhibitor (Cpd-4) | 0.03 |
| Color-image stabilizer (Cpd-5) | 0.006 |
| Color-image stabilizer (Cpd-6) | 0.05 |
| Color-image stabilizer (Cpd-7) | 0.004 |
| Solvent (Solv-1) | 0.02 |
| Solvent (Solv-2) | 0.08 |
| Fifth Layer (Red-Sensitive Emulsion Layer) | |
| Emulsion R-401 | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1-4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

Here were used the same ones as the yellow coupler ExY-1, the magenta coupler ExM, the cyan couplers ExC-2 and ExC-3, the color-image stabilizers Cpd-1 to Cpd-3, the color-mixing inhibitor Cpd-4, the color-image stabilizers Cpd-5 to Cpd-11, the surface active agent Cpd-13, the color-image stabilizers Cpd-14 to Cpd-18, the color-mixing inhibitor Cpd-19, the ultraviolet absorbing agents UV-1 to UV-7, UV-A, UV-B and UV-C, the solvents Solv-1 to Solv-5, Solv-7 and Solv-8, and the compound S1-4 in the above-mentioned EXAMPLE 1 respectively.

The sample prepared as mentioned above was referred to as sample 4101. Samples were prepared in the same manner as sample 4101 except that the blue-sensitive emulsion layer, the green-sensitive emulsion layer and the red-sensitive emulsion layer were changed as shown in Table 10. The thus-obtained samples were referred to as samples 4102 to 4120, respectively.

TABLE 10

| | Yellow developable blue-sensitive emulsion layer | | Magenta developable green-sensitive emulsion layer | | Cyan developable red-sensitive emulsion layer | | Maximum interlayer difference |
|---|---|---|---|---|---|---|---|
| Sample No. | Emulsion name | Equivalent-sphere diameter (μm) | Emulsion name | Equivalent-sphere diameter (μm) | Emulsion name | Equivalent-sphere diameter (μm) | of average equivalent-sphere diameter % |
| 4101 | B-401 | 0.70 | G-401 | 0.68 | R-401 | 0.68 | 3 |
| 4102 | B-401 | 0.70 | G-402 | 0.59 | R-402 | 0.59 | 19 |
| 4103 | B-401 | 0.70 | G-403 | 0.49 | R-403 | 0.49 | 43 |
| 4104 | B-401 | 0.70 | G-404 | 0.40 | R-404 | 0.40 | 75 |
| 4105 | B-401 | 0.70 | G-405 | 0.34 | R-405 | 0.34 | 106 |
| 4106 | B-402 | 0.63 | G-401 | 0.68 | R-401 | 0.68 | 8 |
| 4107 | B-402 | 0.63 | G-402 | 0.59 | R-402 | 0.59 | 7 |
| 4108 | B-402 | 0.63 | G-403 | 0.49 | R-403 | 0.49 | 29 |
| 4109 | B-402 | 0.63 | G-404 | 0.40 | R-404 | 0.40 | 58 |
| 4110 | B-402 | 0.63 | G-405 | 0.34 | R-405 | 0.34 | 85 |
| 4111 | B-403 | 0.52 | G-401 | 0.68 | R-401 | 0.68 | 31 |
| 4112 | B-403 | 0.52 | G-402 | 0.59 | R-402 | 0.59 | 13 |
| 4113 | B-403 | 0.52 | G-403 | 0.49 | R-403 | 0.49 | 6 |
| 4114 | B-403 | 0.52 | G-404 | 0.40 | R-404 | 0.40 | 30 |
| 4115 | B-403 | 0.52 | G-405 | 0.34 | R-405 | 0.34 | 53 |
| 4116 | B-404 | 0.46 | G-401 | 0.68 | R-401 | 0.68 | 49 |
| 4117 | B-404 | 0.46 | G-402 | 0.59 | R-402 | 0.59 | 28 |
| 4118 | B-404 | 0.46 | G-403 | 0.49 | R-403 | 0.49 | 7 |
| 4119 | B-404 | 0.46 | G-404 | 0.40 | R-404 | 0.40 | 15 |
| 4120 | B-404 | 0.46 | G-405 | 0.34 | R-405 | 0.34 | 35 |

To examine photographic characteristics of these samples by laser scanning exposure, the following exposure was performed using light sources as set forth below.

Three types of semiconductor laser were used as laser light sources, i.e., a blue semiconductor laser having a wavelength of about 440 nm (reported by NICHIA Corporation in the 48th symposium of Applied physics-relating Federation (March 2001)), a green laser having a wavelength of about 530 nm taken out by changing the wavelength of a semiconductor laser (the emitting wavelength: about 1060 nm) by an SHG crystal of a wave guide-like $LiNbO_3$ having an inverting domain structure, and a red semiconductor laser having a wavelength of about 650 nm (HITACHI Type No. HL 6501 MG).

Each of three-color laser beams was made to be able to transfer vertically to scanning direction by a polygonal mirror and successively scanning exposure on the sample. For restraining the fluctuation of light amount due to the change of temperature, the temperature of a semiconductor laser was maintained constant using Peltier element. The effective beam diameter was 80 μm, the scanning pitch was 42.3 μm (600 dpi) and the average exposure time per one pixel was $1.7\times10^{-7}$ second.

Under the 10° C. 30% RH atmosphere, with the above-mentioned light source, a gradation exposure for sensitometry developing gray color consisting of yellow, magenta and cyan each developed in the respective layer was given to these layers.

Each exposed sample was subjected to the following color development processing. From the end of uniformly exposed samples, color-development started after about 4 seconds of exposure.

The processing steps are shown below.

[Process]

The continuous processing was performed using the sample 4110 until a color developing replenisher used in the following steps was reached to the half amount of the color developing tank capacity.

| Processing Step | Temperature | Time | Replenishing rate* |
|---|---|---|---|
| Color Development | 45.0° C. | 16 sec. | 45 ml |
| Bleach-fixing | 40.0° C. | 16 sec. | 35 ml |
| Rinse (1)** | 40.0° C. | 8 sec. | — |
| Rinse (2)** | 40.0° C. | 8 sec. | — |
| Rinse (3)** | 40.0° C. | 8 sec. | — |
| Rinse (4)** | 38.0° C. | 8 sec. | 121 ml |
| Dry | 80.0° C. | 16 sec. | |

*The replenishment rates were amounts per $m^2$ of light-sensitive material to be processed.

**Rinse (3) was equipped with a rinse cleaning system RC50D manufactured by Fuji Photo Film Co., Ltd., and a rinse solution was taken out from Rinse (3) and sent to a reverse osmotic film module (RC50D) by means of a pump. The permeated water obtained in the tank was supplied to Rinse (which may be (4)) and the concentrated water was returned to Rinse (3). The pump pressure was adjusted so that an amount of the transmitted water to the reverse osmotic film module could be maintained at the rate of 50 to 300 ml per minute. A thermo-regulated circulation was carried out for 10 hours a day.

(Rinsing was performed by tank counter-current system from tank (1) to tank (4).)

The compositions of each of the processing solutions were as follows:

| | [Tank solution] | [Replenisher] |
|---|---|---|
| [Color developer] | | |
| Water | 800 ml | 600 ml |
| Fluorescent whitening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.5 g | 0.5 g |
| Disodium-N,N-bis(sulfonatoethyl) hydroxylamine | 8.5 g | 14.5 g |
| 4-Amino-3-methyl-N-ethyl-N-(β-methanesulfonamidoethyl) aniline• 3/2 sulfuric acid•1 $H_2O$ | 10.0 g | 22.0 g |
| Potassium carbonate | 26.3 g | 26.3 g |
| Water to make | 1000 ml | 1000 ml |
| pH (at 25° C./adjusted with potassium hydroxide and sulfuric acid) | 10.35 | 12.6 |
| [Bleach - fixing solution] | | |
| Water | 800 ml | 800 ml |
| Ammonium thiosulfate (750 g/liter) | 107 ml | 214 ml |
| Succinic acid | 29.5 g | 59.0 g |
| Ethylenediamine tetraacetic acid iron (III) ammonium | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (at 25° C./adjusted with nitric acid and ammonia) | 6.00 | 6.00 |
| [Rinse solution] | | |
| Sodium chlorinated-isocyanurate | 0.02 g | 0.02 g |
| Deionized water (Conductivity: 5 μS/cm or less) | 1000 ml | 1000 ml |
| pH (25° C.) | 6.5 | 6.5 |

Here was used the same one as fluorescent whitening FL-1 in the above-mentioned EXAMPLE 2.

To examine deterioration of white background resulting from irradiation of natural radiation to each sample, a uniform X-ray irradiation (120 KV, 1/10 sec.) was conducted to each said sample and then the above-mentioned processing was performed without exposure to light. Besides, each similarly processed sample but for omitting X-ray irradiation was prepared. The value of a*b* of each white ground was measured using a color analyzer (C-2000 manufactured by Hitachi, Ltd.) and xenon daily use light-source. D65 was measured as a neutral point (white or deteriorated point). A latitude of fluctuation on the a*b* axis resulting from whether X-ray irradiation was conducted or not was read and referred to as Δa*b*. The smaller Δa*b* is, the less deterioration of white ground is. This is because fluctuation in tint of a white ground resulting from a natural radiation during a long period of storage is small and also a tint of the white ground that has not yet been stored can be maintained.

To examine the rapidity in color development of each sample, the sample exposed as mentioned above was processed so that a color developing time was dividedly changed second by second, thereby photographic characteristics being measured. Because a color developing time necessary to reach the maximum density is longest in a yellow dye-developable layer of all samples, the rapid processability was evaluated in terms of a color developing time $t_{dev.}$(sec) that is necessary to reach the maximum density in the yellow dye-developable layer. The shorter $t_{dev.}$(sec) time is, the more excellent processability is.

To evaluate a stability of each sample to fluctuation in processing factors, 0.5 ml of a bleach-fixing solution was mixed to 1 liter of a color developing solution with intent to measure a difference in gradation from the case of no mixing. As a result, in the magenta-developable layer of all samples, a change of gradation resulting from a mixing of the bleach-fixing solution was remarkable, and the change was directed to hard gradation enhancement. A gradation of from the magenta density of 0.5 to the magenta density of 1.5 was read. The change of gradation resulting from a mixing of the bleach-fixing solution was denoted as Δγ. The smaller Δγ is, the more stable the fluctuation in processing factors is. The obtained results were shown in Table 11.

TABLE 11

| Sample No. | Δa*b* | $t_{dev.}$ (sec) | Δγ |
|---|---|---|---|
| 4101 | 1.9 | 27 | 0.13 |
| 4102 | 2.1 | 25 | 0.12 |
| 4103 | 2.2 | 24 | 0.15 |
| 4104 | 2.2 | 25 | 0.16 |
| 4105 | 2.4 | 26 | 0.24 |
| 4106 | 1.7 | 21 | 0.14 |
| 4107 | 1.2 | 16 | 0.14 |
| 4108 | 1.2 | 16 | 0.15 |
| 4109 | 1.4 | 17 | 0.16 |
| 4110 | 2.0 | 20 | 0.23 |
| 4111 | 1.7 | 20 | 0.15 |
| 4112 | 1.4 | 16 | 0.14 |
| 4113 | 1.0 | 14 | 0.14 |
| 4114 | 1.1 | 14 | 0.15 |
| 4115 | 1.5 | 17 | 0.27 |
| 4116 | 1.9 | 19 | 0.14 |
| 4117 | 1.4 | 15 | 0.15 |
| 4118 | 1.0 | 13 | 0.14 |
| 4119 | 1.0 | 13 | 0.17 |
| 4120 | 1.3 | 17 | 0.29 |

Δa*b*; The smaller value is, the less deterioration of white ground is.
$t_{dev.}$(sec); The shorter time is, the more excellent the rapid processability is.
Δγ; The smaller value is, the more stable the fluctuation in processing factors is.

As is apparent from the results in Table 11, the samples of the present invention provide a white ground with less deterioration, and they are excellent in the rapid processability and stable to fluctuation in processing factors.

Example 9

(Preparation of Emulsion B-H1)

Using a conventional method in which silver nitrate and sodium chloride were mixed at the same time with stirring to an aqueous gelatin solution, an emulsion of cubic high silver chloride having an equivalent-sphere diameter of 0.53 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (4 mole % per mole of the finished silver halide) was added. $K_2[IrCl_6]$ was added at the step of from 83% to 88% addition of the entire silver nitrate amount. $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate and sensitizing dye A and sensitizing dye B were added, and the resulting emulsion was optimally ripened with gold thioglucose as a sensitizer. Further, 1-phenyl-5-mercapto tetrazole and 1-(5-methylureidophenyl)-5-mercapto tetrazole were added. The thus-obtained emulsion was referred to as Emulsion B-H1.

(Preparation of Emulsion B-L1)

Using a conventional method in which silver nitrate and sodium chloride were mixed at the same time with stirring to an aqueous gelatin solution, an emulsion of cubic high silver chloride having an equivalent-sphere diameter of 0.43 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (4 mole % per mole of the finished silver halide) was added. $K_2[IrCl_6]$ was added at the step of from 83% to 88% addition of the entire silver nitrate amount. $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate and sensitizing dye A and sensitizing dye B were added, and the resulting emulsion was optimally ripened with gold thioglucose as a sensitizer. Further, 1-phenyl-5-mercapto tetrazole and 1-(5-methylureidophenyl)-5-mercaptotetrazole were added. The thus-obtained emulsion was referred to as Emulsion B-L1.

(Preparation of Emulsion B-H2)

Using a conventional method in which silver nitrate and sodium chloride were mixed at the same time with stirring to an aqueous gelatin solution, an emulsion of cubic high silver chloride having an equivalent-sphere diameter of 0.53 μm and a variation coefficient of 10% was prepared. In this preparation, however, $Cs_2[os(NO)Cl_5]$ was added at the step of from 50% to 80% addition of the entire silver nitrate amount. Further, at the step of from 80% to 90% addition of the entire silver nitrate amount, potassium bromide (3 mole % per mole of the finished silver halide) and $K_4[Ru(CN)_6]$ was added. $K_2[IrCl_6]$ was added at the step of from 83% to 88% addition of the entire silver nitrate amount. Potassium iodide (0.31 mole % per mole of the finished silver halide) was added at the step of completing 90% addition of the entire silver nitrate amount. $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate and sensitizing dye A and sensitizing dye B were added, and the resulting emulsion was optimally ripened with gold thioglucose as a sensitizer. Further, 1-phenyl-5-mercapto tetrazole and 1-(5-methylureidophenyl)-5-mercaptotetrazole were added. The thus-obtained emulsion was referred to as Emulsion B-H2.

(Preparation of Emulsion B-L2)

Using a conventional method in which silver nitrate and sodium chloride were mixed at the same time with stirring to an aqueous gelatin solution, an emulsion of cubic high silver chloride having an equivalent-sphere diameter of 0.43 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, potassium bromide (3 mole % per mole of the finished silver halide) and $K_4[Ru(CN)_6]$ was added. $K_2[IrCl_6]$ was added at the step of from 83% to 88% addition of the entire silver nitrate amount. Potassium iodide (0.31 mole % per mole of the finished silver halide) was added at the step of completing 90% addition of the entire silver nitrate amount. $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate and sensitizing dye A and sensitizing dye B were added, and the resulting emulsion was optimally ripened with gold thioglucose as a sensitizer. Further, 1-phenyl-5-mercapto tetrazole and 1-(5-methylureidophenyl)-5-mercaptotetrazole were added. The thus-obtained emulsion was referred to as Emulsion B-L2.

(Preparation of Emulsion G-H1)

Using a conventional method in which silver nitrate and sodium chloride were mixed at the same time with stirring to an aqueous gelatin solution, an emulsion of cubic high silver chloride having an equivalent-sphere diameter of 0.51 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (3 mole % per mole of the finished silver halide) was added. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 0.92% to 98% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercaptotetrazole, 1-(5-methylureidophenyl)-5-mercaptotetrazole and potassium bromide were added. The thus-obtained emulsion was referred to as Emulsion G-H1.

(Preparation of Emulsion G-L1)

Using a conventional method in which silver nitrate and sodium chloride were mixed at the same time with stirring to an aqueous gelatin solution, an emulsion of cubic high silver chloride having an equivalent-sphere diameter of 0.41 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (3 mole % per mole of the finished silver halide) was added. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate was added, and the resulting emulsion was optimally ripened with a colloid dispersion of gold sulfide as a sensitizer. Further, a sensitizing dye C, 1-phenyl-5-mercaptotetrazole, 1-(5-methylureidophenyl)-5-mercaptotetrazole and potassium bromide were added. The thus-obtained emulsion was referred to as Emulsion G-L1.

(Preparation of Emulsion R-H1)

Using a conventional method in which silver nitrate and sodium chloride were mixed at the same time with stirring to an aqueous gelatin solution, an emulsion of cubic high silver chloride having an equivalent-sphere diameter of 0.52 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (3 mole % per mole of the finished silver halide) was added. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate was added, and the resulting emulsion was optimally ripened with sodium thiosulfate pentahydrate as a sulfur sensitizer and bis(1,4,5-trimethyl-1,2,4-triazolium-3-thiolate) aurate (I) tetrafluoroborate. Further, a sensitizing dye H, 1-phenyl-5-mercaptotetrazole, 1-(5-methylureidophenyl)-5-mercaptotetrazole, Compound I and potassium bromide were added. The thus-obtained emulsion was referred to as Emulsion R-H1.

(Preparation of Emulsion R-L1)

Using a conventional method in which silver nitrate and sodium chloride were mixed at the same time with stirring to an aqueous gelatin solution, an emulsion of cubic high silver chloride having an equivalent-sphere diameter of 0.44 μm and a variation coefficient of 10% was prepared. In this preparation, however, $Cs_2[Os(NO)Cl_5]$ was added at the step of from 50% to 80% addition of the entire silver nitrate amount. Further, at the step of from 80% to 90% addition of the entire silver nitrate amount, $K_4[Ru(CN)_6]$ was added. At the step of from 80% to 100% addition of the entire silver nitrate amount, potassium bromide (3 mole % per mole of the finished silver halide) was added. $K_2[IrCl_6]$ was added at the step of from 83% to 88% addition of the entire silver nitrate amount. Potassium iodide (0.2 mole % per mole of the finished silver halide) was added at the step of completing 90% addition of the entire silver nitrate amount. Further, $K_2[Ir(5\text{-methylthiazole})Cl_5]$ was added at the step of from 92% to 98% addition of the entire silver nitrate amount. After desalting, gelatin was added to the resulting emulsion for re-dispersion.

To the emulsion, sodium benzene thiosulfonate was added, and the resulting emulsion was optimally ripened with sodium thiosulfate pentahydrate as a sulfur sensitizer and bis (1,4,5-trimethyl-1,2,4-triazolume-3-thiolato)aurate (I).tetrafluoroborate as a gold sensitizer. Further, sensitizing dye H, 1-phenyl-5-mercaptotetrazole, 1-(5-methylureidophenyl)-5-mercaptotetrazole, compound I, and potassium bromide were added. The thus-obtained emulsion was referred to as Emulsion R-L1.

A sample was prepared, with the above-mentioned emulsion, as set forth below.

| | |
|---|---|
| First Layer (Blue-Sensitive Emulsion Layer) | |
| Emulsion B-H1 | 0.105 |
| Emulsion B-L1 | 0.105 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color-Mixing Preventing Layer) | |
| Gelatin | 0.60 |
| Color-mixing inihibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| Emulsion G-H1 | 0.06 |
| Emulsion G-L1 | 0.06 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Preventing Layer) | |
| Gelatin | 0.48 |
| Color mixing-inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-H1 | 0.05 |
| Emulsion R-L1 | 0.05 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

Here was used the same one as the yellow coupler ExY-2 in the above-mentioned EXAMPLE 2.

The sample obtained as mentioned above was referred to as sample 4201. Samples were prepared in the same manner as sample 4201 except that the yellow developable blue-sensitive emulsion and the coating amount of silver were change as shown in Table 12. The thus-obtained samples were referred to as samples 4202 to 4206 respectively.

TABLE 12

| | Yellow developable blue-sensitive emulsion layer | | | Magenta developable green-sensitive emulsion layer | | | Cyan developable red-sensitive emulsion layer | | | Maximum interlayer difference |
|---|---|---|---|---|---|---|---|---|---|---|
| Sample No. | Emulsion | Average equivalent-sphere diameter μm | Coating amount of silver g/m$^2$ | Emulsion | Average equivalent-sphere diameter μm | Coating amount of silver g/m$^2$ | Emulsion | Average equivalent-sphere diameter μm | Coating amount of silver g/m$^2$ | of the average equivalent-sphere diameter % |
| 4201 | B-H1<br>B-L1 | 0.48 | 0.21 | G-H1<br>G-L1 | 0.46 | 0.12 | R-H1<br>R-L1 | 0.48 | 0.10 | 4 |
| 4202 | B-H1<br>B-L1 | 0.48 | 0.19 | G-H1<br>G-L1 | 0.46 | 0.12 | R-H1<br>R-L1 | 0.48 | 0.10 | 4 |
| 4203 | B-H1<br>B-L1 | 0.48 | 0.14 | G-H1<br>G-L1 | 0.46 | 0.12 | R-H1<br>R-L1 | 0.48 | 0.10 | 4 |
| 4204 | B-H2<br>B-L2 | 0.48 | 0.21 | G-H1<br>G-L1 | 0.46 | 0.12 | R-H1<br>R-L1 | 0.48 | 0.10 | 4 |
| 4205 | B-H2<br>B-L2 | 0.48 | 0.19 | G-H1<br>G-L1 | 0.46 | 0.12 | R-H1<br>R-L1 | 0.48 | 0.10 | 4 |
| 4206 | B-H2<br>B-L2 | 0.48 | 0.14 | G-H1<br>G-L1 | 0.46 | 0.12 | R-H1<br>R-L1 | 0.48 | 0.10 | 4 |

Δa*b*, $t_{dev.}$(sec) and Δγ of these samples were measured in the same experiment as in Example 8. The results are shown in Table 13.

TABLE 13

| Sample No. | Δa*b* | $t_{dev.}$(sec) | Δγ |
|---|---|---|---|
| 4201 | 0.16 | 14 | 0.15 |
| 4202 | 0.16 | 14 | 0.14 |
| 4203 | 0.15 | 13 | 0.14 |
| 4204 | 0.09 | 10 | 0.15 |
| 4205 | 0.07 | 9 | 0.14 |
| 4206 | 0.05 | 8 | 0.14 |

Δa*b*; The smaller value is, the less deterioration of white ground is.
$t_{dev.}$(sec); The shorter time is, the more excellent the rapid processability is.
Δγ; The smaller value is, the more stable the fluctuation in processing factors is.

As is apparent from the results in Table 13, it is seen that the effects of the present invention are exerted when the emulsion of the yellow color-developable blue-sensitive emulsion layer contains silver iodide, and these effects are remarkable particularly in the samples of less coating amount of silver.

Having described our invention as related to the present embodiments, it is our intention that the invention not be limited by any of the details of the description, unless otherwise specified, but rather be construed broadly within its spirit and scope as set out in the accompanying claims.

This nonprovisional application claims priority under 35 U.S.C. § 119 (a) on Patent Application No. 2002-190728 filed in Japan on Jun. 28, 2002, Patent Application No. 2002-190629 filed in Japan on Jun. 28, 2002, Patent Application No. 2002-284296 filed in Japan on Sep. 27, 2002, and Patent Application No. 2002-285529 filed in Japan on Sep. 30, 2002, which are herein incorporated by reference.

What is claimed is:

1. A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a total coating amount of silver in the photographic constituent layers is in the range of 0.20 g/m$^2$ to 0.50 g/m$^2$, and at least one of said silver halide emulsion layers contains at least one silver halide emulsion (i) set forth below: (i) a silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below;

$$[IrX^{I}_{n}L^{I}_{(6-n)}]^{m} \qquad \text{Formula (I)}$$

wherein $X^{I}$ represents a halogen ion or a pseudo halogen ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \qquad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

2. A silver halide color photographic light-sensitive material having, on a support, photographic constituent layers comprising at least one silver halide emulsion layer containing a yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein a total coating amount of gelatin in the photographic constituent layers is in the range of 3.0 g/m$^2$ to 6.0 g/m$^2$, and at least one of said silver halide emulsion layers contains said silver halide emulsion of (i) set forth below; (i) a silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below;

$$[IrX^{I}_{n}L^{I}_{(6-n)}]^{m} \quad \text{Formula (I)}$$

wherein $X^{I}$ represents a halogen ion or a pseudo halogen ion; $L^{I}$ represents a ligand different from $X^{I}$; n represents an integer of 3 to 5; and m represents an integer of −5 to +1;

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

3. The silver halide color photographic light-sensitive material as claimed in claim 1 or 2, on a support, having constituent layers comprising at least one silver halide emulsion layer containing a-yellow dye-forming coupler, at least one silver halide emulsion layer containing a magenta dye-forming coupler and at least one silver halide emulsion layer containing a cyan dye-forming coupler, and at least one light-insensitive hydrophilic colloid layer, wherein an average equivalent-sphere diameter of entire silver halide emulsion grains contained in said silver halide emulsion layers is 0.50 μm or less.

4. The silver halide color photographic light-sensitive material as claimed in claim 1, wherein a total coating amount of gelatin in the photographic constituent layers is in the range of 3.0 g/m$^2$ to 6.0 g/m$^2$.

5. The silver halide color photographic light-sensitive material as claimed in claim 1, wherein the total coating amount of silver is 0.25 g/m$^2$ to 0.45 g/m$^2$.

6. The silver halide color photographic light-sensitive material as claimed in claim 1, wherein the total coating amount of silver is 0.30 g/m$^2$ to 0.40 g/m$^2$.

7. The silver halide color photographic light-sensitive material as claimed in claim 2, wherein a total coating amount of gelatin in the photographic constituent layers is in the range of 3.0 g/m$^2$ to 5.5 g/m$^2$.

8. The silver halide color photographic light-sensitive material as claimed in claim 2, wherein a total coating amount of gelatin in the photographic constituent layers is in the range of 3.0 g/m$^2$ to 5.0 g/m$^2$.

9. The silver halide color photographic light-sensitive material as claimed in claim 1, wherein the silver halide emulsion grains have a silver bromide-containing phase or a silver iodide-containing phase.

10. The silver halide color photographic light-sensitive material as claimed in claim 2, wherein the silver halide emulsion grains have a silver bromide-containing phase or a silver iodide-containing phase.

11. A silver halide color photographic light-sensitive material having, on a support, photographic constituent layers comprising at least one silver halide emulsion layer containing a yellow dye-forming coupler, at least one silver halide emulsion layer containing a magenta dye-forming coupler, at least one silver halide emulsion layer containing a cyan dye-forming coupler, and at least one light-insensitive hydrophilic colloid layer, wherein a total coating amount of silver in the photographic constituent layers is in the range of 0.20 g/m$^2$ to 0.50 g/m$^2$, wherein a total coating amount of gelatin in the photographic constituent layers is in the range of 3.0 g/m$^2$ to 6.0 g/m$^2$, wherein an average equivalent-sphere diameter of entire silver halide emulsion grains contained in said silver halide emulsion layers is 0.50 μm or less; wherein at least one of said silver halide emulsion layers contains at least one silver halide emulsion (i) set forth below; and shows, for a characteristic curve A obtained by processing after 10 seconds of $10^{-6}$ seconds exposure and a characteristic curve B obtained by processing after 30 minutes of $10^{-6}$ seconds exposure, an absolute difference value between the point on the axis of the logarithm of exposure amount at which point the characteristic curve A gives a density higher than the minimum density by 0.2 and the point on the axis of the logarithm of exposure amount at which point the characteristic curve B gives a density higher than the minimum density by 0.2, is 0.01 or less;

(i) a silver halide emulsion containing silver halide emulsion grains having a silver chloride content of 90 mole % or more and containing at least one compound selected from metal complexes represented by formula (I) set forth below and at least one compound selected from metal complexes represented by formula (II) set forth below;

$$[IrX^{I}_{n}L^{I}_{(6-n)}]^{m} \quad \text{Formula (I)}$$

wherein $X^{I}$ represents a halogen ion or a pseudo halogen ion; $L^{I}$ represents a ligand different from $X^{I}$; n represents an integer of 3 to 5; and m represents an integer of −5 to +1:

$$[MX^{II}_{n1}L^{II}_{(6-n1)}]^{m1} \quad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and m1 represents an integer of −5 to +1.

* * * * *